US006379107B1

(12) United States Patent
Iwasaki et al.

(10) Patent No.: US 6,379,107 B1
(45) Date of Patent: Apr. 30, 2002

(54) METHOD OF INTRODUCING HEAVY ARTICLE AND METHOD OF DISCHARGING HEAVY ARTICLE

(75) Inventors: Nobuo Iwasaki; Kouichi Tsuruta; Tatuhiko Aoki; Nobuaki Itou, all of Tokai (JP)

(73) Assignee: Toyota Steel Center Co., Ltd., Tokai (JP)

( * ) Notice: Subject to any disclaimer, the term of this patent is extended or adjusted under 35 U.S.C. 154(b) by 0 days.

(21) Appl. No.: 09/410,739

(22) Filed: Oct. 1, 1999

(51) Int. Cl.[7] ..... B65G 67/04

(52) U.S. Cl. ..... 414/809; 414/396; 414/911; 180/125; 108/55.3

(58) Field of Search ..... 414/391, 396, 414/399, 407, 809, 911, 345; 180/125; 108/55.3

(56) References Cited

U.S. PATENT DOCUMENTS

| | | | | | |
|---|---|---|---|---|---|
| 3,472,363 | A | * | 10/1969 | Rustin et al. | 108/55.3 |
| 3,889,831 | A | * | 6/1975 | Davis | 414/911 |
| 4,439,093 | A | * | 3/1984 | Victorino | 414/809 |
| 4,461,455 | A | * | 7/1984 | Mills et al. | 180/125 |
| 4,941,794 | A | * | 7/1990 | Hara et al. | 414/391 |
| 5,452,983 | A | * | 9/1995 | Parmley, Sr. | 414/396 |
| 5,820,330 | A | * | 10/1998 | Focke et al. | 414/911 |
| 6,065,923 | A | * | 5/2000 | Foster | 414/396 |
| 6,231,284 | B1 | * | 5/2001 | Kordel | 108/55.3 |

FOREIGN PATENT DOCUMENTS

| | | | | |
|---|---|---|---|---|
| JP | 52-68581 | | 6/1977 | |
| JP | 56-23126 | | 3/1981 | |
| JP | 62-88630 | | 4/1987 | |
| JP | 62-88631 | | 4/1987 | |
| JP | 63-212601 | * | 1/1988 | 414/399 |
| JP | 6-9009 | | 1/1994 | |
| JP | 6-64717 | | 3/1994 | |

* cited by examiner

*Primary Examiner*—James W. Keenan
(74) *Attorney, Agent, or Firm*—Morgan, Lewis & Bockius LLP

(57) ABSTRACT

A method of introducing/discharging a heavy article is provided that allows for introducing and/or discharging a coil-shape heavy article to and from a transporting receptacle. The method includes utilizing a pallet, a stage, and a carrying vehicle to introduce/discharge the coil-shape heavy article. A coil-shape heavy article is secured to the pallet using a securing member and is transported, while secured to the pallet, between the stage, which is secured to the transporting receptacle, and the transporting receptacle. The stage includes a table having a height that is adjustable relative the floor surface of the transporting receptacle. Movement of the pallet between the stage and the transporting receptacle is performed by levitating a support frame of the carrying vehicle on which the pallet has been positioned using a controllable discharge of gas exiting from exhaust nozzles of the carrying vehicle.

23 Claims, 37 Drawing Sheets

METHOD OF INTRODUCING HEAVY ARTICLE AND METHOD OF DISCHARGING HEAVY ARTICLE

BACKGROUND OF THE INVENTION

The present invention relates to a pallet for transporting a heavy article like a steel material, contained in a transporting receptacle, such as a container. More particularly, the present invention relates to a pallet for a coil-shape heavy article for transporting a heavy article like a coiled steel plate in a transporting receptacle, for example, a container, that allows the cargo to be easily secured, prevents the cargo from being damaged, and reduces the cost, as well as being suitable to be moved by a carrying vehicle (particularly a levitation-type carrying vehicle).

Also the present invention relates to a carrying vehicle, and more particularly, to a carrying vehicle with which a heavy article can easily be introduced into a container without damaging the floor of the container.

Moreover, the present invention relates to a stage for introducing/discharging a heavy article to and from a transporting receptacle and a method of introducing/discharging a heavy article. More particularly, the present invention relates to a stage for introducing/discharging a heavy article to and from a transporting container to introduce a heavy article into a transporting receptacle (in particular, a container) mounted on a chassis by using a carrying vehicle or the like, a method of introducing a heavy article into a transporting receptacle, such as a container, mounted on a chassis and a method of discharging the heavy article from a transporting receptacle.

DESCRIPTION OF THE PRIOR ART

A steel plate to be coiled for handling (hereinafter called as a "coil") usually has a large weight (about 5–10 metric tons for overseas and about 10–30 metric tons for domestic areas) as compared with a cargo which is loaded/unloaded in a usual manner. Therefore, the coil is usually moved by a large forklift or suspended by a large crane or the like.

When the coils are sea-transported, the coils in a state of bulk cargoes are usually shipped on a conventional ship. In the transportation performed by the aforementioned method, each coil packed with the rust preventive paper or steel plates is loaded and unloaded as a unit.

However, the transport ship for transporting the bulk cargoes has been conventionally used for transporting a large quantity of cargoes at one time. Therefore, a vast space is required to temporarily store the transported cargoes in a large quantity. Moreover, operations, such as fixation (called "lashing") of the cargoes, must be performed whenever the transporting means is changed.

Under the above-mentioned circumstance, containerized transportation of the coils has been required. If the cargoes are accommodated in containers so as to be transported, the cargoes are protected by the containers and, therefore, flaws can be reduced. Moreover, the time required to complete the shipping operation can be shortened because the cargoes are handled in units of the containers and the interest rate of the products can be lowered because the time required to transport the product can be shortened.

Any one of a variety of containers may be selected to meet the purpose. Among the various containers, dry containers are containers which are possessed in a largest number, the cost of each of which is the lowest and which can be made available very easily. The dry container exhibits satisfactory air tightness. If a low humidity can be maintained in the inside portion of the container when the container is tightly sealed, the low humidity can be maintained during tight sealing. Therefore, dew condensation is not generated in the coil, thus preventing formation of rust.

Since the dry container has an opening in the side surface thereof, the crane or the like for suspending and moving the cargo cannot introduce the coil into the dry container. As in the case where the large forklift capable of moving a heavy coil has a main body that is larger than the opening of the dry container. Therefore the coil cannot be introduced deeply into the dry container.

To solve the above-mentioned problem, flat containers having no ceiling and open-top containers having the ceilings which can be opened can be available. Since the above-mentioned containers have poor air tightness, outside moisture is undesirably introduced into the container. Therefore, close packing is required to prevent formation of rust. Moreover, the costs of the foregoing containers are higher than those of the dry containers. Since the foregoing containers do not exist in a sufficient number, the containers cannot easily be reserved. Moreover, the open-top containers usually encounter difficulty in opening the ceilings thereof as compared with the dry containers.

Even if the dry containers are employed, use of packing materials, such as wood, which easily contain water causes water in the packing material to be vaporized. As a result, vapor is condensed on the ceiling or the like, causing vapor to be dropped onto the coil. Therefore, rust is easily formed.

Since usual coils are held such that the axes of the coils are oriented horizontally, the coils are easily rolled. To prevent rolling, the coils are secured to the floor, walls or the like with ropes or wood members. The foregoing operation requires great labor and excessively long time.

When heavy articles, such as the steel-plate coils, are exported, the physical distribution of the heavy articles with the dry containers must follow the procedure below.

Initially, the heavy article is, by a forklift or the like, introduced into the dry container directly placed on the floor. Then, the container is lifted by a machine, such as a crane or a large forklift, which is capable of lifting the container, so as to be placed on a chassis (a car for carrying the container). Then, the chassis is transported to a marshalling yard (a portion in which containers having cargoes which must be shipped are placed).

If the heavy article, such as the coil, can directly be introduced into an empty transporting receptacle, such as a container, placed on the chassis, time required to complete the transportation and labor cost can greatly be saved.

Since the chassis has a suspension, the height of the floor of the dry container is, however, lowered whenever one heavy article is introduced into the dry container placed on the chassis. Therefore, a stepped portion is formed between the height of the floor of a container freight station on which the heavy articles, which must be introduced, are placed and the forklifts or the like run and the floor of the dry container. As a result, introduction of the heavy article by using the carrying vehicle, such as the forklift, which runs on the surface of the floor, cannot easily be performed.

The above-mentioned problem becomes critical as the diameter of each wheel of the carrying vehicle is reduced and the minimum road clearance is lowered. When the heavy article is introduced into the container by using the carrying vehicle, such as the forklift, the size of the carrying vehicle is limited to a size with which the carrying vehicle can be introduced into the container. Therefore, the minimum road clearance and the diameters of the wheels cannot be enlarged. The limitation of the size of the carrying vehicle may cause another problem of limiting the weight of the heavy article which can be introduced by the carrying vehicle.

In case of using the air-levitation-type carrying vehicle, the distance from the floor to the bottom surface of the carrying vehicle is rapidly changed when the carrying vehicle passes on the stepped portion. In such a case, there is the possibility that the bottom surface of the carrying vehicle is brought into contact with the floor.

Hitherto, the coil-shape thin plates are exported without using the container on the ground of the reason to be described later. In the foregoing case, each coil as a unit is loaded, unloaded and stored separately.

In order to prevent the flaw resulting from the lifting operation using a tongue, the flaw resulting from interference between cargoes, and rust formed during the transportation or in a relay warehouse, each coil has been closely packed with rust preventive paper or steel plates. The close packing operation demands considerable labor and time.

However, the coil sometimes suffers from the flaw during loading or unloading the coil. Since the coils are directly stacked during shipping, there arises another problem of deforming the coil owning to the weights of the stacked coils.

Since no container is used, a usual periodical shipping service cannot be used. Therefore, collective transportation of coils in a large quantity using conventional ships of dedicated shipping services has been performed. Thus, transportation is not performed until coils in a predetermined quantity are collected. Therefore, a period of time required to complete the transportation is elongated undesirably. Moreover, intermediate inventories in a large quantity are carried during the process of the distribution.

As a method of solving the above-mentioned problems, it might be feasible to employ transportation using containers. Since the sealed type dry container has an inlet portion formed in the side surface thereof, .the coil cannot be introduced from a position above the container by lifting the coil by a crane or the like. On the other hand, the open-top container and the flat-track container having opened upper portion cannot maintain air tightness. Therefore, packing of the coil for preventing rust cannot be simplified. Thus, the problem of packing cannot be solved. Since the open-top container and the flat-track container are costly containers and, therefore, only a small quantity is distributed. Therefore, there arises another problem in that the cost cannot be reduced and smooth physical distribution cannot be performed.

It might therefore be considered feasible to transport the coils by using dry containers each of which has air tightness, which exhibits a low cost and a large quantity of available numbers and which can therefore easily be reserved. When the coils are introduced, the forklift is used in place of the crane.

In general, the doors of the dry container are disposed opposite to each other in the lengthwise direction of the rectangular parallelopiped dry container. Therefore, when the coil is introduced deeply into the dry container through the openings of the doors, the size of the carrying vehicle, such as the forklift, is limited such that the carrying vehicle can be introduced into the container. Therefore, the above-mentioned method has a limitation that the weight of a cargo which can be handled must be lighter than a weight which can be lifted by the carrying vehicle which can be introduced into the container.

Since loads are, on the floor, concentrated to a point of contact of each tire of the carrying vehicle, such as the forklift, there arises a problem in that the bottom of the container is broken by the carrying vehicle introduced into the container. Moreover, the forklift bears a cargo in a front portion thereof and therefore incorporates a counter balance for keeping the balance of the weight. Therefore, there arises another problem in that excessively heavy weight is added to each point of contact.

As an invention which is capable of solving the above-mentioned problems, a cargo loading apparatus has been disclosed in Japanese Patent Laid-Open No. 8-208195, which incorporates rollers disposed in the lower portion of the forks of the forklift to bear the weight of the cargo to enable even a small forklift to lift a heavy cargo.

Even with the aforementioned invention having increased wheels, as far as wheels are employed, it is impossible to avoid concentration of the point of contact of each wheel. Moreover, after introducing the coil into the container, the coil has to be firmly secured. When employing a conveyance conveyor in place of the forklift, the foregoing problem will occur.

Since the forklift has the counter balance, the excessive weight will be added to the floor of the container.

The foregoing problems have been experienced with not only the thin-plate but also the heavy article like machinery.

SUMMARY OF THE INVENTION

An object of the present invention is to provide a pallet for a coil-shape heavy article which is capable of easily carrying a steel plate as the coil-shape heavy article to a dry container having an opening formed in the side surface thereof and with which a cargo can easily be secured without causing any flaw.

In view of the foregoing, another object of the present invention is to provide a heavy-article carrying vehicle which enables a heavy article to be transported with a container and which is able to easily introduce a heavy article into a container without damaging the floor of the container.

In view of the foregoing, another object of the present invention is to provide a stage for introducing/discharging a heavy article to and from a transporting receptacle such that direct introduction of a heavy article into a transporting receptacle like a container, placed on a chassis by using a carrying vehicle or the like is permitted, a method of introducing a heavy article into a transporting receptacle, for example, a container placed on a chassis and a method of discharging a heavy article from a transporting receptacle.

A pallet for a coil-shape heavy article according to a first aspect of the present invention is a pallet for a coil-shape heavy article arranged to be accommodated in a transporting receptacle in a state in which a coil-shape heavy article has been placed on the pallet, the pallet for a coil-shape heavy article being characterized by a pallet body, a holding portion disposed on the pallet body and structured to be in contact with side surfaces of the cylindrical coil-shape heavy article to support the coil-shape heavy article, and a lower opening formed downward of the pallet body and opened in at least a lower portion thereof or one of side portions thereof, in which a coil securing member for securing the coil-shape heavy article to the pallet body is disposed on the pallet for the coil-shape heavy article, and when the number of the pallet for the coil-shape heavy article is one, the size of the one pallet for the coil-shape heavy article is substantially the same as the planar size of the transporting receptacle and when the number of the pallet for the coil-shape heavy article is two or more, the size of the combined pallets for the coil-shape heavy article is substantially the same as the planar size of the transporting receptacle.

The "coil-shape heavy article" represents an elongated article wound to be formed into a coil form. The material of the elongated article is not limited particularly and exemplified by steel, stainless steel, aluminum and synthetic resin. The weight, width, the number of windings and so forth of the coil-shape heavy article are not limited particularly. The weight of the heavy article may be 100 kg or greater to be in the range from about 100 kg to about 100 metric tons. It is preferable that the weight is in the range from about 100 kg to about 50 metric tons. In general, it is in the range from about 1 ton to about 20 metric tons. The foregoing weight range is applied to the following aspects.

The "transporting receptacle" may be a structure incorporating a receptacle for accommodating the coil-shape heavy article. The transporting receptacle is exemplified by a container, a truck having a receptacle like a container and a freight car (that is, a structure in which a receptacle like a container is secured to the chassis of a truck or a freight car). The foregoing definition is applied to the following aspects.

The expression that "opened in at least a lower portion thereof or one of side portions thereof" does not mean openings facing all of the specified directions. The opening is required to be formed in any one of a "front portion", a "rear portion", a "right portion" and a "left portion". That is, the "lower opening" may be formed in only the "lower direction" and the "rear direction".

The lower opening may be a space through which the carrying vehicle for carrying the pallet according to the present invention or a portion of the same is introduced, a space to which a securing member for securing the coil-shape heavy article to the pallet is secured or a space for another arbitrary purpose.

The expression that "when the number of the pallet for the coil-shape heavy article is one, the size of the one pallet for the coil-shape heavy article is substantially the same as the planar size of the transporting receptacle and when the number of the pallet for the coil-shape heavy article is two or more, the size of the combined pallets for the coil-shape heavy article is substantially the same as the planar size of the transporting receptacle" will now be described. Assuming that the bottom of the pallet is formed into a rectangle, the shape and size of the present invention may be those which are substantially the same as those of the bottom surface of the transporting receptacle. A bottom shape obtained by combining two or more pallets having various sizes and shapes may be those which are substantially the same as those of the transporting receptacle.

The pallets to be combined may be formed into shapes obtained by equally dividing the longer side (or the shorter side) of the bottom surface of the transporting receptacle into two, three, four, five or the like. Similarly, pallets having sizes which are ⅙, ⅔, ⅜ or the like (see FIG. 14) may be combined with one another. Pallets having sizes which are ⅖, ⅗ or the like which are not sizes obtained by equal division may be combined with one another. Pallets each having a size which is ⅙ of the bottom surface such that the shorter side is bisected, that is, pallets formed into shapes obtained by dividing both of the longer side and shorter side of the bottom surface may be combined with one another.

A pallet for a coil-shape heavy article according to a second aspect of the present invention has a structure wherein the holding portion has inclined surfaces, a pair of the inclined surfaces are formed opposite to each other, and the coil securing member is a band for binding and securing the coil and/or movement inhibiting members disposed on the two sides of the coil.

The holding portion may be a structure which can be attached/detached to and from the body of the pallet for a coil-shape heavy article. An attaching/detaching means between the holding portion and the pallet for a coil-shape heavy article is exemplified by a structure using joining members, for example, screws or other joining members to join the two elements to each other. The attachable/detachable pallet enables loading portions adaptable to the size of the container and a holding portion having an appropriate coil support portion adaptable to the size of the coil to be combined with each other.

The movement inhibiting member may be an elongated member (members 26*a* and 26*b* each having a U-shape facing side or a column member shown in FIG. 1) detachably joined to a guide for the movement inhibiting member. As shown in FIGS. 23 and 24, erect members 28*a* and 28*b* disposed slidably on slide rails may be employed. To slide the slidable movement-inhibition-member, slide rails are disposed between a pair of the holding portions in a direction substantially perpendicular to a direction in which the pair of holding portions are opposite to each other. The slide rails extend from a position at which the slide rails are interposed between the holding portions forming the pair to reach a position over the end of the holding portions. A pair of the movement inhibiting members is slidably stood erect, the movement inhibiting members each having a height higher than the lower end of the inclined surface.

The shape of the pallet according to the present invention may be an arbitrary shape adaptable to the shape of the coil-shape heavy article and a direction in which the coil-shape heavy article is held. For example, a structure may be employed in which the holding portion is disposed on a leg structure formed by combining four square timbers into the number-sign-like configuration. Another structure in which the holding portion is disposed on a flat frame member or a box-like structure may be employed.

A pallet for a coil-shape heavy article according to a third aspect of the present invention has a structure wherein the pallet body is provided with at least four column stack-support portions formed into a quadrangle configuration, and when the coil-shape heavy article is not held (not loaded), stacking of other pallets for the coil-shape heavy article above and below said pallet body is permitted. The number of the stack-supported portions is usually four, but the number may be increased. Also, although the configuration of the four stack-support portions is usually a triangle or a square, the configuration is not limited to the foregoing configurations. To vertically stack the pallets, all of the pallets have the stack-support portions formed at the corresponding positions. The upper and lower surfaces of the stack-support portions are required to be formed such that slippage can be prevented. For example, the surfaces may be any one of the following structures: (1) both of the surfaces are formed into planar shapes; (2) one of the surfaces has a projecting shape (a convex shape) while another surface has a recessed shape (a concave shape); or (3) the upper surface has engaging projections, while the lower surface has corresponding engaging recesses.

A heavy-article carrying vehicle according to a fourth aspect of the present invention is characterized by a support frame for lifting a pallet, and a plurality of exhaust nozzles provided for the lower surface of the support frame to discharge gas flows to the floor surface at a predetermined pressure so as to be capable of levitating the support frame in a state in which the pallet loaded with a heavy article has been placed on the support frame, in which the plural exhaust nozzles, valves for the exhaust nozzles for adjusting amounts of exhaust gas from the exhaust nozzles and a control stick which is capable of simultaneously controlling degrees of opening of the plural valves are provided so that control of the attitude of the support frame is permitted when the control stick is operated.

A heavy-article carrying vehicle according to a fifth aspect of the present invention has a structure wherein the number of exhaust nozzles is four, the four exhaust nozzles are disposed in a quadrangle configuration, and assuming that the nozzle disposed at the right front in a direction of transportation is a right-front nozzle, the nozzle disposed at the right rear is a right-rear nozzle, the nozzle disposed at the left front is a left-front nozzle and the nozzle disposed left rear is a left-rear nozzle, the nozzles forming each of four pairs composed of a pair formed by the right-front nozzle and the right-rear nozzle, a pair formed by the left-front nozzle and the left-rear nozzle, a pair formed by the right-front nozzle and the left-front nozzle and a pair formed by the right-rear nozzle and the left-rear nozzle are connected to each other through a connecting pipe.

Since the four nozzles are grouped into four which are right, left, front and rear nozzles, the roll angle of the support frame (an angle of lateral inclination with respect to the longitudinal direction) can be controlled by adjusting amounts of gas discharge from the right and left nozzles. When amounts of gas discharge from the front and rear nozzles are adjusted, the pitch angle (an angle of longitudinal inclination with respect to the lateral axis) of the support frame can be controlled. Therefore, the right, left, front and rear directional attitudes can easily be controlled.

If the nozzles are not positioned at the right, left, front and rear positions of the support frame, control of the amounts of gas discharge from the nozzles performed synchronously enables the attitude to be controlled.

At least one pair of the pipes connected to one pair of corresponding exhaust nozzles for controlling the attitude may be connected to each other through a connection pipe which is provided with a valve for adjusting the flow rate.

The expression that "one pair of corresponding exhaust nozzles for controlling the attitude" is one pair of exhaust nozzles disposed symmetrically or one pair of exhaust nozzles disposed in the longitudinal direction. If the carrying vehicle is inclined to the left, the attitude of the carrying vehicle is controlled by enlarging the amounts of gas discharge from the left nozzles. Moreover, the amounts of gas discharge from the right nozzles are reduced. If the carrying vehicle is inclined forwards, the amounts of gas discharge from the front nozzles are enlarged. Moreover, the amounts of gas discharge from the rear nozzles are reduced. The nozzles having the above-mentioned relationship are the "one pair of corresponding exhaust nozzles for controlling the attitude".

The connection between the pair composed of the right front nozzle and the left rear nozzle and the connection between the pair composed of the left front nozzle and the right rear nozzle may be added.

A stage for introducing/discharging a heavy article to and from a transporting receptacle according to the present invention is characterized by a support column disposed adjacent to an opening door of a transporting receptacle placed on the chassis and secured to the chassis and structured to fix the height of the chassis and the height of the transporting receptacle by fixing the positions of corner metal members adjacent to the opening door of the transporting receptacle; and a table disposed to be adjacent to the opening when the support column has been disposed adjacent to the opening door of the transporting receptacle so as to introduce a carrying vehicle for introducing a heavy article into the transporting receptacle on standby, wherein the table has a support portion for individually bearing the weight of an article which has been placed thereon, and the support portion is able to coincide the height of the upper surface of the table with the height of the floor surface of the transporting receptacle.

The expression that "disposed adjacent to an opening door of a transporting receptacle" does not mean that the stage for introducing/discharging a heavy article to and from a transporting receptacle is directly provided for the transporting receptacle. That is, the stage for introducing/discharging a heavy article to and from a transporting receptacle is disposed on the ground, the floor surface or the like. In this case, the position is "adjacent to the opening door of the transporting receptacle."

The "corner metal members" are members for securing the chassis and the transporting receptacle to each other, securing the transporting receptacles on the ship and performing a lifting operation using a crane or a gantry crane. The corner metal members are disposed at the (upper and lower) vertexes of the transporting receptacle. The expression "fix the height" means fixing the "position" in the direction of the height of an article to be constant. The expression that "individually bearing the weight of an article which has been placed on the table" means a fact that the chassis or the transporting receptacle does not bear the weight of the article placed on the table.

A stage for introducing/discharging a heavy article to and from a transporting receptacle according to a seventh aspect of the present invention has a structure wherein the support column incorporates an engaging member having a leading end, the width of which is larger than the width of a root portion thereof, the engaging member is inserted into an elongated hole of the corner metal member joined to a comer of the upper surface of the transporting receptacle at a position adjacent to the opening door and the engaging member is pivoted for a predetermined angle about an insertion direction so that a leading end of the engaging member is engaged to the corner metal member, and the engaging member is suspended at a predetermined height to prevent lowering of the height of the corner metal member so that the heights of the transporting receptacle on the chassis and the chassis to which the transporting receptacle has been secured are fixed.

The "engaging member" is a member having a leading end, the thickness of which is smaller than the width (the thickness) of the elongated hole formed in the corner metal member and a horizontal width which is larger than the width (the thickness) of the elongated hole of the corner metal member. The root portion has a diameter with which rotation in the elongated hole of the corner metal member is permitted. If the above-mentioned requirements are satisfied, any member may be employed. For example, a member having a leading end formed into a triangular plate may be employed. Another member having a leading end formed into a pentagonal shape like a home plate may be employed. A hook-shape member may be employed.

A stage for introducing/discharging a heavy article to and from a transporting receptacle according to an eighth aspect of the present invention has a structure wherein the support column has engaging members, and the engaging members are inserted into elongated holes of corner metal members joined to the right and left lower corners adjacent to the opening door of the transporting receptacle to support the engaging members at a predetermined height so as to prevent lowering of the heights of the corner metal members so that the heights of the transporting receptacle on the chassis and the chassis to which the transporting receptacle has been secured are fixed.

The expression that "the right and left lower corners" means right and left corners in the lower portion of the transporting receptacle in a direction toward the opening of the transporting receptacle placed on the chassis.

A stage for introducing/discharging a heavy article to and from a transporting receptacle according to a ninth aspect of the present invention has a structure wherein the support column incorporates a guide rail disposed vertically, a slide portion slidably engaged to the guide rail and enabling the engaging member to be introduced/discharged in a direction perpendicular to the guide rail and slide-portion lifting means which is capable of supporting the slide portion at a predetermined height.

A stage for introducing/discharging a heavy article to and from a transporting receptacle according to a tenth aspect of the present invention has a structure wherein the slide-portion lifting means supports the slide portion with rollers thereof.

A stage for introducing/discharging a heavy article to and from a transporting receptacle a according to a eleventh aspect of the present invention has a structure wherein at least two guide rails are provided, and the slide portion is engaged to the guide rails at two or more points of the two guide rails in a vertical direction so that the slide portion is able to slide along the guide rails.

Note that the stage for introducing/discharging a heavy article to and from a transporting receptacle may be structured to have a leakage-preventive sheet disposed at least across a gap between an end of the table and the end of the floor surface of the transporting receptacle which are positioned opposite to each other.

The above-mentioned stage for introducing/discharging a heavy article to and from a transporting receptacle has the leakage-preventive sheet disposed over the gap between the end of the table and the end of the floor surface of the transporting receptacle. Therefore, when using a carrying vehicle arranged to be levitated by discharging gas, downward leakage of discharged gas through a gap between the end of the table and the end of the floor surface of the transporting receptacle causing the lift to be reduced can be prevented.

Since the leakage-preventive sheet exhibits flexibility, a gap cannot easily be formed between the upper surface of the table and the floor surface of the transporting receptacle differently from a structure using a plate having rigidity to close the gap. Therefore, leakage of gas can effectively be prevented. Since the upper surface of the table and the floor surface of the transporting receptacle are connected to each other after the leakage-preventive sheet has been placed, disorder of a gas flow discharged from the levitation-type carrying vehicle can be prevented. Therefore, disorder of the attitude of the carrying vehicle can be prevented.

The present invention may be formed as a stage for introducing/discharging a heavy article to and from a transporting receptacle incorporating a sheet winding reel which is capable of winding the leakage-preventive sheet up.

When the leakage-preventive sheet is fixedly joined to the stage for introducing/discharging a heavy article to and from a transporting receptacle, the leakage-preventive sheet is undesirably suspended from the front end of the table downwards before installment of the stage for introducing/discharging a heavy article to and from a transporting receptacle to the transporting receptacle. Therefore, the complex process is required to raise the leakage-preventive sheet suspended between the front end of the table and the transporting receptacle to cause the leakage-preventive sheet to reach the floor surface of the transporting receptacle after the stage has been placed in the transporting receptacle.

The stage for introducing/discharging a heavy article to and from a transporting receptacle incorporates the sheet winding reel. Therefore, the leakage-preventive sheet can be wound around the sheet winding reel before the stage is placed in the transporting receptacle. Then, the leakage-preventive sheet is pulled out to the upper surface of the table after the stage has been disposed in the transporting receptacle such that the leakage-preventive sheet reaches the floor surface of the transporting receptacle.

It can also be formed such that the sheet winding reel is disposed downward of the upper surface of the table. The foregoing leakage-preventive sheet is the stage for introducing/discharging a heavy article to and from a transporting receptacle which is pulled out to the upper surface of the table through a slit formed in the table or from the rear end of the table or wound by the sheet winding reel.

Since the stage for introducing/discharging a heavy article to and from a transporting receptacle incorporates the sheet winding reel which is disposed downward of the table and the leakage-preventive sheet is pulled out or wound through the slit or from the rear end of the table, the sheet winding reel does not obstruct the operation for introducing a heavy article to be performed on the table.

It can further be formed such that a stage for introducing/discharging a heavy article to and from a transporting receptacle incorporates an air supply hose for supplying gas (compressed air) and a hose reel for winding the air supply hose up.

The foregoing stage for introducing/discharging a heavy article to and from a transporting receptacle incorporates the air supply hose and the hose reel. Therefore, when performing a conveying operation using a carrying vehicle arranged to be levitated by discharging gas, the air supply hose connected to the carrying vehicle does not move around on the ground, thus securing the safe operation.

In the foregoing case, the hose reel can be wound up when the operation is not performed. When a required length of the hose is short in accordance with the operation (if a cargo is introduced into an area adjacent to the inlet portion of the transporting receptacle), the rest unnecessary portion of the hose can be wound up. Therefore, the operator is not entangled his/her feet in the unnecessary unwound hose, thus securing safe operation. Moreover, a possibility that air supply is interrupted because the unnecessary portion of the air supply hose is stepped on can be lowered.

A stage for introducing/discharging a heavy article to and from a transporting receptacle according to a twelfth aspect of the present invention includes a table that incorporates attitude control means.

A stage for introducing/discharging a heavy article to and from a transporting receptacle according to a thirteenth aspect of the present invention utilizes a transporting receptacle that is a container.

A method of introducing a heavy article according to a fourteenth aspect of the present invention is a method of introducing a heavy article using a stage for introducing a heavy article to and from a transporting receptacle to introduce a coil-shape heavy article into a transporting receptacle placed on a chassis, the method of introducing a heavy article being characterized in that the method includes conveying, by a heavy-article carrying vehicle, a pallet incorporating a holding frame on which the coil-shape heavy article is held and leg portions for supporting the holding frame at a predetermined height and forming a space between the holding frame and the surface of the floor to introduce the coil-shape heavy article placed on the pallet and secured to the pallet into the transporting receptacle. The stage for introducing a heavy-article includes a support column disposed adjacent to an opening door of the transporting receptacle placed on the chassis and secured to the chassis and structured to fix the height of the chassis and the height of the transporting receptacle by fixing the positions of corner metal members adjacent to the opening door of the transporting receptacle; and a table disposed to be adjacent to the opening when the support column has been disposed adjacent to the opening door of the transporting receptacle so as to introduce the heavy carrying vehicle for introducing the heavy article into the transporting receptacle on standby, wherein the table has a support portion for individually bearing the weight of the pallet on which a coil-shape heavy article has been placed, and the support portion is able to coincide the height of the upper surface of the table with the height of the floor surface of the transporting receptacle. The pallet includes a pallet body, and a lower opening formed downward of the pallet body and opened in at least a lower portion thereof or one of side portions thereof, wherein a coil securing member for securing the coil-shape heavy article to the pallet body is disposed on the pallet for the coil-shape heavy article, and the holding frame being disposed on the pallet body and structured to be in contact with side surfaces of the coil-shape heavy article to support the coil-shape heavy article. The heavy-article carrying vehicle includes a support frame for lifting a pallet; and a plurality of exhaust nozzles provided for the lower surface of the support frame to discharge gas flows to the floor surface at a predetermined pressure so as to be capable of levitating the support frame in a state where the pallet loaded with a heavy article has been placed on the support frame, wherein the plural exhaust nozzles, valves for the exhaust nozzles for adjusting amounts of exhaust gas from the exhaust nozzles and a control stick which is capable of simultaneously controlling degrees of opening of the plural valves are provided so that control of the attitude of the support frame is permitted when the control stick is operated; and the conveying to introduce the coil-shape heavy article into the transporting receptacle includes the following sequentially performed steps:

(1) the heavy-article carrying vehicle is placed on the table, an engaging member is previously placed on the support frame of the heavy-article carrying vehicle, the pallet on which the heavy article is held and secured is placed on the heavy-article carrying vehicle such that support frame of the heavy-article carrying vehicle is positioned in a space downward of the holding frame of the pallet and the leg portions of the pallet are positioned across the support frame of the heavy-article carrying vehicle, and then the heavy-article carrying vehicle is levitated so as to raise the heavy article through the engaging member and the pallet;

(2) the heavy article is introduced into the transporting receptacle by the heavy-article carrying vehicle;

(3) initially, amounts of gas discharge from the exhaust nozzles of the heavy-article carrying vehicle are reduced or set to be zero to temporarily lower the support frame to bring the leg portions of the pallet into contact with the ground to enlarge the gap between the lower surface of the holding frame of the pallet and the upper surface of the support frame of the heavy-article carrying vehicle so as to unload the heavy article from the heavy-article carrying vehicle, and then the engaging member disposed between the support frame of the heavy-article carrying vehicle and the lower surface of the holding frame is removed, followed by moving the heavy-article carrying vehicle rearwards so as to discharge the support frame from the space below the holding frame of the pallet; and (4) the heavy-article carrying vehicle is returned to the upper surface of the table.

A method of introducing a heavy article according to a fifteenth aspect of the present invention is a method of introducing a heavy article using a stage for introducing a heavy article to and from a transporting receptacle to introduce a coil-shape heavy article into a transporting receptacle placed on a chassis, the method of introducing a heavy article being characterized in that the method includes conveying, by a heavy-article carrying vehicle, a pallet incorporating a holding frame on which the coil-shape heavy article is held and leg portions for supporting the holding frame at a predetermined height and forming a space between the holding frame and the surface of the floor to introduce the coil-shape heavy article placed on the pallet and secured to the pallet into the transporting receptacle. The stage for introducing a heavy-article includes a support column disposed adjacent to an opening door of the transporting receptacle placed on the chassis and secured to the chassis and structured to fix the height of the chassis and the height of the transporting receptacle by fixing the positions of corner metal members adjacent to the opening door of the transporting receptacle; and a table disposed to be adjacent to the opening when the support column has been disposed adjacent to the opening door of the transporting receptacle so as to introduce the heavy carrying vehicle for introducing the heavy article into the transporting receptacle on standby, wherein the table has a support portion for individually bearing the weight of the pallet on which a coil-shape heavy article has been placed, and the support portion is able to coincide the height of the upper surface of the table with the height of the floor surface of the transporting receptacle. The pallet includes a pallet body, and a lower opening formed downward of the pallet body and opened in at least a lower portion thereof or one of side portions thereof, wherein a coil securing member for securing the coil-shape heavy article to the pallet body is disposed on the pallet for the coil-shape heavy article, and the holding frame being disposed on the pallet body and structured to be in contact with side surfaces of the coil-shape heavy article to support the coil-shape heavy article. The heavy-article carrying vehicle includes a support frame for lifting a pallet; and a plurality of exhaust nozzles provided for the lower surface of the support frame to discharge gas flows to the floor surface at a predetermined pressure so as to be capable of levitating the support frame in a state where the pallet loaded with a heavy article has been placed on the support frame, wherein the plural exhaust nozzles, valves for the exhaust nozzles for adjusting amounts of exhaust gas from the exhaust nozzles and a control stick which is capable of simultaneously controlling degrees of opening of the plural valves are provided so that control of the attitude of the support frame is permitted when the control stick is operated; and the conveying to introduce the coil-shape heavy article into the transporting receptacle includes the following sequentially performed steps:

(1) the heavy-article carrying vehicle is placed on the table of the stage, the pallet on which the heavy article is held and secured is positioned on the heavy-article carrying vehicle such that support frame of the heavy-article carrying vehicle is positioned in a space downward of the holding frame of the pallet and the leg portions of the pallet are positioned across the support frame of the heavy-article carrying vehicle, and then an engaging member is placed on the support frame of the heavy-article carrying vehicle, and then the heavy-article carrying vehicle is levitated so as to raise the heavy article through the pallet;

(2) the heavy article is introduced into the transporting receptacle by the heavy-article carrying vehicle;

(3) initially, amounts of gas discharge from exhaust nozzles of the heavy-article carrying vehicle are reduced or set to be zero to temporarily lower the support frame to bring the leg portions of the pallet into contact with the ground to enlarge the gap between the lower surface of the holding frame of the pallet and the upper surface of the support frame of the heavy-article carrying vehicle so as to unload the heavy article from the heavy-article carrying vehicle, and then the engaging member disposed between the support frame of the heavy-article carrying vehicle and the lower surface of the holding frame is removed, followed by rearwards moving the heavy-article carrying vehicle so as to discharge the support frame from the space below the holding frame of the pallet; and (4) the heavy-article carrying vehicle is returned to the upper surface of the table.

A method of introducing a heavy article according to a sixteenth aspect of the present invention is a method of introducing a heavy article by using no engaging member and using a stage for introducing a heavy article to and from a transporting receptacle to introduce a coil-shape heavy article into a transporting receptacle placed on a chassis, the method of introducing a heavy article being characterized in that the method includes conveying, by a heavy-article carrying vehicle, a pallet incorporating a holding frame on which the coil-shape heavy article is held and leg portions for supporting the holding frame at a predetermined height and forming a space between the holding frame and the surface of the floor to introduce the coil-shape heavy article placed on the pallet and secured to the pallet into the transporting receptacle. The stage for introducing a heavy-article includes a support column disposed adjacent to an opening door of the transporting receptacle placed on the chassis and secured to the chassis and structured to fix the height of the chassis and the height of the transporting receptacle by fixing the positions of corner metal members adjacent to the opening door of the transporting receptacle; and a table disposed to be adjacent to the opening when the support column has been disposed adjacent to the opening door of the transporting receptacle so as to introduce the heavy carrying vehicle for introducing the heavy article into the transporting receptacle on standby, wherein the table has a support portion for individually bearing the weight of the pallet on which a coil-shape heavy article has been placed, and the support portion is able to coincide the height of the upper surface of the table with the height of the floor surface of the transporting receptacle. The pallet includes a pallet body, and a lower opening formed downward of the pallet body and opened in at least a lower portion thereof or one of side portions thereof, wherein a coil securing member for securing the coil-shape heavy article to the pallet body is disposed on the pallet for the coil-shape heavy article, and the holding frame being disposed on the pallet body and structured to be in contact with side surfaces of the coil-shape heavy article to support the coil-shape heavy article. The heavy-article carrying vehicle includes a support frame for lifting a pallet; and a plurality of exhaust nozzles provided for the lower surface of the support frame to discharge gas flows to the floor surface at a predetermined pressure so as to be capable of levitating the support frame in a state where the pallet loaded with a heavy article has been placed on the support frame, wherein the plural exhaust nozzles, valves for the exhaust nozzles for adjusting amounts of exhaust gas from the exhaust nozzles and a control stick which is capable of simultaneously controlling degrees of opening of the plural valves are provided so that control of the attitude of the support frame is permitted when the control stick is operated; and the conveying to introduce the coil-shape heavy article into the transporting receptacle includes the following sequentially performed steps:

(1) the heavy-article carrying vehicle is placed on the table, the pallet on which the heavy article is held and secured is placed on the heavy-article carrying vehicle such that support frame of the heavy-article carrying vehicle is positioned in a space downward of the holding frame of the pallet and the leg portions of the pallet are positioned across the support frame of the heavy-article carrying vehicle, and then the heavy-article carrying vehicle is levitated so as to raise the heavy article through the pallet;

(2) the heavy article is introduced into the transporting receptacle by the heavy-article carrying vehicle;

(3) initially, amounts of gas discharge from exhaust nozzles of the heavy-article carrying vehicle are reduced or set to be zero to temporarily lower the support frame to bring the leg portions of the pallet into contact with the ground to enlarge the gap between the lower surface of the holding frame of the pallet and the upper surface of the support frame of the heavy-article carrying vehicle so as to unload the heavy article from the heavy-article carrying vehicle, followed by rearwards moving the heavy-article carrying vehicle so as to discharge the support frame from the space below the holding frame of the pallet; and (4) the heavy-article carrying vehicle is returned to the upper surface of the table.

A method of introducing a heavy article according to a seventeenth aspect of the present invention includes a pallet holding portion with inclined surfaces, a pair of the inclined surfaces formed opposite to each other, and a coil securing member including a band for binding and securing the coil and/or movement inhibiting members disposed on the two sides of the coil.

A method of introducing a heavy article according to a eighteenth aspect of the present invention utilizes a pallet body that is provided with at least four column stack-support portions formed into a quadrangle configuration, and when a coil-shape heavy article is not held, stacking of other pallets for the coil-shape heavy article above and below the pallet body is permitted.

A method of introducing a heavy article according to a nineteenth aspect of the present invention includes a heavy-article carrying vehicle having an exhaust nozzle configuration wherein the number of the exhaust nozzles is four, the four exhaust nozzles are disposed in a quadrangle configuration, and assuming that the nozzle disposed at the right front in a direction of transportation is a right-front nozzle, the nozzle disposed at the right rear is a right-rear nozzle, the nozzle disposed at the left front is a left-front nozzle and the nozzle disposed left rear is a left-rear nozzle, the nozzles forming each of four pairs composed of a pair formed by the right-front nozzle and the right-rear nozzle, a pair formed by the left-front nozzle and the left-rear nozzle, a pair formed by the right-front nozzle and the left-front nozzle and a pair formed by the right-rear nozzle and the left-rear nozzle are connected to each other through a connecting pipe.

A method of introducing a heavy article according to a twentieth aspect of the present invention includes utilizing a transporting receptacle that is a container.

A method of discharging a heavy article according to a twenty-first aspect of the present invention is a method of discharging a heavy article using a stage for introducing/discharging a heavy article to and from a transporting receptacle to discharge a coil-shape heavy article from a transporting receptacle placed on a chassis, the method of discharging a heavy article being characterized in that the method including carrying, by a heavy-article carrying vehicle, a pallet incorporating a holding frame on which the coil-shape heavy article is held and leg portions for supporting the holding frame at a predetermined height and forming a space between the holding frame and the surface of the floor to discharge the heavy article placed on the pallet and secured to the pallet from the transporting receptacle. The stage for introducing/discharging a heavy-article includes a support column disposed adjacent to an opening door of the transporting receptacle placed on the chassis and secured to the chassis and structured to fix the height of the chassis and the height of the transporting receptacle by fixing the positions of corner metal members adjacent to the opening door of the transporting receptacle; and a table disposed to be adjacent to the opening when the support column has been disposed adjacent to the opening door of the transporting receptacle so as to introduce the heavy carrying vehicle for introducing the heavy article into the transporting receptacle on standby, wherein the table has a support portion for individually bearing the weight of the pallet on which a coil-shape heavy article has been placed, and the support portion is able to coincide the height of the upper surface of the table with the height of the floor surface of the transporting receptacle. The pallet includes a pallet body, and a lower opening formed downward of the pallet body and opened in at least a lower portion thereof or one of side portions thereof, wherein a coil securing member for securing the coil-shape heavy article to the pallet body is disposed on the pallet for the coil-shape heavy article, and the holding frame being disposed on the pallet body and structured to be in contact with side surfaces of the coil-shape heavy article to support the coil-shape heavy article. The heavy-article carrying vehicle includes a support frame for lifting a pallet; and a plurality of exhaust nozzles provided for the lower surface of the support frame to discharge gas flows to the floor surface at a predetermined pressure so as to be capable of levitating the support frame in a state where the pallet loaded with a heavy article has been placed on the support frame, wherein the plural exhaust nozzles, valves for the exhaust nozzles for adjusting amounts of exhaust gas from the exhaust nozzles and a control stick which is capable of simultaneously controlling degrees of opening of the plural valves are provided so that control of the attitude of the support frame is permitted when the control stick is operated; and carrying to discharge the heavy-article from the transporting receptacle includes the following sequentially performed steps:

(1) the heavy-article carrying vehicle put on standby on the table is introduced into the transporting receptacle;

(2) the support frame of the heavy-article carrying vehicle is inserted into a space downward of the holding frame of the pallet, and then amounts of gas discharge from exhaust nozzles of the heavy-article carrying vehicle are reduced or made to be zero to temporarily lower the support frame to enlarge the gap between the lower surface of the holding frame and the upper surface of the support frame. Then, an engaging member is disposed between the lower surface of the holding frame of the pallet and the upper surface of the support frame, and then the amount of gas discharge from the exhaust nozzles of the heavy-article carrying vehicle is enlarged to raise the support frame so as to raise the heavy article through the engaging member and the pallet;

(3) the heavy-article carrying vehicle is returned onto the table so as to discharge the heavy article from the inside portion of the transporting receptacle; and (4) the heavy article is unloaded from the heavy-article carrying vehicle.

A method of discharging a heavy article according to a twenty-second aspect of the present invention is a method of discharging a heavy article using no engaging member and using a stage for introducing/discharging a heavy article to and from a transporting receptacle to discharge a coil-shape heavy article from a transporting receptacle placed on a chassis, the method of discharging a heavy article being characterized in that the method includes carrying, by a heavy-article carrying vehicle, a pallet incorporating a holding frame on which the coil-shape heavy article is held and leg portions for supporting the holding frame at a predetermined height and forming a space between the holding frame and the surface of the floor to discharge the heavy article placed on the pallet and secured to the pallet from the transporting receptacle. The stage for introducing/discharging a heavy-article includes a support column disposed adjacent to an opening door of the transporting receptacle placed on the chassis and secured to the chassis and structured to fix the height of the chassis and the height of the transporting receptacle by fixing the positions of corner metal members adjacent to the opening door of the transporting receptacle; and a table disposed to be adjacent to the opening when the support column has been disposed adjacent to the opening door of the transporting receptacle so as to introduce the heavy carrying vehicle for introducing the heavy article into the transporting receptacle on standby, wherein the table has a support portion for individually bearing the weight of the pallet on which a coil-shape heavy article has been placed, and the support portion is able to coincide the height of the upper surface of the table with the height of the floor surface of the transporting receptacle. The pallet includes a pallet body, and a lower opening formed downward of the pallet body and opened in at least a lower portion thereof or one of side portions thereof, wherein a coil securing member for securing the coil-shape heavy article to the pallet body is disposed on the pallet for the coil-shape heavy article, and the holding frame being disposed on the pallet body and structured to be in contact with side surfaces of the coil-shape heavy article to support the coil-shape heavy article. The heavy-article carrying vehicle including a support frame for lifting a pallet; and a plurality of exhaust nozzles provided for the lower surface of the support frame to discharge gas flows to the floor surface at a predetermined pressure so as to be capable of levitating the support frame in a state where the pallet loaded with a heavy article has been placed on the support frame, wherein the plural exhaust nozzles, valves for the exhaust nozzles for adjusting amounts of exhaust gas from the exhaust nozzles and a control stick which is capable of simultaneously controlling degrees of opening of the plural valves are provided so that control of the attitude of the support frame is permitted when the control stick is operated; and carrying to discharge the heavy-article from the transporting receptacle includes the following sequentially performed steps:

(1) the heavy-article carrying vehicle put on standby on the table is introduced into the transporting receptacle;

(2) the support frame of the heavy-article carrying vehicle is inserted into a space downward of the holding frame of the pallet, and then amounts of gas discharge from exhaust nozzles of the heavy-article carrying vehicle are reduced or made to be zero to temporarily lower the support frame to enlarge the gap between the lower surface of the holding frame and the upper surface of the support frame, and then the amount of gas discharge from the exhaust nozzles of the heavy-article carrying vehicle is enlarged to raise the support frame so as to raise the heavy article through the pallet;

(3) the heavy-article carrying vehicle is returned onto the table so as to discharge the heavy article from the inside portion of the transporting receptacle; and (4) the heavy article is unloaded from the heavy-article carrying vehicle.

A method of discharging a heavy article according to a twenty-third aspect of the present invention includes a pallet holding portion with inclined surfaces, a pair of the inclined surfaces formed opposite to each other, and a coil securing member including a band for binding and securing the coil and/or movement inhibiting members disposed on the two sides of the coil.

A method of discharging a heavy article according to a twenty-fourth aspect of the present invention utilizes a pallet body that is provided with at least four column stack-support portions formed into a quadrangle configuration, and when a coil-shape heavy article is not held, stacking of other pallets for the coil-shape heavy article above and below the pallet body is permitted.

A method of discharging a heavy article according to a twenty-fifth aspect of the present invention includes a heavy-article carrying vehicle having an exhaust nozzle configuration wherein the number of the exhaust nozzles is four, the four exhaust nozzles are disposed in a quadrangle configuration, and assuming that the nozzle disposed at the right front in a direction of transportation is a right-front nozzle, the nozzle disposed at the right rear is a right-rear nozzle, the nozzle disposed at the left front is a left-front nozzle and the nozzle disposed left rear is a left-rear nozzle, the nozzles forming each of four pairs composed of a pair formed by the right-front nozzle and the right-rear nozzle, a pair formed by the left-front nozzle and the left-rear nozzle, a pair formed by the right-front nozzle and the left-front nozzle and a pair formed by the right-rear nozzle and the left-rear nozzle are connected to each other through a connecting pipe.

A method of discharging a heavy article according to a twenty-sixth aspect of the present invention includes utilizing a transporting receptacle that is a container.

The "engaging member" may be used individually or formed in the carrying vehicle which can be placed on or removed from a support frame in accordance with necessity.

The "pallet" is accommodated in the transporting receptacle in a state where a coil-shape heavy article contact portion has been placed. Moreover, the "pallet" is standardized to be adaptable to the planar shape of the transporting receptacle. That is, the pallet has front contact portion, a rear contact portion, a left contact portion and a right contact portion at the front, rear, right and left positions thereof. When the pallets for coil-shape heavy articles are arranged adjacent to one another in a longitudinal or in rightward, leftward, forward and rearward directions, the right, left, front and rear contact portions are brought into contact with the adjacent pallets for coil-shape heavy articles at two or more points. The distance in the longitudinal direction from the surface of the leading end of the front contact portion to the surface of the leading end of the rear contact portion is a fraction of a natural number of the longitudinal length of the inside portion of the transporting receptacle. The distance in a lateral direction from the surface of the leading end of the right contact portion to the surface of the leading end of the left contact portion is a fraction of a natural number of the lateral length of the inside portion of the transporting receptacle. The foregoing sizes are applied to the following aspects.

The "longitudinal direction" of the transporting receptacle is the depth of the transporting receptacle. A direction toward the deep portion is the "front". The "longitudinal directions" are lateral direction with respect to the deep portion of the transporting receptacle. The "forward and rearward directions" of the pallet is a direction which coincides with the direction of the depth of the transporting receptacle when the pallet is accommodated in the transporting receptacle in a predetermined direction. The "front" is a direction toward the deep portion. The "right" and "left" are directions which coincide with the right and left with respect to the direction toward the deep portion of the transporting receptacle when the pallet is accommodated in the transporting receptacle in a predetermined direction.

The "shape with which contact at two or more points is permitted" may be a shape with which contact at two or more points is permitted or a shape with which contact between a surface and a line or that between two surfaces is permitted.

The expression that the distance is "a fraction of a natural number of the length" is "the same length as a fraction of a natural number of an actual and accurate length" to a "a length shorter than the foregoing length by 15% or less". When the length of the pallet is made to be the "the same length as a fraction of a natural number of an actual and accurate length" to the "length shorter than the foregoing length by 10% or lower", the gaps among the pallets in the transporting receptacle can furthermore be reduced. Therefore, the pallets can be held in a further stable state. Note that the natural number includes one.

If the positions of the nozzles in the carrying vehicle are not at the right, left, front and rear positions of the support frame, synchronization of the control of the amounts of gas discharge from the nozzles enables a similar attitude control to be performed.

At least one pair of the pipes which reach one pair of corresponding exhaust nozzles for controlling the attitude may be connected to each other by a connection pipe. The connection pipe may be provided with a valve for adjusting the flow rate.

The expression that "one pair of corresponding exhaust nozzles for controlling the attitude" is a pair of exhaust nozzles disposed symmetrically right and left or a pair of exhaust nozzles disposed in a longitudinal direction. That is, when the carrying vehicle, the attitude of which must be controlled, is inclined to the left, the amounts of discharge from the left nozzles are enlarged and the amounts of the discharge from the right nozzles are reduced. When the carrying vehicle is inclined forwards, the amounts of discharge from the front nozzles are enlarged and the amounts of discharge from the rear nozzles are reduced. The above-identified one pair of nozzles are referred to as "one pair of corresponding exhaust nozzles for controlling the attitude".

The connection using a connection pipe between the right front nozzle and the left rear nozzle constituting one group, and between the left front nozzle and the right rear nozzle constituting another group may be added.

The pallet for a coil-shape heavy article according to the first aspect of the present invention has a structure in which the coil-shape heavy article is formed into a standardized module. Thus, the labor required to perform a securing work in a container having opening formed in the side surfaces thereof can be saved. Moreover, the space in the container can efficiently be reduced.

The pallet for a coil-shape heavy article according to the second aspect of the present invention incorporates one pair of holding portions for supporting the side surfaces of the cylindrical coil-shape heavy article such that the inclined surfaces are disposed to face with each other. Therefore, rolling of the coil-shape heavy article can be prevented, which allows the coil-shape heavy article to be placed in a stable state. Since the side surfaces of the cylindrical coil-shape heavy article are supported by the opposite inclined surfaces, coil-shape heavy articles having a variety of outer diameters in a predetermined range can be placed. The side surfaces of the cylindrical coil-shape heavy article are supported by the opposite inclined surfaces. Therefore even if the coil-shape heavy article is swayed to a certain degree, it is moved by gravitational force to reach around the central portion between the pair of the holding portions.

Moreover, the foregoing pallet does not encounter a cargo shift and, therefore, the coil can be transported without suffering from the flaw.

The pallet for a coil-shape heavy article according to a third aspect of the present invention incorporates the stack-support portions by which the pallets can vertically be stacked. Therefore, after the heavy article has been transported, a plurality of the empty pallets can be stacked compactly and returned.

The heavy-article carrying vehicle according to the fourth aspect of the present invention is designed to lift a heavy article using injection of gas. Therefore, the weight of the heavy article can be borne with a large area of the floor. Unlike the case using wheels, the load is not concentrated on the point of contact between each wheel and the floor. As a result, it is unlikely to have the floor broken by the weight.

The heavy-article carrying vehicle lifts the heavy article by levitating the support frame using discharge of gas to exert the force immediately below the center of gravity. Therefore, the position of the center of gravity is not considerably shifted between an unloaded state and a state loaded with a heavy article. Therefore, excellent stability can be realized.

If the heavy article is lifted at a position deviated from the center of gravity as is performed by the conventional carrying vehicle, the deadweight has to be increased in order to keep a balance in case of lifting the heavy article. Moreover, like a forklift, a counter balance has to be provided for a portion opposite to the cargo. The heavy-article carrying vehicle according to the present invention does not require the additional weights. Therefore, the possibility of damaging the floor that bears the weight can be lowered. Moreover, the size of the apparatus can be reduced and a heavy article can easily be carried into a small space.

Since gas is used to levitate the cargo and bear the weight thereof, no friction resistance is hardly generated in case of horizontal movement. Therefore, the heavy article can easily be moved. Even if the heavy article weighing, for example, 10 metric tons is loaded, the heavy article can be conveyed by man power.

Since gas is used to levitate the cargo and bear the weight thereof, the cargo can be conveyed in a stable state by adjusting the flow rate and direction of the gas even if the positions of the center of gravity of the held heavy articles vary in a wider range.

The heavy-article carrying vehicle according to the present invention incorporates a control stick which is capable of simultaneously controlling the valves of the plural exhaust nozzles. Therefore, the operator is able to easily control the attitude of the support frame.

The heavy-article carrying vehicle according to a fifth aspect of the present invention has the exhaust nozzles disposed in the rectangular configuration. Therefore, the attitude of the loaded heavy article can be securely controlled. Since the exhaust nozzles are divided into 4 groups, each group of which is disposed at the four positions. Control of the amounts of the gas discharge from the four grouped nozzles enables effective control of two-axial angles of inclination of a horizontal plane in a state where the support frame of the heavy-article carrying vehicle has been levitated. Therefore, the attitude of the support frame can effectively be controlled.

When the amounts of gas injected from the nozzles are controlled by the control stick, adjustment of the angles of inclination in the two axial directions, time and pressure enables effective control of the amounts of gas injected from the nozzles.

The heavy-article carrying vehicle according to the present invention is free from excessive sensitiveness in controlling the attitude. The control system can be operated in a stable state to easily control the attitude. Moreover, the rightward, leftward, forward and rearward attitude control of the loaded heavy article can be securely performed in a stable state. Since the connection pipe incorporates the valve for adjusting the flow rate, enlargement of the flow rate by opening the valve retards the response of the attitude control. When the valve is throttled to reduce the flow rate, the response can be quickened up. Therefore, arbitrary response can be obtained in the attitude controlling.

Moreover, the heavy-article carrying vehicle according to the present invention has the four pairs of the exhaust nozzles of right, left, front and rear nozzle and connected to one another. Therefore, the rightward, leftward, forward and rearward attitude controls can be securely performed in a stable state.

The stage for introducing/discharging the heavy article to and from a transporting receptacle according to a sixth aspect of the present invention has the table disposed adjacent to the opening of the transporting receptacle and having the upper surface height coincided with the height of the floor surface of the transporting receptacle. Therefore, the carrying vehicle is kept standby on the table, followed by loading the heavy article on the carrying vehicle by a loading apparatus, such as a crane, and followed by introducing the heavy article into the transporting receptacle having the side door by the carrying vehicle. Thus, the heavy article can be introduced into the transporting receptacle having the side door in a state where the transporting receptacle is placed on the chassis.

The stage for introducing/discharging a heavy article to and from a transporting receptacle incorporates the support portion which is capable of individually bearing the weight of the article placed on the table. Therefore, any load which is not estimated at a time of designing is not exerted to the chassis and the transporting receptacle. Therefore, the apprehension of breaking the chassis and transporting receptacle can be eliminated.

The stage for introducing/discharging a heavy article to and from a transporting receptacle incorporates the support columns for fixing the height of the chassis and the transporting receptacle. Therefore, the height of the floor surface of the transporting receptacle is not changed after the heavy article has been introduced. As a result, a stepped portion from the height of the upper surface of the table cannot be generated. Therefore, the carrying vehicle or the like which runs on the floor surface is able to introduce the heavy article into the transporting receptacle in a stable manner.

The positions of the corner metal members of the support columns of the stage for introducing/discharging a heavy article to and from a transporting receptacle are fixed so as to fix the heights of the transporting receptacle and the chassis. Therefore, any remodeling of the conventional transporting receptacle and chassis is not required to achieve an object to fix the foregoing heights.

The stage for introducing/discharging a heavy article to and from a transporting receptacle according to a seventh aspect of the present invention incorporates the engaging members to engage the corner metal members. Therefore, an object of easily fixing the heights of the transporting receptacle and the chassis can be achieved without a complicated fixing means. The foregoing stage for introducing/discharging a heavy article to and from a transporting receptacle is arranged to engage the corner metal members joined to the upper corners of the corner metal members. Therefore, the corner metal members at the upper surface of the transporting receptacle exhibiting a low potential to be used when the transporting receptacle is joined to the chassis are effectively used to fix the heights of the chassis and the transporting receptacle.

To align the positions of the engaging members of the stage to the positions of the corner metal members on the upper surface of the transporting receptacle, the position of the stage are usually required to be aligned to the positions of the floor surface of the transporting receptacle and corner metal members of the lower surface of the transporting receptacle.

If the chassis is inclined to the ground, the transporting receptacle is inclined. As a result, the positions of the corner metal member on the upper surface of transporting receptacle are deviated from the estimated positions (positions vertically above the corner metal members on the lower surface of the transporting receptacle) with respect to the corner metal members on the lower surface. In the foregoing case, if the position of the stage is aligned with the corner metal members on the lower surface, the central positions of the elongated holes in the corner metal members on the upper surface of the transporting receptacle and the positions of the engaging members of the stage do not coincide. When the engaging members are inserted into the corner metal members, adjustment of the position of the stage or the positions of the engaging members may be required.

However, the corner metal members on the lower surface of the transporting receptacle encounters little deviation of the positions owning to the inclination of the chassis. The stage for introducing/discharging a heavy article to and from a transporting receptacle according to the eighth aspect of the present invention uses the engaging members into the corner metal members joined to the right and left corners of the lower portion of the transporting receptacle to engage the engaging members. Therefore, when the engaging members are inserted into the corner metal members, the problem of the position deviation owing to the inclination of the chassis hardly occurs.

When the corner metal members joined to the right and left corners of the lower portion of the transporting receptacle are engaged, a monitoring person is allowed to visually check the engaging operation and a state of the engagement easily, thus realizing excellent workability.

As no support column nor beams are not required for the stage, its overall size and weight can be reduced, thus lowering the manufacturing cost.

The stage for introducing/discharging a heavy article to and from a transporting receptacle according to a ninth aspect of the present invention incorporates the slide portion arranged to introduce/discharge the engaging members and vertically slidably provided. Moreover, the slide-portion lifting means is provided to support the slide portion at a predetermined height. Therefore, the engaging members can be inserted into the elongated holes of the corner metal members of the transporting receptacle which are disposed at various heights. Thus, the transporting receptacle can be supported at an arbitrary position.

The stage for introducing/discharging a heavy article to and from a transporting receptacle according to a tenth aspect of the present invention incorporates the slide-portion lifting means which simply supports the slide portion from lower positions with rollers. Therefore, bending moment is not allowed to be transmitted to the slide-portion lifting means owning to a load exerted on the engaging members.

The slide portions are supported by the slide-portion lifting means and engaged with the guide rails at two or more points of the guide rail in the vertical direction. Therefore, even if the load of the transporting receptacle is added to the engaging members, the engaging members can be supported in a stable state. Moreover, the slide portion can smoothly slide on the guide rails.

The stage for introducing/discharging a heavy article to and from a transporting receptacle according to the eleventh aspect of the present invention incorporates the slide portion which are supported at two or more points of each guide rail. Therefore, the slide portion is two-dimensionally supported at four points. As a result, even if the load of the transporting receptacle is added to the engaging members, the engaging members can be supported three-dimensionally in as table state. Moreover, the slide member is able to smoothly slide on the guide rails.

The stage for introducing/discharging a heavy article to and from a transporting receptacle according to the twelfth aspect of the present invention incorporates the attitude control means. Therefore, the table can horizontally be maintained. Thus, when the carrying vehicle or the like is kept standby on the table and a heavy article is loaded, the carrying vehicle is not undesirably moved owning to the inclination of the table. In a case of a levitation-type carrying vehicle which does not produce great resistance when the carrying vehicle of the foregoing is moving, it is an important factor to maintain the horizontal state of the table.

The stage for introducing/discharging a heavy article according to the thirteenth aspect of the present invention is adapted to the container. Therefore, the stage according to this aspect is an advantageous stage for introducing/discharging the container.

The method of introducing/discharging a heavy article according to the fourteenth and fifteenth aspects of the present invention uses the pallet having a space between the holding frame and the floor surface; and the engaging members. Therefore, a complicated or a large apparatus for loading/unloading a cargo is not required to introduce the heavy article by effectively using the carrying vehicle.

The fourteenth, fifteenth and the sixteenth aspects of the present invention use the standardized pallets. Therefore, when a predetermined number of pallets not smaller than one are disposed adjacently in rows and columns, they can be disposed without any gap or with small gaps in the transporting receptacle. The right, left, front and rear contact portions of the opposite surfaces of the adjacent pallets are in contact with one another at two or more points. Therefore, if the outer shape is defined by the inner wall of the transporting receptacle, the pallets can be held in the transporting receptacle in a stable state. Even if the pallets are not secured in the transporting receptacle, the transporting receptacle, such as a container, can be transported. The method of introducing a heavy article according to the present invention has the structure that the carrying vehicle incorporates the control stick which is capable of simultaneously controlling the valves of the plural exhaust nozzles. Therefore, a human is allowed to easily control the attitude of the support frame of the carrying vehicle to introduce the heavy article. Moreover, using the method of introducing a heavy article according the present invention, they can efficiently introduce a heavy article into the transporting receptacle keeping mounted the transporting receptacle on a chassis. Therefore, in transporting heavy article by the transporting receptacle, a lot of transport hours and personnel expenditure are economized for the reason that it is not necessary to take the transporting receptacle down on the floor surface.

The method of introducing a heavy article according to a seventeenth aspect of the present invention uses the pallet having a pair of holding portions for supporting the side surface of the cylindrical coil-shape heavy article such that the inclined surfaces are opposite to each other. Therefore, rolling of the coil-shape heavy article can be prevented. Thus, the coil-shape heavy article can be placed in a stable state. Since the opposite inclined surfaces support the side surface of the cylindrical coil-shape heavy article, coil-shape heavy articles having various outer diameters satisfying a predetermined range can be held. The opposite inclined surfaces support the side surface of the cylindrical coil-shape heavy article. Therefore even if the coil-shape heavy article is swayed, it is moved by gravitational force to reach around the central portion between the pair of the holding portion. The introducing method according to the present invention is able to transport the coil-shape heavy article without generating a cargo shift and any flaw. Since the securing member is employed, separation of the heavy article from the pallet can be prevented.

The introducing method according to the eighteenth aspect of the present invention using the stack support portion which enables the pallets to vertically be stacked. Therefore, after the heavy articles have been transported, a plurality of empty pallets can be stacked compactly and returned.

The method of introducing a heavy article according to the nineteenth aspect of the present invention uses the four exhaust nozzles disposed to form the rectangle. Therefore, the attitude of the heavy article can be stabilized. According to the present invention, the four exhaust nozzles composed of the right, left, front and rear exhaust nozzles are connected to one another. Therefore, excessive sensitivity of the response which occurs during attitude control can be prevented. Therefore, a stable control system can be realized. Thus, the attitude control can easily be performed. Moreover, the rightward, leftward, forward and rearward attitudes of the loaded heavy article can reliably and be controlled in a stable state. Since the connection pipe is provided with the valve for adjusting the flow rate, enlargement of the flow rate by opening the valve retards the response of the attitude control. When the valve is throttled to reduce the flow rate, the response is retarded to be slower. Therefore, arbitrary response can be obtained in controlling the attitude.

The method of introducing a heavy article according to a twentieth aspect of the present invention uses the container as the transporting receptacle. Therefore, the foregoing method is a significantly advantageous method of introducing the heavy article into the container.

The method of discharging a heavy article according to the twenty-first and twenty-second aspects of the present invention enables the heavy article to efficiently be discharged from the inside portion of the transporting receptacle in a state in which the transporting receptacle is placed on the chassis. Therefore, the transportation of a heavy article by using the transporting receptacle does not require the transporting receptacle to be unloaded to the surface of the floor. As a result, great time and labor cost can be saved. Since the employed carrying vehicle discharges the gas to raise the heavy article, an effect can be obtained for the carrying vehicle similar to that obtainable from the above-mentioned method of introducing the heavy article. The employed coil-shape heavy article is similar to that for use in the above-mentioned method of introducing the heavy article. Therefore, an effect can be obtained for the pallet similar to that obtainable from the above-mentioned method of introducing a heavy article.

The method of discharging a heavy article according to the twenty-first aspect of the present invention uses the pallet having a space between the holding frame and the floor surface, and the engaging members. Therefore, a complicated or a large apparatus is not required to load/unload the heavy article. Thus, the carrying vehicle is effectively used to discharge the heavy article from the transporting receptacle.

The method of discharging a heavy article according to the twenty-third aspect of the present invention uses a pair of pallets disposed such that the inclined surfaces of the holding portion face with each other. Therefore, the coil-shape heavy article can be prevented from rolling. Thus, the coil-shape heavy article can be placed in a stable state. Since the opposite inclined surfaces support the side surface of the cylindrical coil-shape heavy article, coil-shape heavy articles having a variety of outer diameters satisfying a predetermined range can be held. Since the side surface of the coil-shape heavy article is supported by the opposite inclined surfaces, somewhat sway of the coil-shape heavy article results in the coil-shape heavy article being positioned in the central portion between the pair of the holding portion owning to the attracting force of the gravity. The introducing method according to this aspect is able to prevent a cargo shift even if the above-mentioned securing operation is omitted. Therefore, the coil can be transported without generating the flaw. Since the securing member is used, separation of the heavy article from the pallet can be prevented.

The method of discharging a heavy article according to a twenty-fourth aspect of the present invention enables the pallets to be vertically stacked thanks to the stack-support portion. Therefore, a plurality of empty pallets can be stacked compactly and returned after the heavy articles have been transported.

The method of discharging a heavy article according to the twenty fifth aspect of the present invention enables a human to easily control the attitude of the support frame of the carrying vehicle to discharge the heavy article from the transporting receptacle. Since the four exhaust nozzles are disposed to form a rectangular configuration, the attitude of the heavy article can be stabilized. Moreover, excessive sensitivity of the response can be prevented during the attitude control, thus realizing a stable control system. As a result, the attitude control can be easily performed. In addition, the rightward, leftward, forward and rearward attitude controls of the loaded heavy article can be performed in a secure and stable state. Thus, arbitrary response can be obtained at the attitude controlling.

The method of discharging a heavy article according to the twenty-sixth aspect of the present invention uses the container as the transporting receptacle. Therefore, the foregoing method is a significantly advantageous method for discharging the container.

DESCRIPTION OF THE PREFERRED EMBODIMENTS

Figure 1:
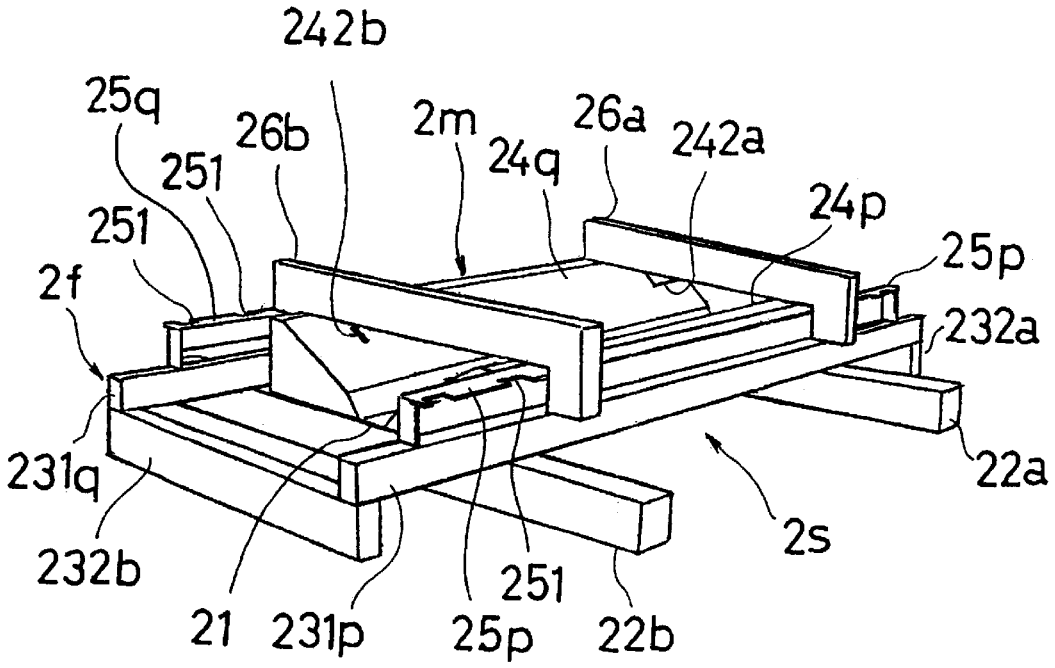
FIG. 1 is a perspective view showing the shape of a pallet for a coil-shape heavy article according to an embodiment.
Figure 57:
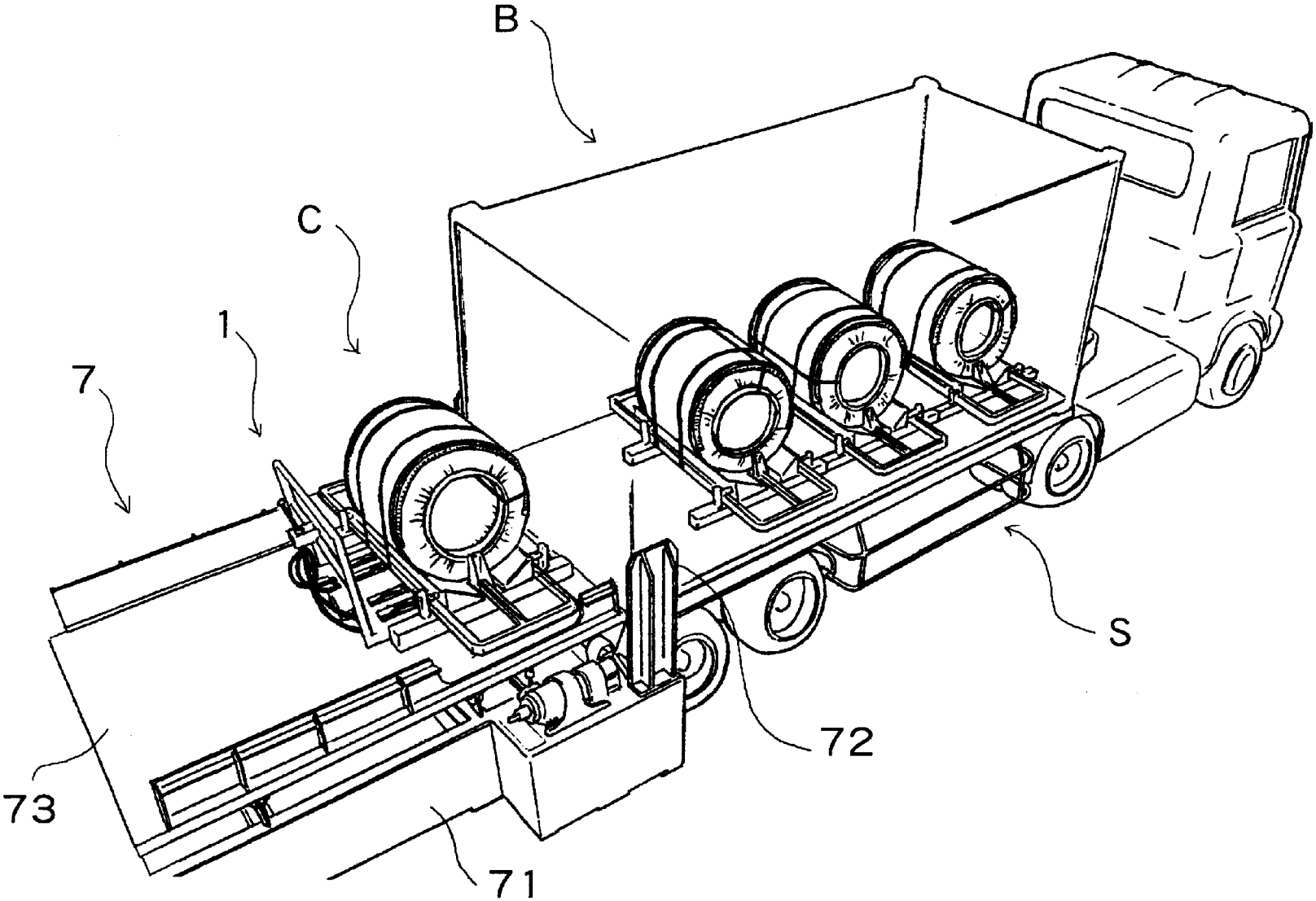
FIG. 57 is a diagram showing a state where the pallet is being loaded on the container on the chassis.

Referring to FIGS. 1 to 57, a pallet for a coil-shape heavy article, a heavy-article carrying vehicle, a stage for introducing/discharging a heavy article to and from a transporting receptacle, a method of introducing a heavy article into a container and a method of discharging a heavy article from a container will be described.

First Embodiment

A pallet, a heavy-article carrying vehicle, a stage for introducing/discharging a heavy article used in this embodiment and a transporting method using the foregoing elements will be described.

(1) Pallet

A pallet 2 according to this embodiment is used for efficiently handling a thin-plate coil for transportation.

As shown in FIGS. 1 to 5, the pallet 2 incorporates camber members 24*p*, 24*q* on which the coil is loaded, a bottom plate 21 for securing the camber members 24*p*, 24*q* to face with each other, leg portions 22*a*, 22*b* including rod members to support the camber members 24*p*, 24*q* and the bottom plate 21 at predetermined heights to form a space from the surface of a floor, sub-legs 23 disposed across the leg portions 22*a*, 22*b* to be grounded with the floor surface on the outside of the leg portions 22*a*, 22*b* so as to stably support the pallet 2 in a stable state, movement-inhibiting member guides 25*p*, 25*q* disposed on the upper surfaces of the sub-arms 231*p*, 231*q* of the sub-legs 23 disposed across the leg portions 22*a* and 22*b*, and movement-inhibiting members 26*a*, 26*b* joined across the movement-inhibiting-member guides 25*p*, 25*q* to limit the positions of the two end surfaces of the coil C. A holding portion 2*m* on which a heavy article is held is composed of the bottom plate 21 (a body of the holding portion) and a pair of camber portions (coil support portions) 24*p*, 24*q*.

Figure 2:
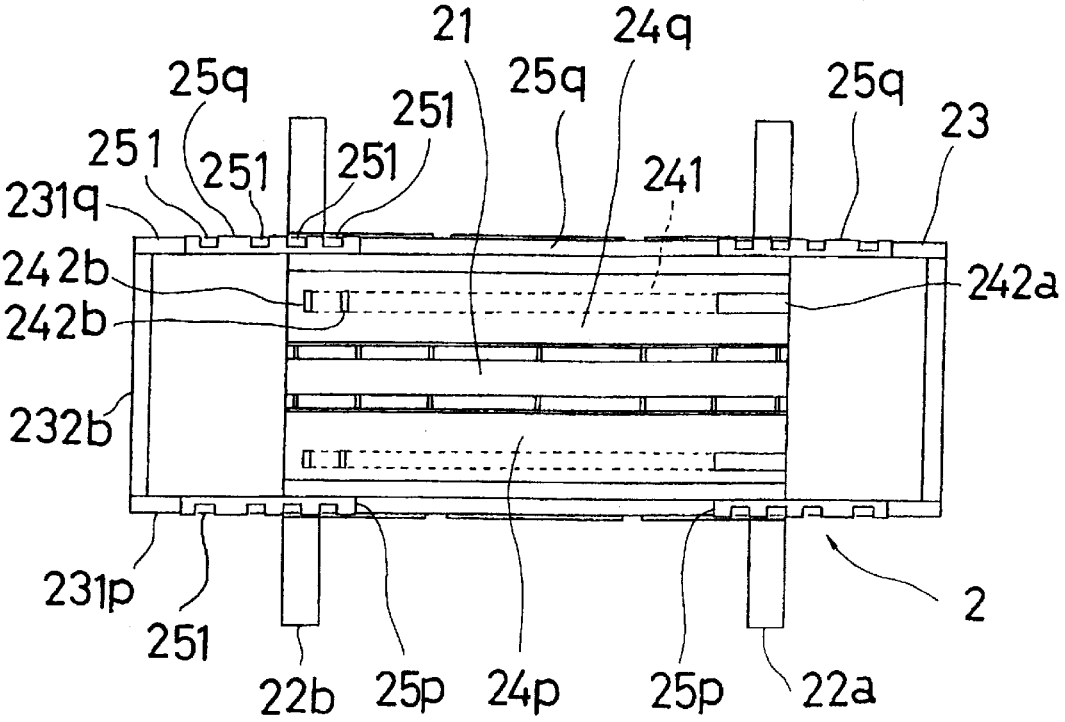
FIG. 2 is a plan view of the pallet shown in FIG. 1.
Figure 3:
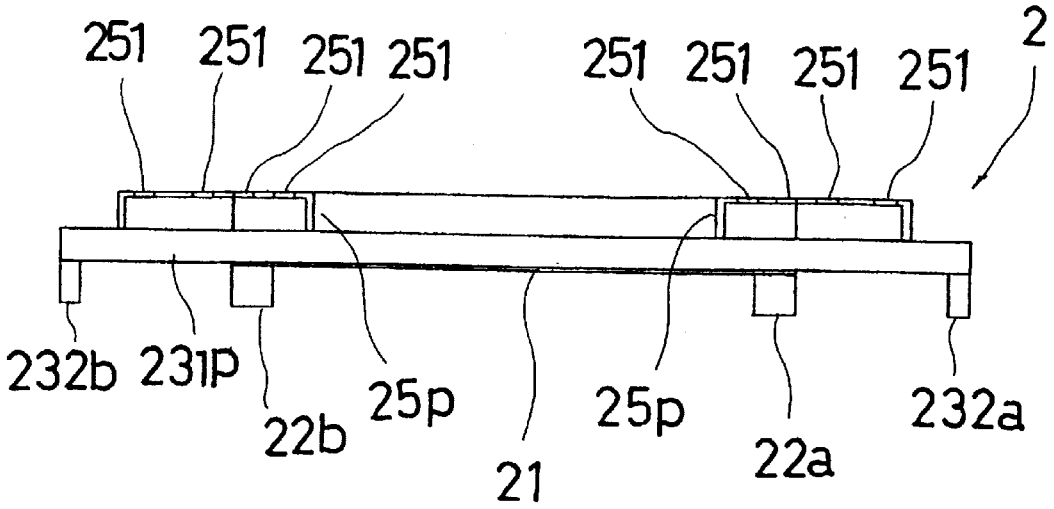
FIG. 3 is a side view of the pallet shown in FIG. 1.

The leg portions 22*a*, 22*b* are square bars each having a height of 100 mm, a width of 100 mm, a thickness of 2.3 mm and a length of 1450 mm. As shown in FIGS. 1 to 3, the leg portions 22*a*, 22*b* are disposed in parallel at the interval of 1200 mm.

The length of each of the leg portions 22*a*, 22*b* becomes the maximum size of the pallet in the foregoing direction. The foregoing length is about ¼ of the length of the floor surface of the container B. Therefore, when four pallets 2 are arranged in the longitudinal direction (in the lengthwise direction of the leg portions 22*a*, 22*b* ) in the container B such that the pallets 2 are in contact with each another at the end surfaces of the leg portions 22*a*, 22*b*, the overall length substantially coincides with the length of the floor surface of the container B. Therefore, lashing (securing) of the pallets 2 is not required in the container B to prevent longitudinal shift of the pallet in the container B.

The bottom plate 21 is joined on the upper surfaces of the leg portions 22*a*, 22*b*. The camber members 24*p*, 24*q*, as rod members each having a pentagonal cross sectional shape with one corner right angled are disposed across the leg portions 22*a*, 22*b* in a direction perpendicular to the leg portions 22*a*, 22*b* as shown in FIGS. 1 to 5.

The cross sectional shape of each of the camber members 24*p*, 24*q* is pentagonal shaped like formed by cutting the vertexes of two acute angles of a right angled triangle with a straight line. Hereinafter, the longer side of two sides across the right angle of the right angled triangle is called as a "longer side", the shorter side of the two sides across the right angle of the right angled triangle is called as a "shorter side" and the oblique side of the right angled triangle is called as an "oblique side".

The cross section of each of the camber members 24*p*, 24*q* has the longer side of 250 mm, a shorter side of 173 mm, the side opposing the longer side of 50 mm and the side opposing the shorter side of 50 mm. Each of the camber members 24*p*, 24*q* has a length of 1400 mm.

Figure 25:
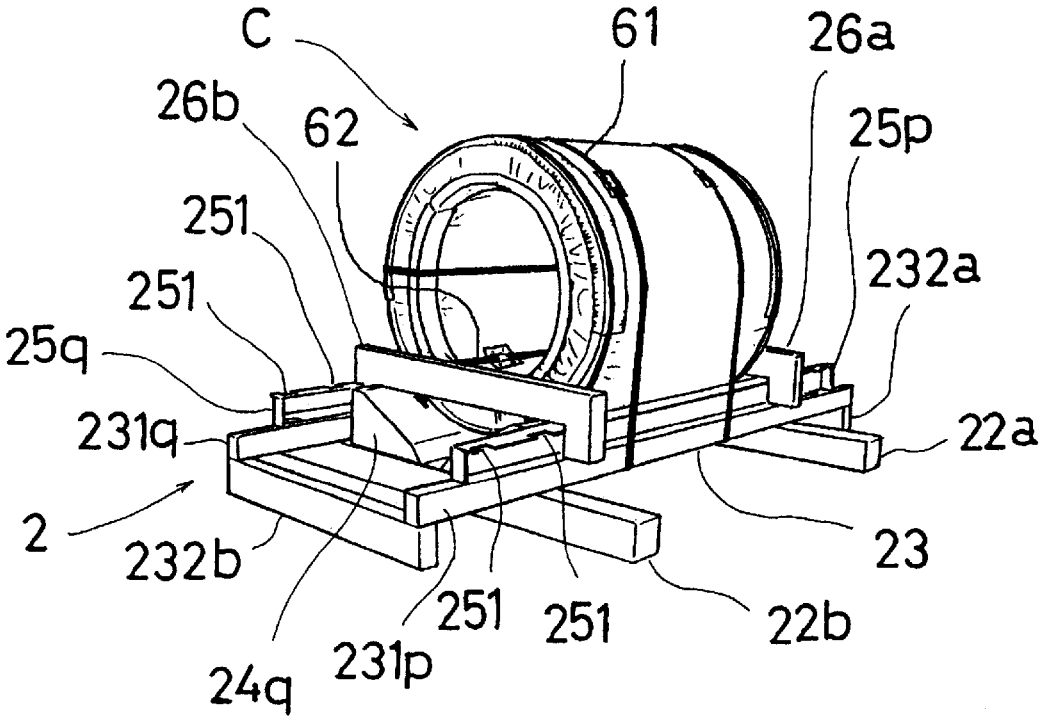
FIG. 25 is a perspective view showing a pallet in a state where a coil has been loaded and secured with a band.
Figure 26:
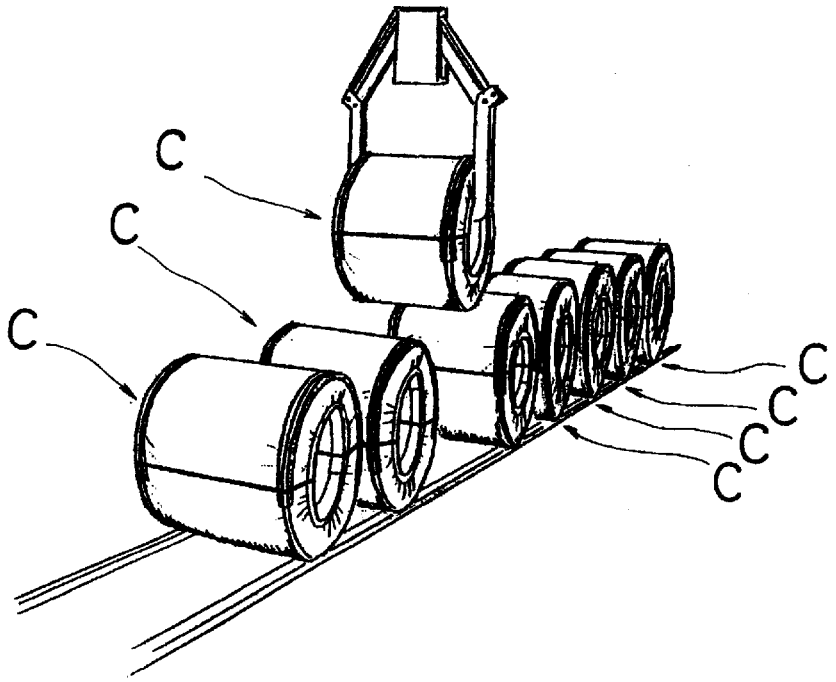
FIG. 26 is a diagram showing a state where a coil has been suspended by a tongue.
Figure 27:
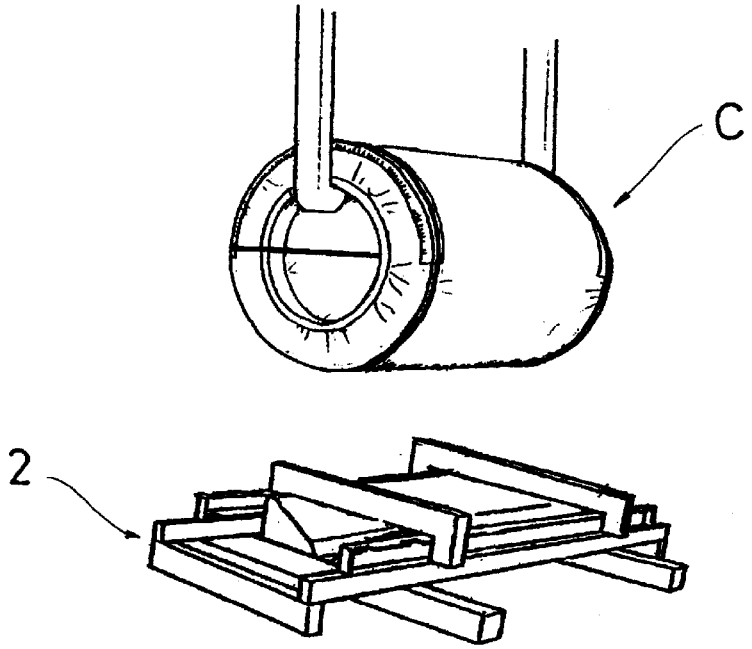
FIG. 27 is a diagram showing a state where the coil is loaded on the pallet.

The camber members 24*p*, 24*q* are disposed such that the oblique sides of the pentagonal cross section are facing with each other in a state where the longer side of the pentagonal cross section faces downwards. As shown in FIG. 25, the coil C to be loaded on the pallet 2 according to this embodiment is placed on the camber members 24*p*, 24*q* such that the outer surface is in contact with the opposing oblique sides.

Each of the camber members 24*p*, 24*q* has a shell made of a steel plate and includes a band passage 241. As shown in FIGS. 5 to 7 and 25, band insertion holes 242*a*, 242*b* communicated with the band passage 241 are formed in the surfaces (hereinafter called as an "inclined surface") corresponding to the oblique sides of the pentagonal cross sections of the camber members 24*p*, 24*q*.

The band insertion holes 242*a*, 242*b* are formed adjacent to two ends of each of the camber members 24*p*, 24*q*. The band insertion hole 242*a* as an elongated hole is formed along the camber members 24*p*, 24*q*. The distance between the pair of the band insertion holes 242*a*, 242*b* of the camber members 24*p*, 24*q* is set to 900 mm. That is, the distance between the pair of the band insertion holes 242*a* and 242*b* is shorter than the width of the coil C which is loaded on the camber members 24*p* and 24*q*.

Figure 5:
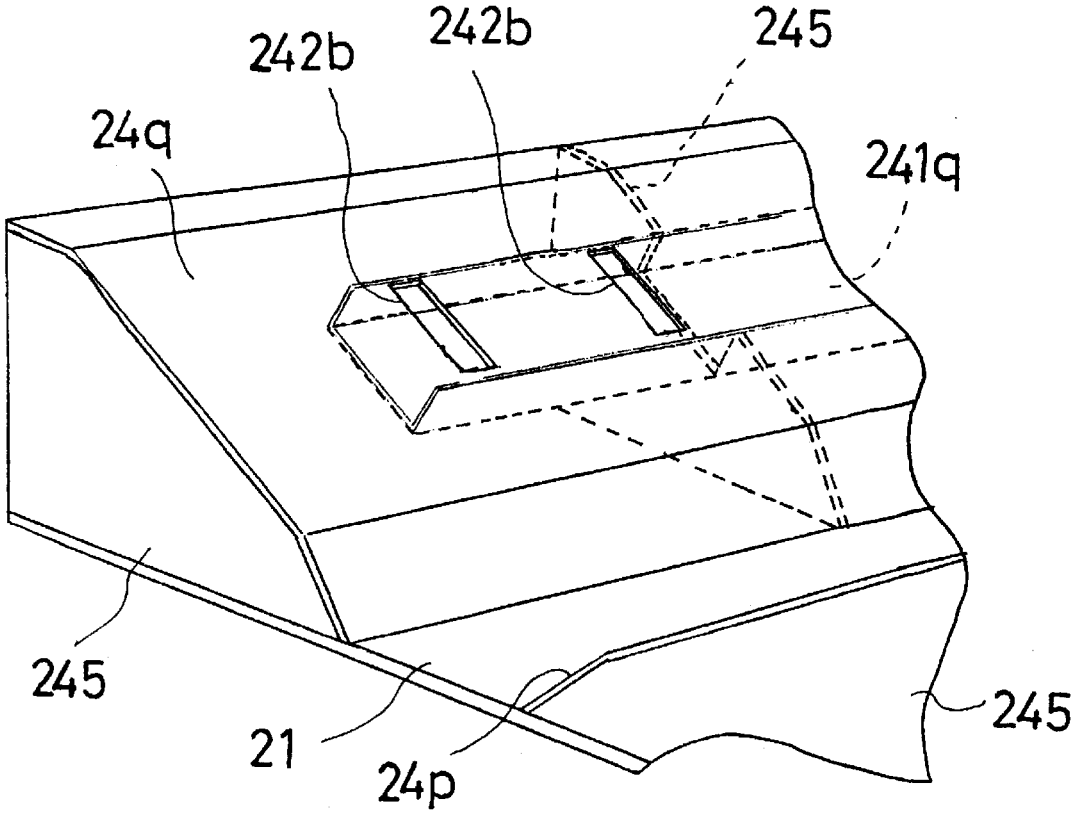
FIG. 5 is a partially enlarged view showing a holding portion of the pallet for a coil-shape heavy article according to the embodiment.

If the distance between the band insertion holes 242*a* and 242*b* is longer than the width of the coil C, the band will form a trapezoidal shape having an upper side corresponding to the inner surface of the central hole of the coil C and a lower side (longer than the upper side) corresponding to the band passage 241 when the band is, through the central hole of the coil C, routed to the band passage 241, the two ends of which are the band insertion holes 242*a*, 242*b*, as shown in FIG. 5. If the tension of the band is raised, the two ends of the respective camber members 24*p*, 24*q* which are the lower side of the trapezoid are undesirably lifted up. That is, the surfaces of the camber members 24*p*, 24*q* around the band insertion holes 242*a*, 242*b* are deformed.

However, the pallet 2 according to this embodiment incorporates the band insertion holes 242*a*, 242*b* disposed apart from at the distance shorter than the width of the coil C. Therefore, the band forms a rectangular shape along the cross section of the coil C (exactly, the lower side corresponds to the band passage 241). Thus, the above-mentioned problem does not arise.

Figure 6:
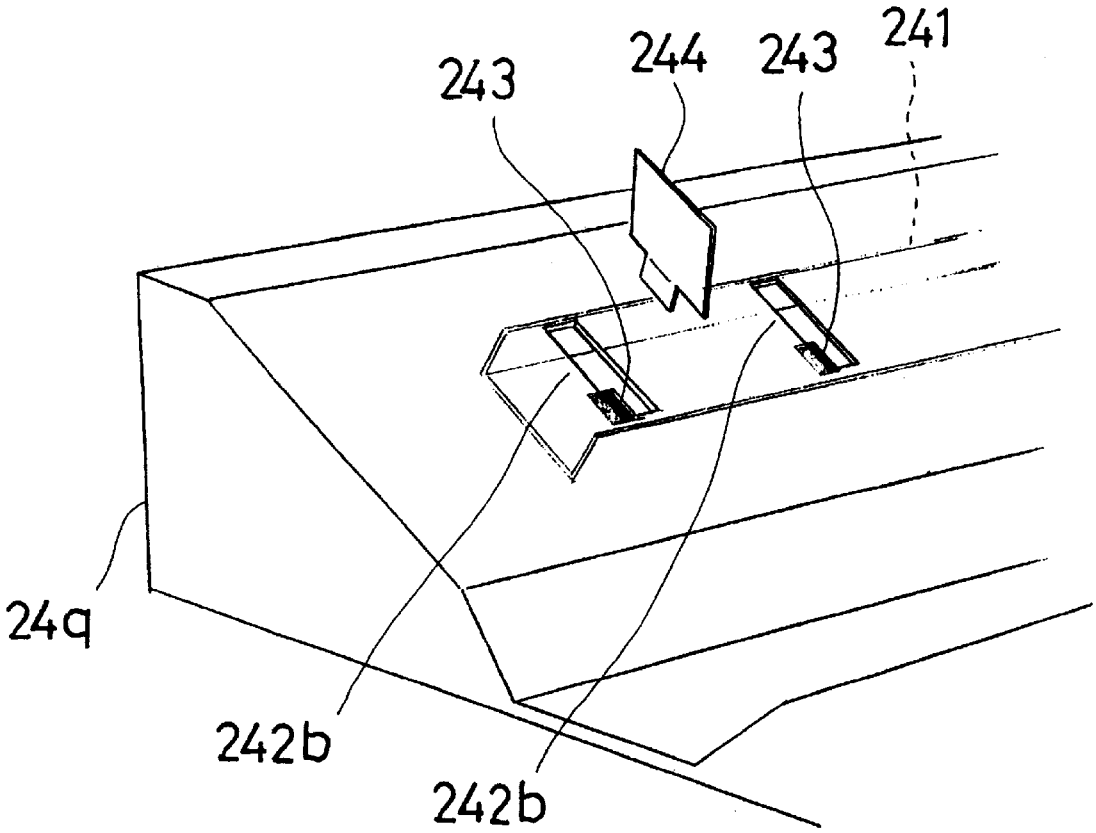
FIG. 6 is a diagram showing the relationship between guide plates and holes for joining the guide plates.
Figure 7:
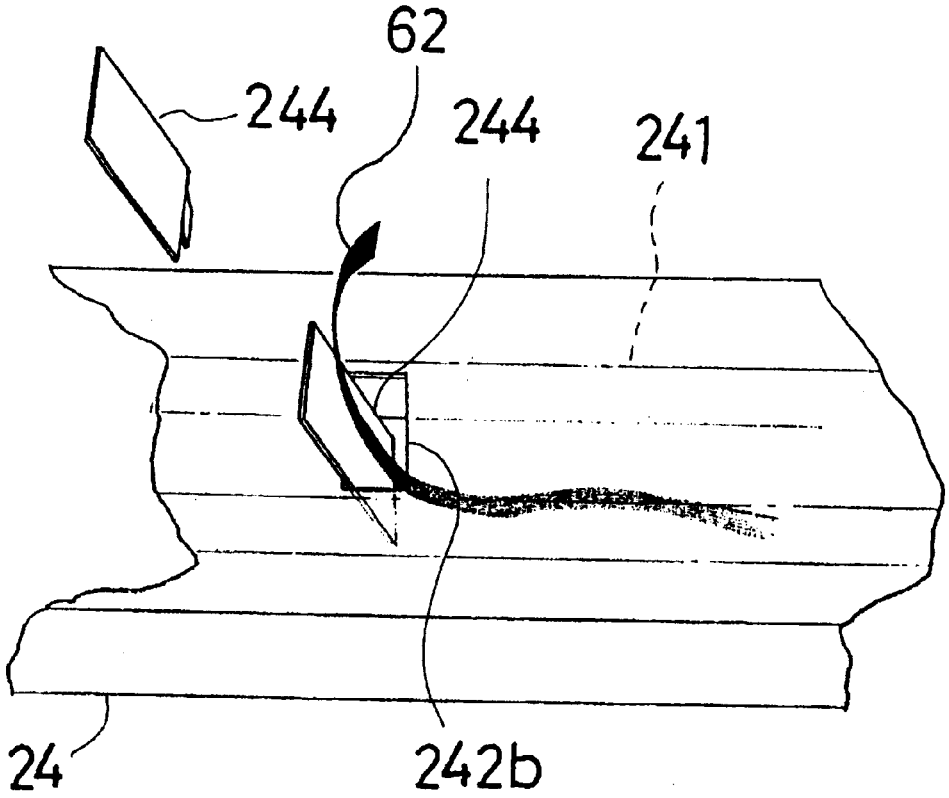
FIG. 7 is a diagram showing a state of use of the guide plates.

As shown in FIG. 6, the band insertion hole 242*b* has a guide-plate joining hole 243 formed in the bottom surface of the band passage 241. Thus, a guide plate 244 forming the inclined surface which reaches the surface of the camber member 24*p* or 24*q* from the bottom surface of the band passage 241 through the band insertion hole 242*b* can be inserted into the guide-plate joining hole 243. As shown in FIG. 7, since the guide plate 244 is joined, the leading end of the band is pulled out to the surface of the camber member 24*p* or 24*q* along the guide plate 244 when the leading end of the band is taken out from the inside portion of the band insertion hole 242*b*. Therefore, the coil C can be easily secured by the band.

Figure 4:
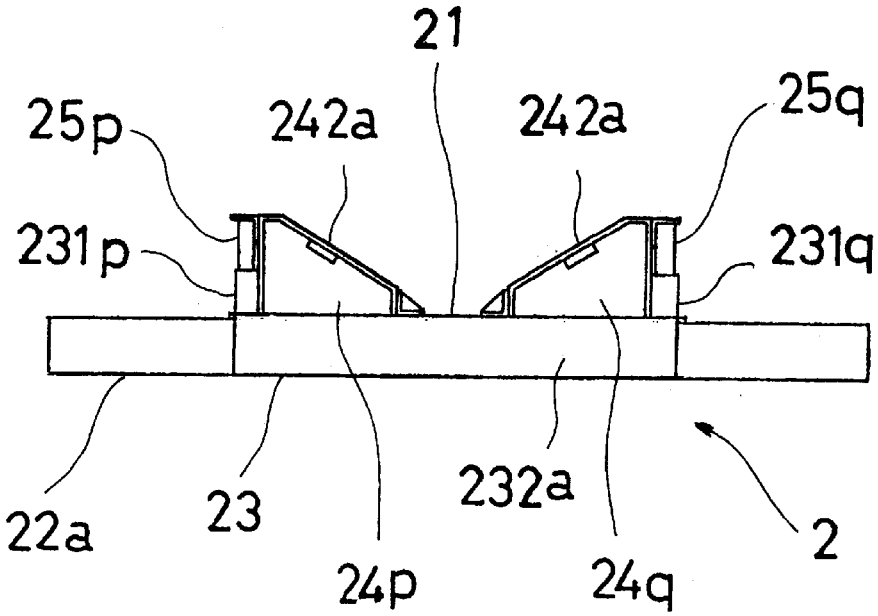
FIG. 4 is a front view of the pallet shown in FIG. 1.

As shown in FIGS. 2 to 4, parallel sub-arms 231*p*, 231*q* are disposed on the upper surfaces of the leg portions 22*a*, 22*b* such that the sub-arms 231*p*, 231*q* are in contact with the camber members 24*p* and 24*q* in a state in which the sub-arms 231*p* and 231*q* are positioned across the camber members 24*p*, 24*q*. The sub-legs 23 disposed across the leg portions 22*a*, 22*b* are composed of the sub-arms 231*p*, 231*q* and sub-leg members 232*a*, 232*b* to be described later.

Each of the sub-arms 231*p* and 231*q* is an angular pipe having a height of 75 mm, a width of 45 mm, a thickness of 3.2 mm and a length of 2290 mm. As shown in FIG. 4, the sub arms 231*p*, 231*q* are disposed such that their side surfaces are in contact with the upper surfaces of the leg portions 22*a*, 22*b* and the outer surfaces which are the shorter sides of the pentagonal cross sections of the opposite camber members 24*p*, 24*q*. That is, the leg portions 22*a*, 22*b* and the sub-arms 231*p*, 231*q* are combined with one another to form parallel crosses.

The length of each of the sub-arms 231*p*, 231*q* is the maximum size for the pallet in the direction (a direction perpendicular to the leg portions 22*a*, 22*b*). Since the foregoing size is substantially the same as the width of the floor surface of the container B, lashing (securing) of the pallet 2 in the container B is not required to prevent a lateral shift of the pallet in the container B. Moreover, a lower opened space 2*s* into which a carrying vehicle can be inserted can be formed below the leg portion 2*f* and front and rear surfaces. Therefore, the pallet 2 can easily be loaded on a transporting apparatus 1.

As shown in FIGS. 1 to 4, the sub-leg members 232*a*, 232*b* are disposed below the lower surfaces of the two ends of the sub-arms 231*p*, 231*q*.

Each of the sub-leg members 232*a*, 232*b* is an angular pipe having a height of 100 mm, a width of 50 mm, a thickness of 1.6 mm and a length of 810 mm. The sub-leg members 232*a*, 232*b* are disposed in parallel with the leg portions 22*a* and 22*b* below the two ends of the sub-arms 231*p*, 231*q*.

On the other hand, movement-inhibiting-member guides 25*p* and 25*q* are disposed on the upper surface of the sub-arms 231*p* and 231*q* along the sub-arms 231*p*, 231*q*, as shown in FIGS. 1 to 4. Each of the movement-inhibiting-member guides 25*p* and 25*q* is made of steel having an "L" cross sectional shape, as a thickness of 4 mm and a length of 490 mm. Each of the movement-inhibiting-member guides 25*p*, 25*q* is disposed such that the bottom side of the "L" shape faces upwards and the rear portion is in contact with each of the camber members 24*p*, 24*q*. The movement-inhibiting-member guides 25*p*, 25*q* may have other dimensions and structures. For example, a shape having a cross section form into a U-shape facing side may be employed.

As shown in FIGS. 2 and 3, a cut portion 251 is, in a predetermined lengthwise directional position (corresponding to the bottom side of an L-shape) on the upper surface of each of the movement-inhibiting-member guides 25*p*, 25*q*. The cut portion 251 is formed adjacent to each of two ends of each of the movement-inhibiting-member guides 25*p*, 25*q*. The distance between a pair of the cut portions 251 is 900 mm to 1900 mm. Note that the distance may be set to the different value.

The movement-inhibiting members 26*a*, 26*b* each having a U-shape facing side are engaged with the cut portions 251. Each of the movement-inhibiting members 26*a*, 26*b* is used to form an angular pipe having a height of 100 mm, a width of 50 mm and a thickness of 1.6 mm into a U-shape facing side. The movement-inhibiting members 26*a*, 26*b* are joined across the movement-inhibiting-member guides 25*p*, 25*q* such that the two ends of the U-shape facing side are inserted into the cut portions 251 adjacent to the two ends of the movement-inhibiting-member guides 25*p*, 25*q*.

A method of loading and securing the coil C on the pallet 2 will be described.

Figure 28:
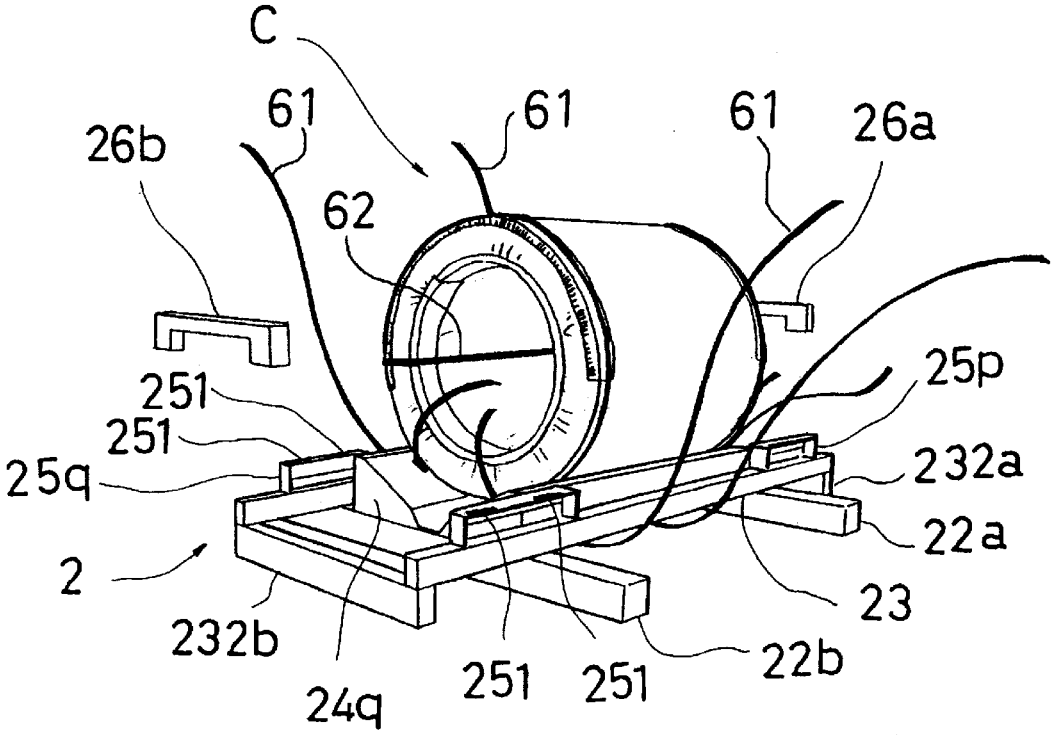
FIG. 28 is a diagram showing a state in which the coil loaded on the pallet is banded.

As shown in FIGS. 25 and 28, the coil C is placed on the camber members 24*p*, 24*q* such that the cylindrical side surface of the coil C is brought into contact with the camber members 24*p*, 24*q*, and then secured using a band. The band is allowed to pass through the central hole of the coil C, and then introduced into the band passage 241 in the camber members 24*p*, 24*q* through the band insertion hole 242*a*. Then, the band is allowed to pass through the band passage 241, and then pulled out to the outside of the camber members 24*p*, 24*q*. Thus, the band is connected to the trailing end of the band pulled out from the central hole of the coil C. Thus, a loop is defined so as to secure the coil C to the camber members 24*p*, 24*q*.

If the coil C can be secured in a stable state by the movement-inhibiting members 26*a*,6*b* to be described later, the securing operation using the band may be omitted.

As shown in FIGS. 25 and 28, the coil C is also bound with the sub-arms 231*p*, 231*q* in a direction perpendicular to the central axis of the coil C by the band allowed to pass through portions below the sub-arms 231*p*, 231*q*.

Therefore, the coil C is held between two inclined surfaces of the camber members 24*p*, 24*q* from front and rear portions so as to prevent longitudinal shift of the coil C. Moreover, the coil C is secured to the camber members 24*p*, 24*q* by the band and also secured to the sub-arms 231*p*, 231*q*, vertical shift of the coil C can also be prevented.

As shown in FIG. 28, the movement-inhibiting members 26*a*, 26*b* are joined at the cut portions 251 adjacent to two ends of the movement-inhibiting-member guides 25*p*, 25*q* to hold two end surfaces of the coil C. As a result, also the lateral (in the direction of the axis of the coil C) shift of the coil C can be prevented. That is, the coil C is firmly secured to the surface of the pallet 2.

(2) Heavy-Article Carrying Vehicle

A carrying vehicle 1 shown in FIGS. 12 to 15 is used for carrying a thin-plate coil C loaded on a pallet.

The carrying vehicle 1 incorporates a support frame 11 on which the pallet is loaded, four air bearings 12*a* to 12*d* disposed on the lower surface of the support frame, a handle portion 13 connected to the rear portion of the support frame and an air-supply pipe portion 14.

Figure 12:
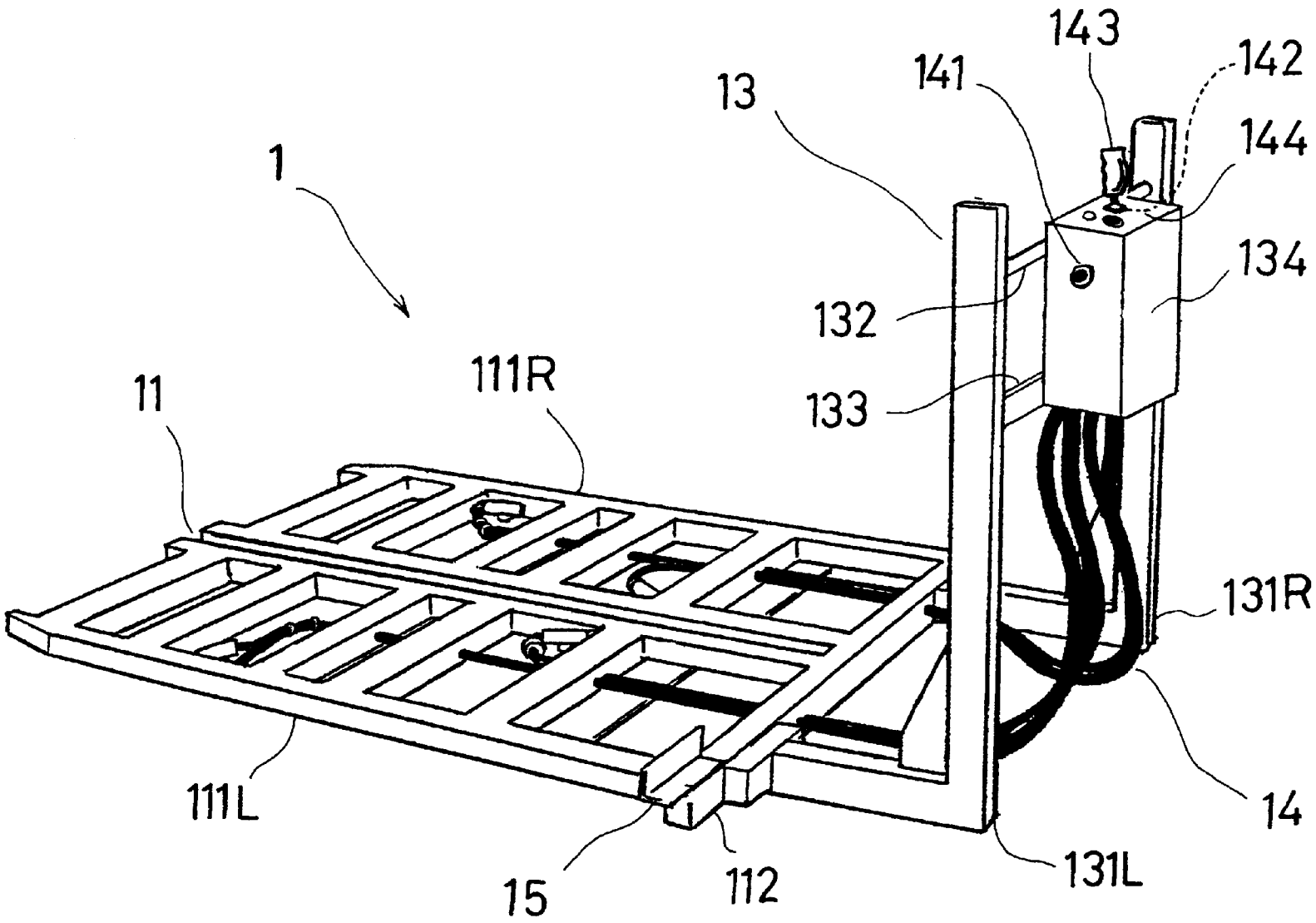
FIG. 12 is a perspective view showing a carrying vehicle in accordance with the present invention.
Figure 13:
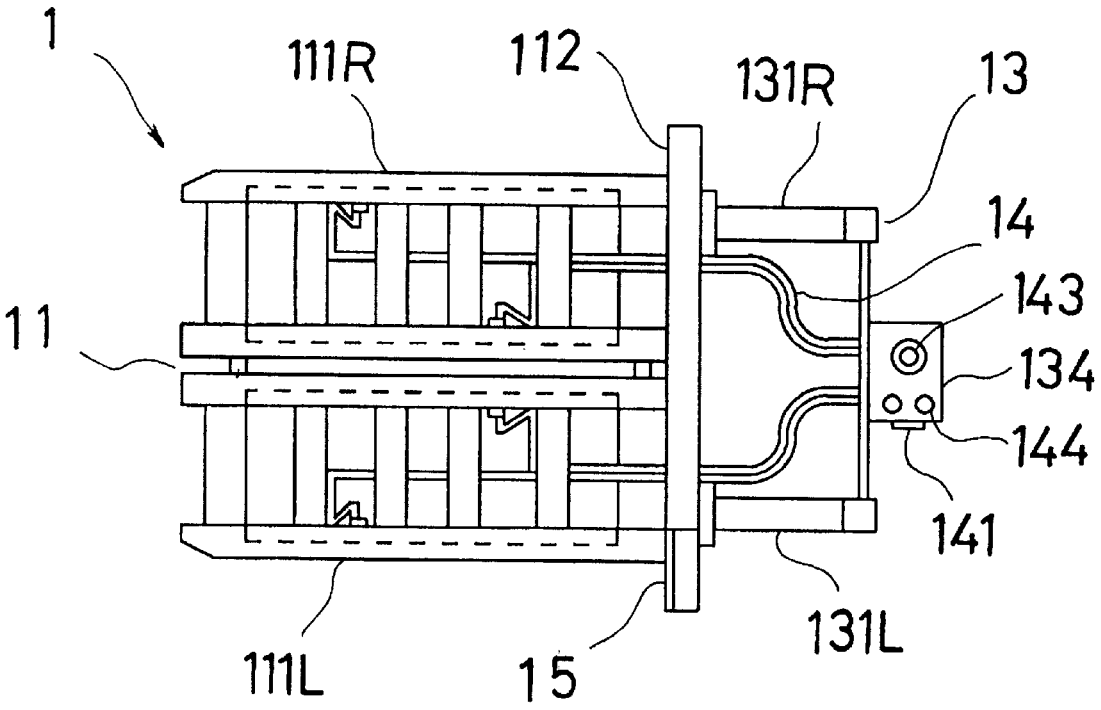
FIG. 13 is a plan view of the carrying vehicle shown in FIG. 12.

As shown in FIGS. 12 and 13, the support frame 11 incorporates a pair of fork portions 111 each of which is formed by conducting ladder-like connection between two angular pipes each having a height of 40 mm, a width of 80 mm, a thickness of 3.2 mm and a length of 1450 mm to be apart at an interval of 420 mm with five angular pipes. Hereinafter, a right-hand fork portion 111 in a direction of movement of the carrying vehicle 1 is called as a fork portion 111R. A left-hand fork portion 111 is called as a fork portion 111L. In the description of the carrying vehicle according to this embodiment, members constituting a pair in the direction of the movement are distinguished from each other using symbols R and L.

The fork portions 111R and 111L are apart at the interval of 30 mm and connected in parallel to a base member 112 as an angular pipe having a height of 60 mm, a width of 60 mm, a thickness of 3.2 mm and a length of about 1400 mm to form a plane. That is, the fork portions 111R and 111L and the base member 112 are disposed to define a character "II" on substantially the same plane.

The leading ends of outer surfaces of the two outer angular pipes of the four square pipes constituting the fork portions 111R and 111L are inclined toward the central portion. Therefore, when a method of discharging the coil to be described later is performed, the fork portions 111R and 111L can easily be inserted into a portion downward of the pallet 2.

Figure 14:
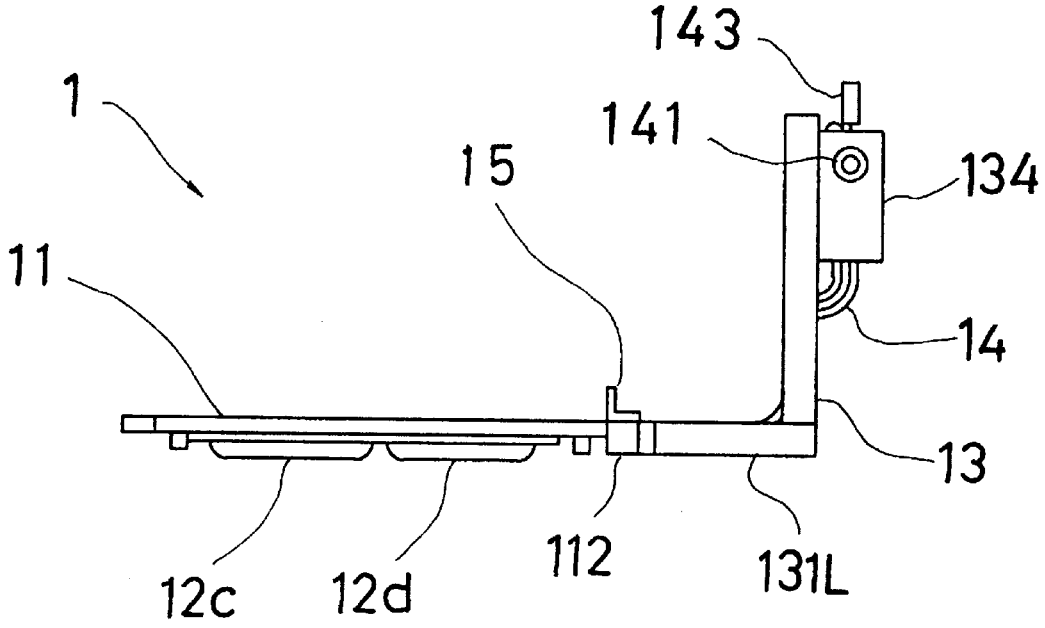
FIG. 14 is a side view of the carrying vehicle shown in FIG. 12.

The air bearings 12*a* to 12*d* are apparatuses for discharging air to levitate the carrying vehicle from the floor surface. As shown in FIG. 14, two air bearings are disposed in the lengthwise direction of each of the fork portions 111R and 111L. Hereinafter, the air bearings 12*a* to 12*d* are collectively called as an air bearing 12 if the air bearings 12*a* to 12*d* are not distinguished from one another.

Figure 17:
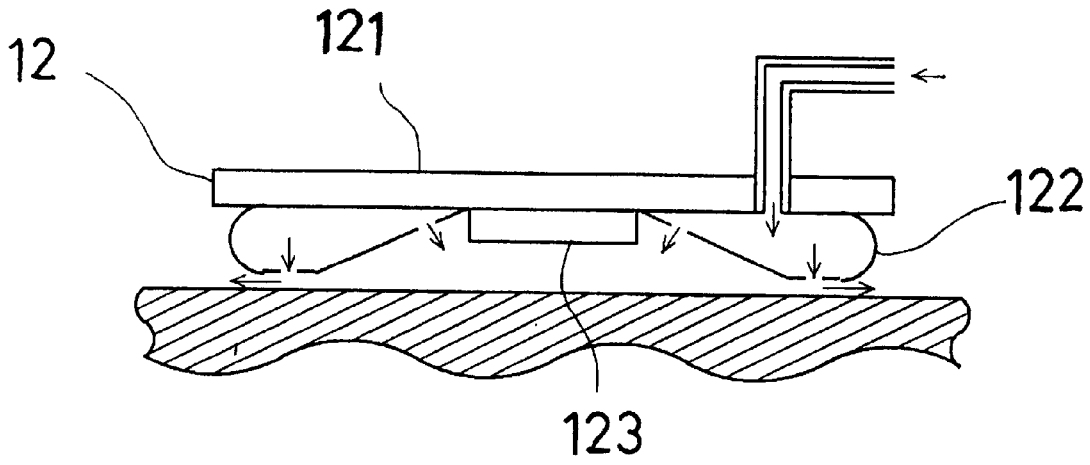
FIG. 17 is a diagram showing a vertical cross section of an air bearing in a levitated state.
Figure 18:
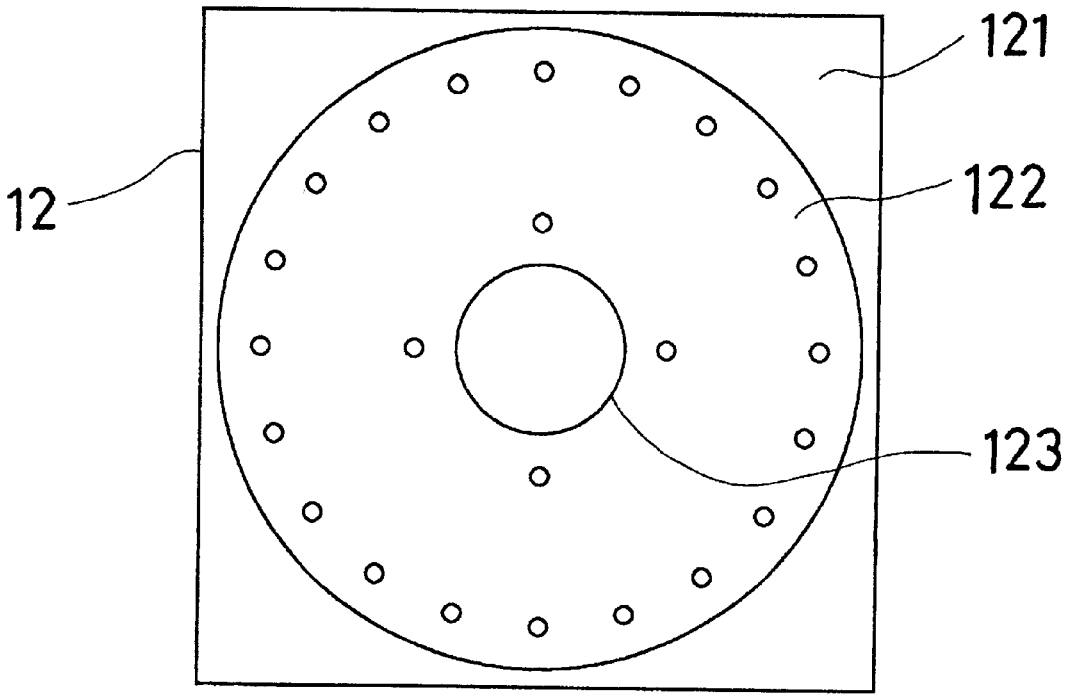
FIG. 18 is a reverse view showing the air bearing shown in FIG. 17.

As shown in FIGS. 17 and 18, the air bearing 12 is provided with a balloon portion 122, disposed on a base plate 121, having an outer diameter of 420 mm and formed into substantially annular shape. A circular landing pad 123 with a diameter of about 50 mm is provided for the inside portion of the central hole of the ring-shaped balloon portion 122. Four air discharge openings are formed adjacent to the central portion of the ring-shaped balloon portion 122, and a plurality of air discharge openings are formed in the peripheral portion of the same. When the balloon portion 122 is deflated, the landing pad 123 maximally projects toward the base plate 121. As shown in FIG. 17, being expanded, the ring-shaped balloon portion 122 maximally projects toward the base plate 121.

The carrying vehicle 1 according to this embodiment has an overall structure in which the legs provided for the carrying vehicle 1 downwards project downward of the landing pad 123. Therefore, when the balloon portion 122 is deflated, the carrying vehicle 1 is supported by the legs. That is, the carrying vehicle 1 is not supported by the landing pad 123.

The balloon portion 122 of the air bearing 12 is supplied with compressed air so as to be expanded. Thus, air is discharged from the air discharge openings of the air bearing 12. As shown in FIGS. 17 and 14, the air bearing 12 is placed to face the floor surface. Therefore, the surface of the ring-shaped balloon portion 122 adjacent to the central hole, the upper surface of the landing pad 123 and the floor surface define a space in the form of a truncated cone downward of the air bearing 12. Air is blown out toward the foregoing space from the air discharge openings. Blown out air is discharged outwards through a gap in the contact portion between the floor surface and the balloon portion 122. Air discharged from the air discharge openings levitates the air bearing 12 from the floor surface so that the support frame 11 provided with the air bearing 12 is levitated from the floor surface accordingly.

Specifically, a thin air layer is formed between the carrying vehicle 1 and the floor surface by the air bearing 12. The air layer reduces the friction between the carrying vehicle and the floor surface so that the carrying vehicle 1 is permitted to be moved with small force in spite of carrying a heavy article.

As shown in FIGS. 12 to 15, the handle portion 13 is formed by connecting support columns 131R, 131L obtained by combining angular pipes each having a height of 60 mm, a width of 60 mm and a thickness of 3.2 mm with each other in to an L-shape structure having a shorter side of 370 mm and a longer side of 840 mm with first and second beam members 132 and 133 so as to be apart at a distance of 760 mm. The first beam member 132 establishes the connection between the support columns 131R and 131L at a position apart from the longer side of each of the support columns 131R and 131L at an interval of 100 mm. The second beam member 133 establishes the connection between the support columns 131R and 131L at a position of the longer side of each of the support columns 131R and 131L closer to the shorter side compared with the first beam member 132 by 205 mm.

Moreover, the first and second beam members 132, 133 are provided with a control box 134 for joining various control units.

As shown in FIGS. 12 and 14, the handle portion 13 is connected to the base member 112 at the ends of the shorter side such that the longer side of its support columns 131R and 131L faces upwards with respect to the support frame 11 grounded in a horizontal plane. Thus, the handle portion 13 is connected to be opposite to the fork portions 111R and 111L such that the base member 112 is interposed.

The air-supply pipe portion 14 extends from a manifold 141 disposed on the left surface of the control box 134 to an ON/OFF switch 144 disposed on the upper surface of the control box 134. The ON/OFF switch 144 is integrally formed with a so-called stop valve. The air-supply pipe portion 14 extends from the ON/OFF switch 144 to a regulator 142 (not shown in FIGS. 12, 13 and 15) disposed on the upper surface of the control box 134. Then, the air-supply pipe portion 14 is branched at the regulator 142 into four sections so as to be connected to the air bearings 12*a* to 12*d*, as shown in FIGS. 12 to 16. The flow rate of compressed air supplied from the pipes connected to the manifold 141 is adjusted by the regulator 142, and then compressed air is supplied to the air bearings 12*a* to 12*d*.

Figure 19:
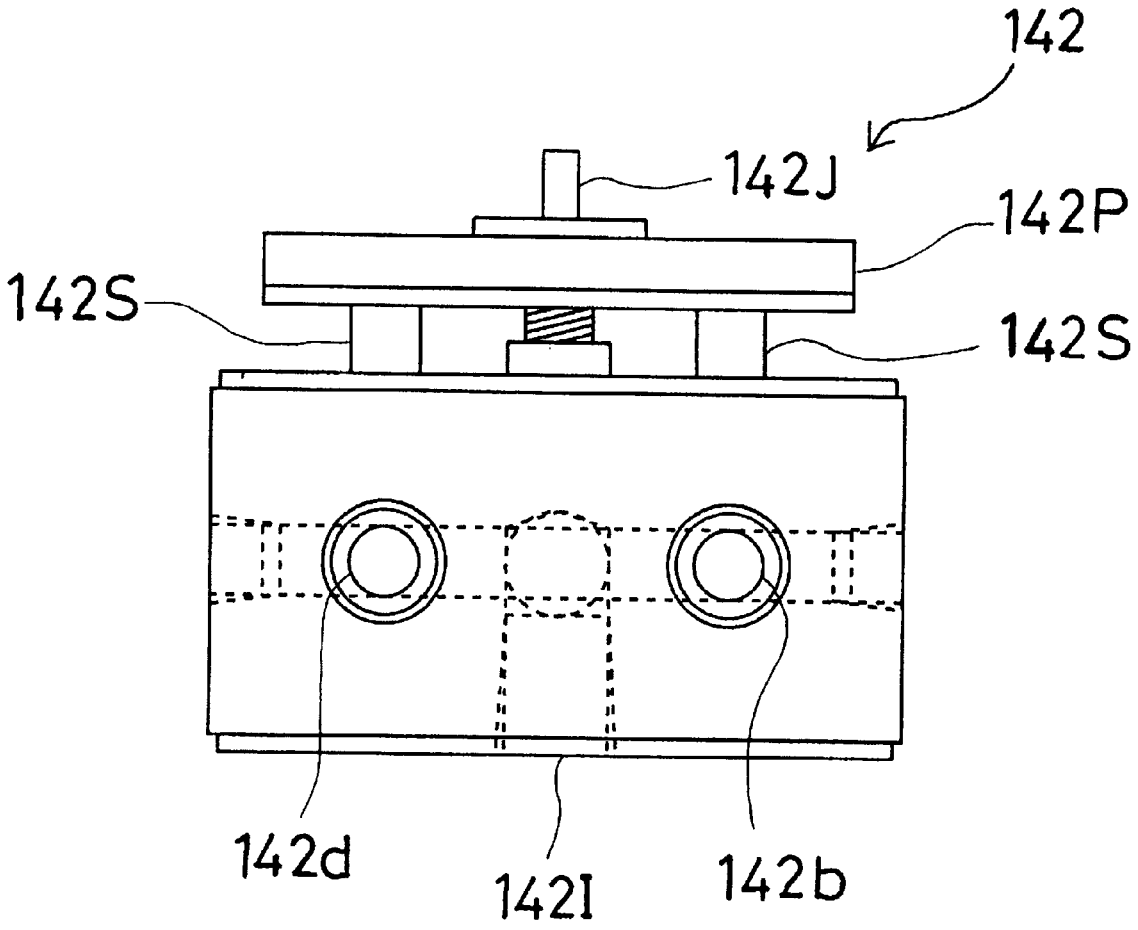
FIG. 19 is a side view showing the body of a regulator in accordance with the present invention.
Figure 20:
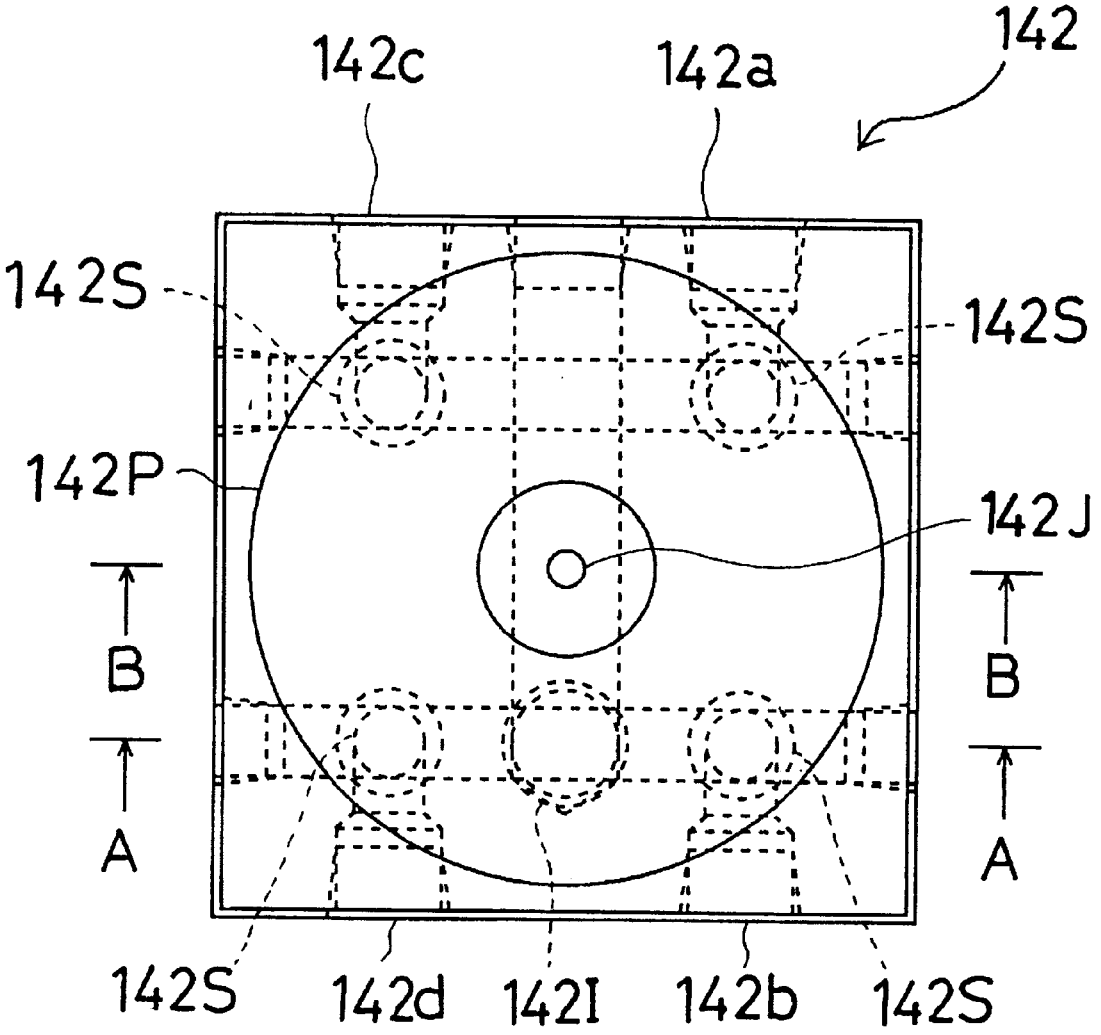
FIG. 20 is a horizontal view showing the body of the regulator shown in FIG. 19.
Figure 21:
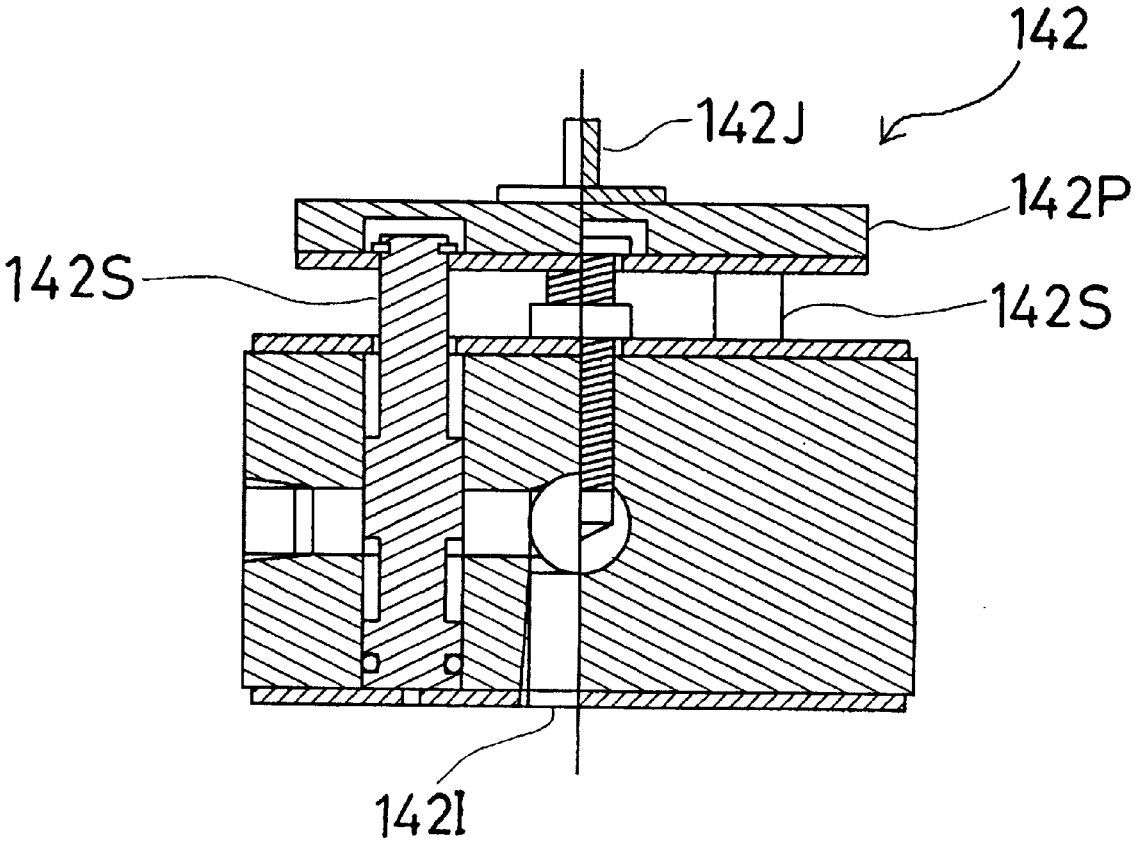
FIG. 21 is a cross sectional view having a right half portion showing section taken along line A—A and a left half portion showing section taken along line B—B shown in FIG. 20.

The body of the regulator 142 is structured as shown in FIGS. 19 to 21.

The body of the regulator 142 is joined to the control box 134. A joy stick 143 is joined to a joy-stick joining portion 142J formed in the central portion of a disc 142P on the upper surface of the control box 134.

The center of the disc 142P is supported by support bolts. The support bolts are, as shown in FIG. 21, connected by a structure in which flanges formed at the leading ends of the support bolts are surrounded by a recessed space formed in the lower center of the disc 142P. Therefore, the disc 142P is allowed to be inclined in an arbitrary vertical direction up to an angular degree of 20° from a vertical state with respect to the support bolts. As a matter of course, the foregoing angle may be set to other value.

On the other hand, an inlet portion 142I provided for the lower surface is connected to the manifold 141 through the ON/OFF switch 144 so that the compressed air is introduced through the inlet portion 142I. The compressed air is discharged from outlet portions 142*a* to 142*d* provided for the side surface so as to be supplied to the air bearings 12*a* to 12*d*.

Passages for the compressed air in the body of the regulator 142 are enlarged/reduced by the four cylinders 142S connected to the disc 142P so that an amount of the compressed air supplied to each of the air bearings 12*a* to 12*d* is adjusted.

That is, inclination of the joy stick 143 to various direction may allow the disc 142P to be inclined to various directions. As a result, each of the four cylinders 142S moves up and down so that the passage for compressed air is enlarged/reduced. Thus, an amount of the compressed air supplied to each of the air bearings 12*a* to 12*d* is adjusted.

The regulator 142 according to this embodiment enables adjustment of each flow rate of the compressed air, which has been performed by the conventional structure, to simultaneously be operated by the joy stick. Since the structure can be simplified and no power source is required, the manufacturing cost and possibility of failure can be reduced.

The total amount of the compressed air to be supplied to the air bearings 12*a* to 12*d* is adjusted by adjusting the adjustment bolts and nuts disposed in the lower portion of the central portion of the disc to adjust the height of the disc 142P with respect to the body, that is, the average height of the four cylinders 142S.

Figure 15:
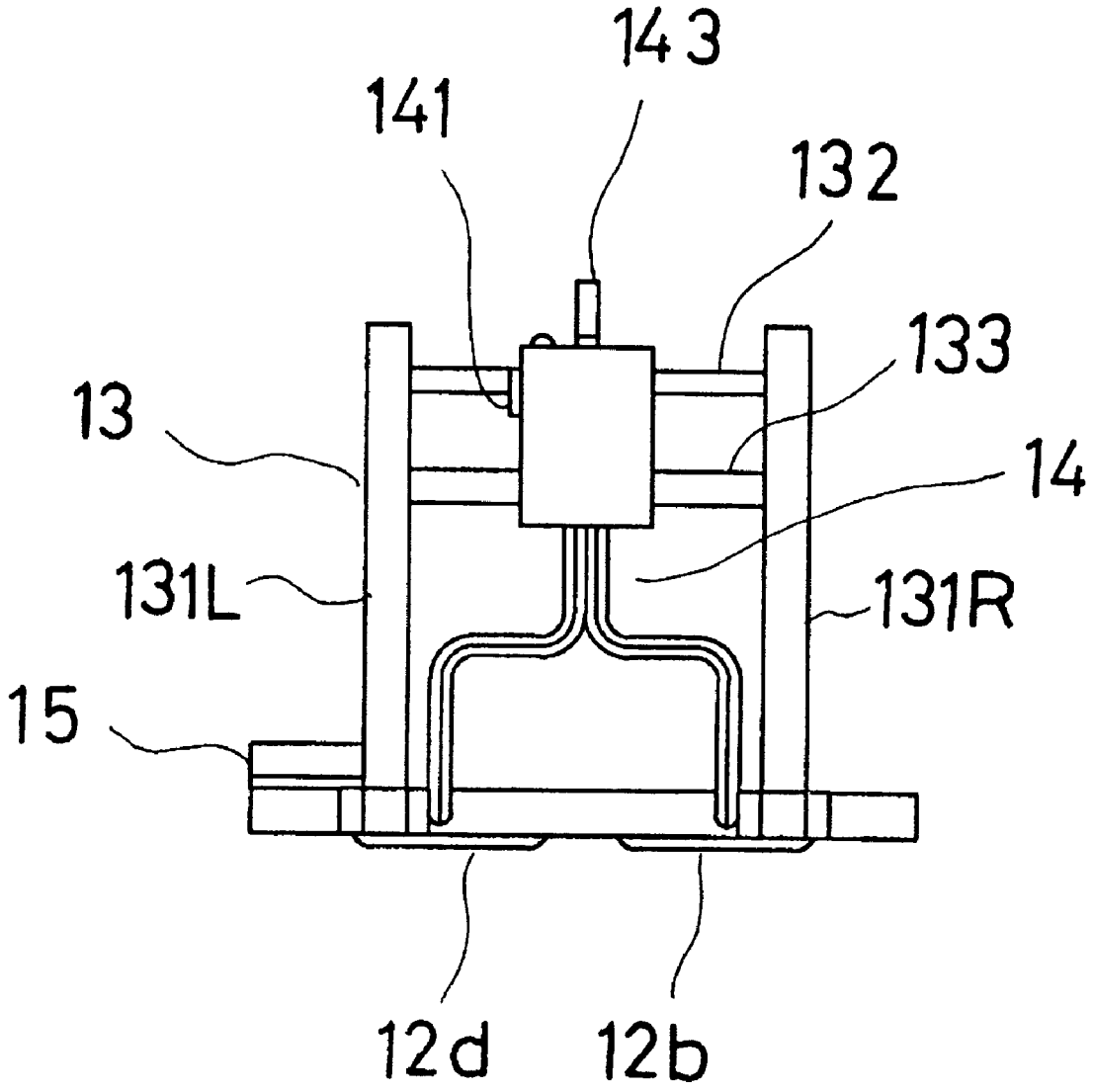
FIG. 15 is a rear view of the carrying vehicle shown in FIG. 12.

As shown in FIGS. 12, 14 and 15, the joy stick 143 is disposed to expose over the upper surface of the control box 134. When turning over the joy stick 143 forwards, the regulator 142 reduces an amount of the compressed air to be supplied to each of the air bearings 12*a* and 12*c* disposed in the front portion of the support frame 11. On the other hand, the amount of the compressed air to be supplied to each of the air bearings 12*b* and 12*d* disposed in the rear portion of the support frame 11 is increased. As a result, the attitude of the support frame 11 is caused to face down frontward. When turning over the joy stick 143 backwards, an amount of the compressed air to be supplied to each of the air bearings 12*a* and 12*c* is increased. On the other hand, an amount of the compressed air to be supplied to each of the air bearings 12*b* and 12*d* is reduced. As a result, the attitude of the support frame 11 is caused to face further upwards.

When turning over the joy stick 143 to the left, an amount of the compressed air to be supplied to each of the air bearings 12*a* and 12*b* is increased. On the other hand, an amount of the compressed air to be supplied to each of the air bearings 12*c* and 12*d* is reduced. As a result, the attitude of the support frame 11 is caused to face down to the right. When the joy stick 143 is inclined to the right, an amount of compressed air to be supplied to each of the air bearings 12*a* and 12*b* is reduced. On the other hand, an amount of the compressed air to be supplied to the air bearings 12*c* and 13*d* is increased. As a result, the attitude of the support frame 11 is caused to face down to the right.

As shown in FIGS. 12 and 13, the ON/OFF switch 144 is disposed on the upper surface of the control box 134 at a position adjacent to the joy stick 143. When turning the ON/OFF switch 144 on, the compressed air is supplied to the air bearings 12*a* to 12*d* through the air-supply pipe portion 14. When turning the ON/OFF switch 144 off, supply of compressed air to the air bearings 12*a* to 12*d* is interrupted. Therefore, turning the ON/OFF switch 144 on or off may control levitation/landing of the carrying vehicle 1 of this embodiment.

Figure 16:
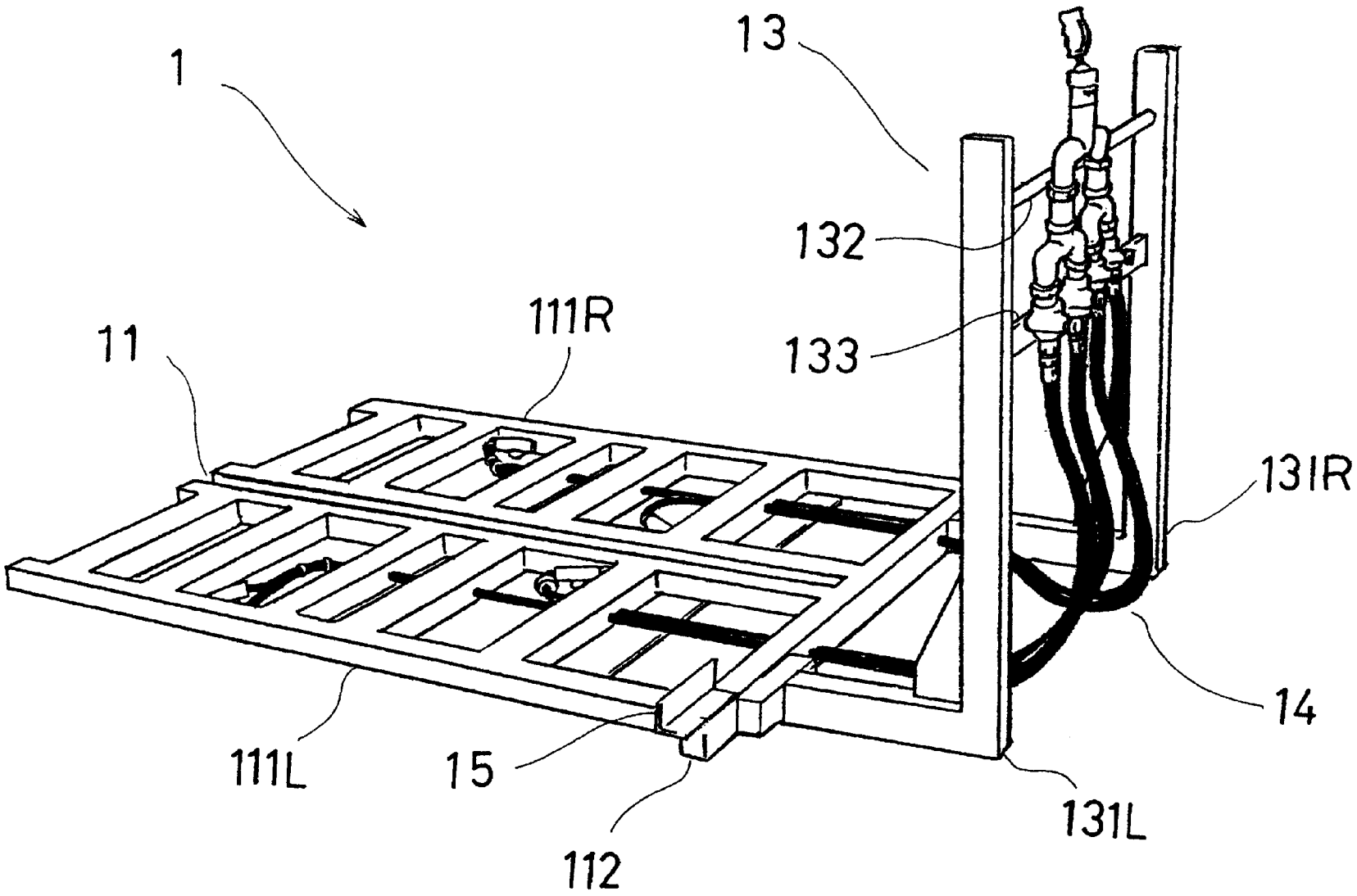
FIG. 16 is a perspective view showing another exemplary carrying vehicle in accordance with the present invention.

Note that the shape of the air-supply pipe portion of the heavy-article carrying vehicle may be structured as shown in FIG. 16.

(3) Stage for Introducing/Discharging Heavy article

Figure 22:
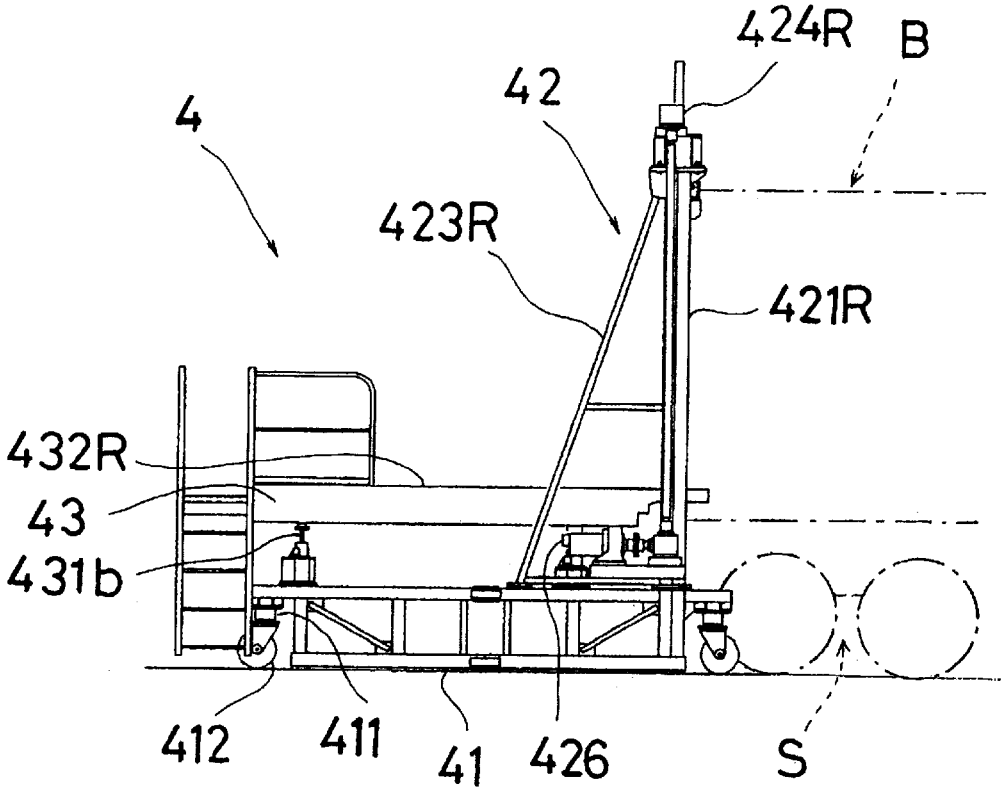
FIG. 22 is a side view showing a stage for introducing/discharging a heavy article in accordance with the present invention.
Figure 23:
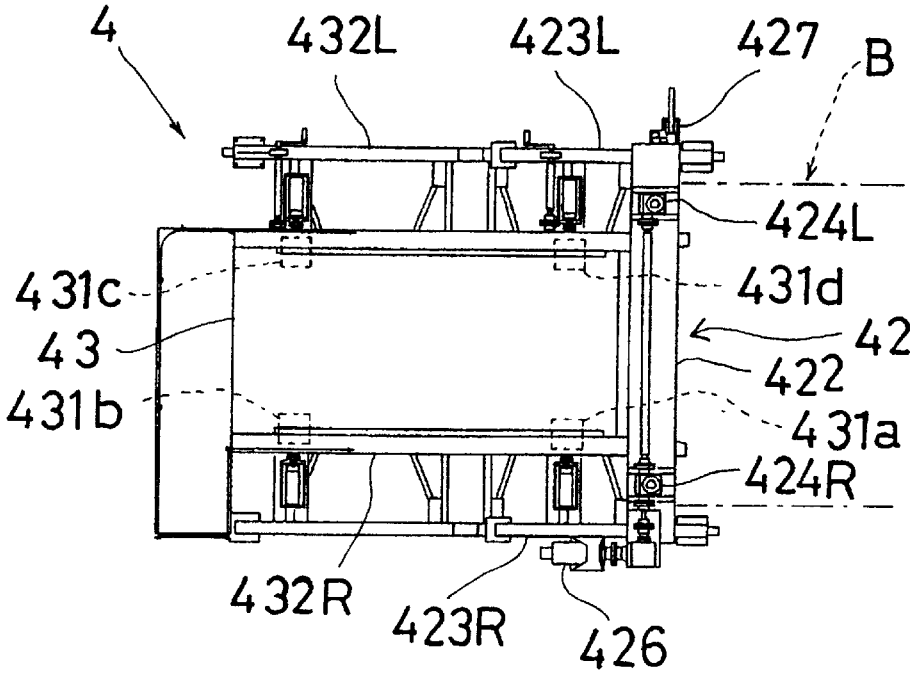
FIG. 23 is a plan view of the stage for introducing/discharging a heavy article shown in FIG. 22.
Figure 24:
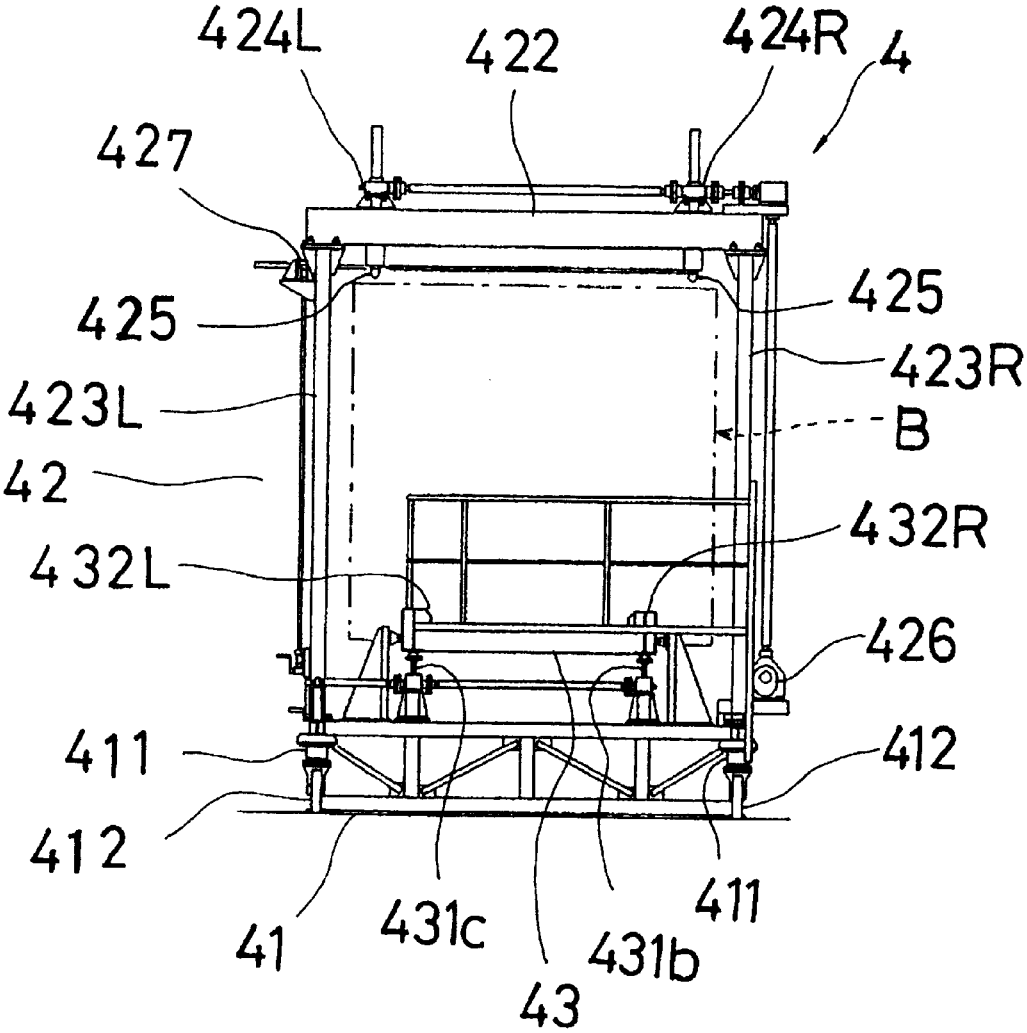
FIG. 24 is a rear view the stage for introducing/discharging a heavy article shown in FIG. 22.

A stage 4 for introducing/discharging a heavy article according to this embodiment and shown in FIGS. 22 to 24 is an apparatus that uses the carrying vehicle to smoothly introducing/discharging a heavy article to and from a dry container loaded on the chassis.

The stage 4 for introducing/discharging a heavy article incorporates a stage body 41, a support column 42 provided for the stage body 41, and a table 43.

The stage body 41 is formed by combining steel materials into a box-like shape (having a longitudinal length of 3869 mm, a lateral length of 3274 mm and a height of 652 mm) and by providing beams for the inside portion. Transport wheels 412 are disposed at the four corners of the stage body 41 through hydraulic cylinders 411 for the wheels vertically disposed. The hydraulic cylinders 411 for wheels of the stage body 41 are extended downwards so that the transport wheels 412 are grounded so as to be allowed to move. When the hydraulic cylinders 411 are contracted, the bottom surface of the stage body 41 is directly grounded on the surface of the earth to be capable of bearing a heavy weight.

In place of the transport wheels 412, the stage body 41 may be provided with ball casters or bearings to obtain a similar effect.

A gate-shaped support column 42 is disposed at the front end of the box-like stage body 41. On the other hand, the table 43 is disposed on the upper surface of the stage body 41.

The support column 42 incorporates right and left columns 421R and 421L disposed at the right and left corners of the front portion of the stage body 41, and a main beam 422 for connecting the right and left columns 421R and 421L at the upper ends. Each height of the right and left columns 421R and 421L is 3365 mm. The gate-shaped structure of the support column 42 composed of the right and left columns 421R and 421L and the main beam 422 has a size with which the chassis S and the container B loaded thereon can be surrounded.

As shown in FIG. 22, the right and left columns 421R and 421L are supported in an auxiliary manner by right and left sub-columns 423R and 423L, each of which is disposed from substantially the central portion of each of the right and left upper sides of the stage body 41 toward the leading end.

As shown in FIG. 23, a pair of right and left worm jacks 424R and 424L are vertically provided for the main beam 422. Moreover, engaging members 425, 425 are disposed at the lower end of each of the worm jacks 424R and 424L. The distance between the worm jacks 424R and 424L is 2260 mm so as to coincide with the distance between the corner metal members disposed at the right and left upper sides of the opening of a 20-feet container. The worm jacks 424R and 424L are operated by an air motor 426 disposed on the upper front right surface of the stage body 41 through a rod disposed along the right column 421R and the main beam 422.

The engaging members 425, 425 disposed at the lower ends of the worm jacks 424R, 424L are able to rotate around vertical axes. The engaging members 425 are, through rods along the main beam, rotated by a rack jack 427 provided for the left column 421L and arranged to be operated manually. As shown in FIG. 3, each of the engaging members 425 has a spade-like shape formed by joining a rod member to the pentagonal plate like a home plate. The engaging members 425 are joined to the worm jacks 424R, 424L such that the rod member is positioned upwards so as to be rotated by the rack jack 427 around the rod member.

On the other hand, the table 43 disposed on the upper surface of the stage body 41 is plate-like shaped having a width of 1818 mm and a length of 3870 mm. The table 43 is supported on the stage body 41 by support jacks (attitude control means) 431*a* to 431*d* disposed at the four corners of the lower surface.

The table 43 incorporates guides 432R, 432L disposed along the right and left sides of the upper surface thereof. Each of the guides 432R, 432L has a height of 95.5 mm and a length of 3650 mm. The rear ends of the guides 432R, 432L coincide with the rear end of the body of the table 43, while the front ends project over the body of the table 43.

Although the stage 4 for introducing/discharging a heavy article according to this embodiment has the above-mentioned dimensions, the dimensions and the configuration of each of the guides 432R and 432L may be made to allow insertion from the opening of a 20-feet container along the right and left inner surfaces of the container.

The support jacks 431*a*, 431*d* are disposed in the front portion of the table 43 so as to be elongated/contracted in synchronization with each other. The support jacks 431*b*, 431*c* are disposed in the rear portion of the table 43 so as to be elongated/contracted in synchronization with each other. The height of the table 43 can be changed by enlarging/contracting the support jacks. The pitch angle (a rotational angle about the lateral axis) can be adjusted by making the height of the support jacks 431*a* and 431*d* different from that of the support jacks 431*b* and 431*c*.

The stage 4 for introducing/discharging a heavy article can be decomposed into the stage body 41, the right and left columns 421R and 421L, the main beam 422 and the table 43. Moreover, the stage body 41 can be decomposed into two sections. Therefore, the stage 4 can be accommodated in the container so as to be transported to a destination together with the container. Since the stage 4 can be transported to the destination together with the heavy-article carrying vehicle 1, the container accommodating a cargo using the pallet 2 can be received by the destination which is not provided with the stage 4 for introducing/discharging a heavy article to effectively use the foregoing function.

(4) Method of Introducing/discharging Coil to and from Container

Figure 30:
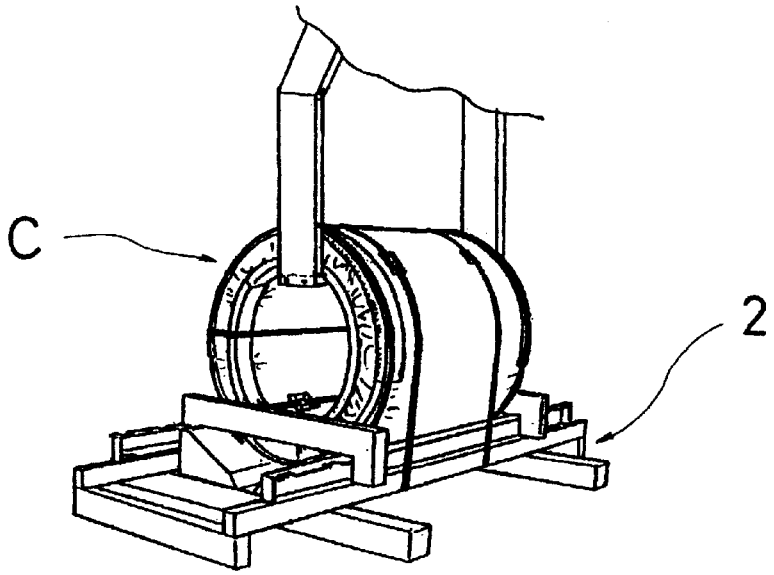
FIG. 30 is a diagram showing a state in which the coil is being conveyed by the tongue.
Figure 31:
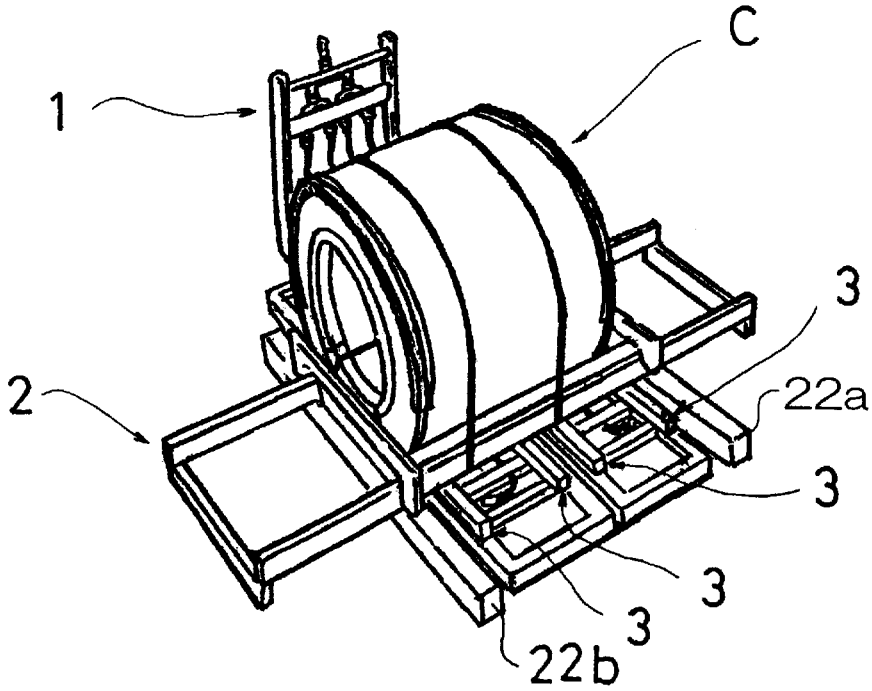
FIG. 31 is a diagram showing a state where the pallet has been loaded on the carrying vehicle.
Figure 32:
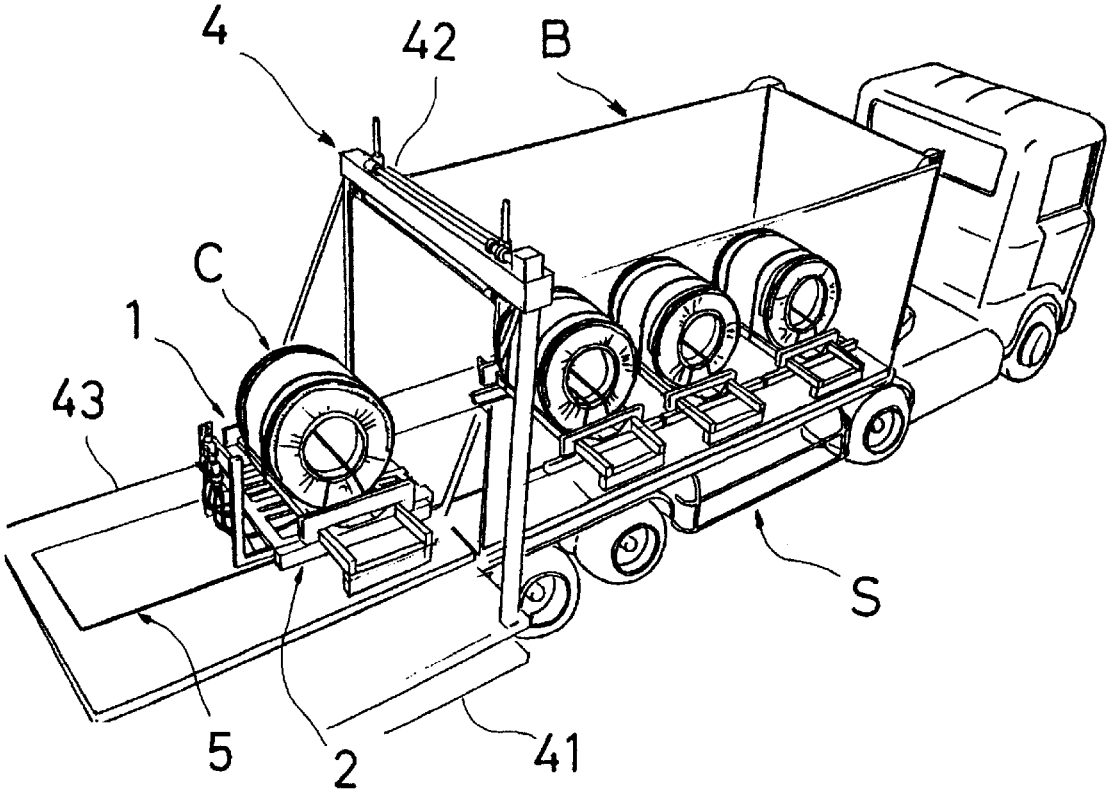
FIG. 32 is a diagram showing a state where the pallet is loaded into the container on the chassis.

A method of introducing the coil according to this embodiment is, as shown in FIGS. 25 to 34, performed by previously loading the coil C on the pallet 2 with a tongue or the like, by securing the coil C with the band and by introducing the thin-plate coil C into the container B together with the pallet 2 by the carrying vehicle 1 and the stage 4 for introducing/discharging a heavy article, as shown in FIG. 32.

(a) Method of Introducing Coil into Container

Figure 29:
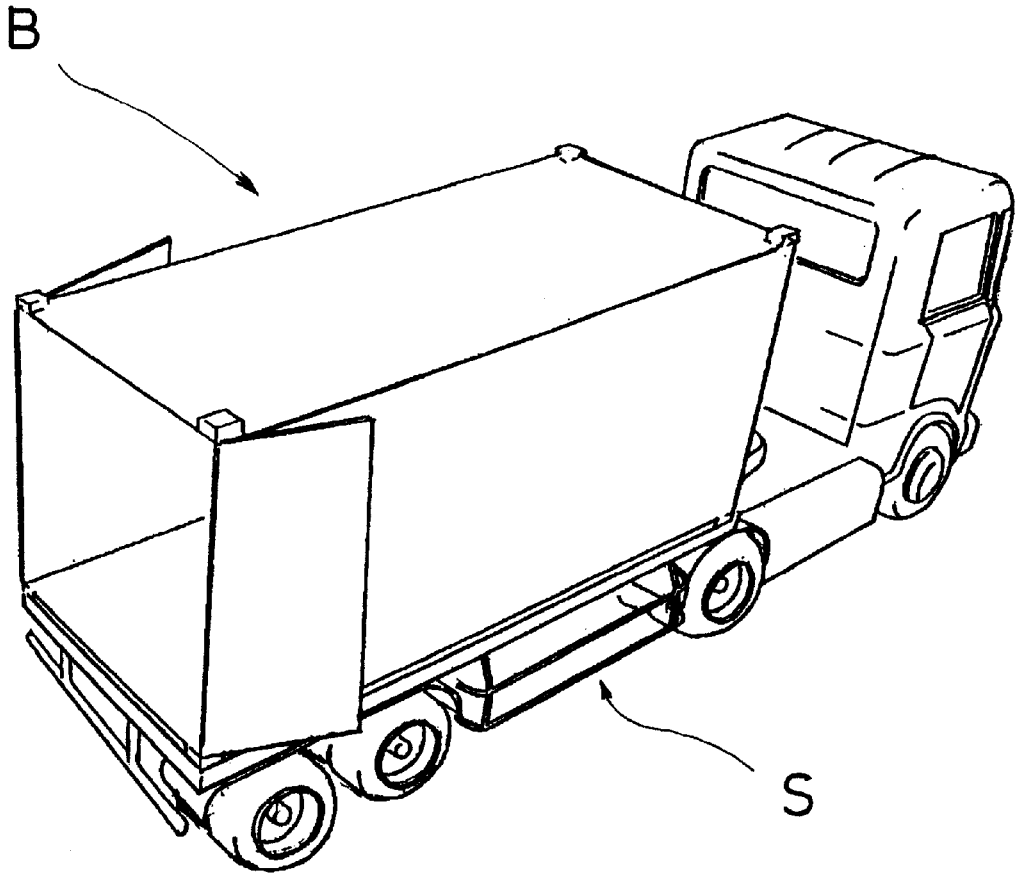
FIG. 29 is a diagram showing a state where an opening door of a container on a chassis has been opened.

As shown in FIG. 29, the opening doors of the dry container B loaded on the chassis S are opened, and then the stage 4 for introducing/discharging a heavy article is transported by the transport wheels 412. As shown in FIGS. 22, 24 and 32, the end portions of the opening of the chassis S are surrounded by the gate-shape support column 42. Then, the hydraulic cylinders 411 for wheels are contracted so that the stage body 41 is placed. Note that landing gears (not shown) disposed in the front portions of the chassis S are extended to be grounded on the floor surface so as to fix the longitudinal height of the front portions of the chassis S before the stage for introducing/discharging a heavy article is transported. The operations of the landing gears may be omitted if the container is not inclined by the loaded heavy article.

At this time, the resin sheet 5 and the carrying vehicle have been loaded on the table 43. The resin sheet 5 is a flexible sheet which does not permit penetration of air (which has not air permeability) and has a width (smaller than the inner width of the container B) smaller than the distance between the leg portions 22*a* and 22*b* of the pallet 2. The length of the resin sheet 5 is substantially the same as the sum of the longitudinal directional length of the table 43 and the depth of the container B. The resin sheet 5 is spread on the table 43 such that the rear end of the resin sheet 5 substantially coincides with the rear end of the table 43. The carrying vehicle 1 is placed on the resin sheet 5. A front portion of the resin sheet 5 over the table 43 is wound up.

The support jacks 431*a* to 431*d* for supporting the table 43 are extended maximally. The table 43 is positioned above the floor surface of the container B by several centimeters. Therefore, when the end portions of the opening of the chassis S are surrounded by the support column 42, the guides 432R and 432L are inserted into the opening of the container B at a height tens of centimeters from the floor surface of the container B (see FIG. 22).

Then, the corner metal members on the upper surface of the opening of the dry container B are engaged by the engaging members 425, 425. The engaging members 425, 425 are suspended by the worm jacks 424R and 424L. The container B and the chassis S are suspended until the springs of the suspension of the chassis S are fully extended (see FIGS. 22, 24 and 32).

Then, as shown in FIGS. 22 and 32, the support jacks 431*a* to 431*d* are contracted such that the height of the upper surface of the table 43 coincides with the height of the floor surface of the container B. Since the guides 432R and 432L have been inserted into the opening of the container B at this time, the support jacks 431*a* to 431*d* are contracted to ground the guides 432R and 432L on the floor surface of the container B. Thus, the height of the upper surface of the table 43 can be adjusted (the guides 432R and 432L are omitted in FIG. 32). Then, the support jacks 431*a* to 431*d* are adjusted to keep the floor surface of the table 43 horizontal.

The wound resin sheet 5 is unwound along the container B so as be spread in the container B, as shown in FIG. 32. The leading end of the resin sheet 5 reaches the innermost position in the container B.

Then, four engaging members 3 as the rod members are longitudinally disposed on the support frame 11 of the carrying vehicle 1 on the table 43 (see FIG. 31).

If the height of the engaging members 3 is added to the height of the upper surface of the support frame 11 in the case where the carrying vehicle 1 on which a heavy article has been loaded is levitated, the calculated height is larger than the height of a space formed downward of the camber members 24*p* and 24*q* of the pallet 2. Moreover, if the height of the engaging members 3 is added to the height of the upper surface of the support frame 11 in the case where the carrying vehicle 1 has been grounded on the floor surface, the calculated height is smaller than the height of the space formed downward of the camber members 24*p* and 24*q* of the pallet 2.

The four engaging members 3 have to be disposed so as not to project over the fork portions 111R and 111L of the carrying vehicle 1. It is preferable that the two engaging members 3 are disposed outwards as much as possible and two other engaging members 3 are disposed in parallel with the leg portions 22*a* and 22*b*. Note that the number of the engaging members 3 may be arbitrary as far as the pallet 2 can be supported.

As shown in FIGS. 30 to 32, a tongue or the like is used to collectively carry the thin-plate coil C secured to the upper surface of the pallet 2 to the upper surface of the support frame 11 of the carrying vehicle 1. At this time, the four engaging members 3 are positioned between the pallet 2 and the support frame 11. The pallet 2, on which the thin-plate coil C has been loaded, is disposed such that the leg portions 22*a* and 22*b* are positioned across the support frame 11 of the carrying vehicle 1 to be positioned in the space downward of the camber members 24*p* and 24*q* of the pallet 2. A gap is formed between the upper surfaces of the engaging members 3 and the lower surface of the pallet 2. Therefore, the weights of the pallet 2 and the coil C are not borne by the support frame 11 but borne by the leg portions 22*a* and 22*b*.

The engaging members 3 may be inserted into a space (a gap between the camber members 24*p*, 24*q* and the support frame 11) downward of the camber members 24*p*, 24*q* after the pallet 2 has been placed on the support frame 11 of the carrying vehicle 1 by the tongue or the like.

As described above, the coil is secured to the upper surfaces of the camber members 24*p*, 24*q* of the pallet 2 with the band. A hose for supplying compressed air from an air compressor (not shown) is connected to the manifold 141 of the carrying vehicle 1. The ON/OFF switch 144 has been switched off at this time so that the carrying vehicle 1 is grounded on the surface of the earth. Then, the following steps (i) to (viii) are performed to introduce the coil.

(i) The ON/OFF switch 144 is switched on to levitate the carrying vehicle 1. Then, the joy stick 143 is operated to adjust the attitude such that the support frame 11 is made to be horizontal.

(ii) The fork portions 111R and 111L of the carrying vehicle 1 are inserted into a position between the leg portions 22*a* and 22*b* of the pallet 2, that is, a position downward of the sub-arms 231*p* and 231*q* and the camber members 24*p* and 24*q*. The carrying vehicle 1 is inserted until the leading ends of the fork portions 111R and 111L project over the sub-arm 231*q* opposite to the carrying vehicle 1 (see FIG. 15).

Specifically, the carrying vehicle 1 is inserted until the sub-arm 231*p* abuts against the positioning member 15 for the carrying vehicle 1 shown in FIGS. 12 to 14. When the pallet 2 loaded with the coil is loaded on the fork portions 111R and 111L with the sub-arm 231*p* abutting against the positioning member 15, the center of gravity of the pallet 2 loaded with the coil substantially coincides with the center of gravity of the air bearings 12*a* to 12*d*.

(iii) The ON/OFF switch 144 is switched off to ground the carrying vehicle 1 on the surface of the earth.

(iv) The four engaging members 3 each having a height of 20 mm and a length of 1100 mm are inserted between the fork portions 111R and 111L of the carrying vehicle 1, the sub-arms 231*p* and 231*q* of the pallet 2 and the camber members 24*p* and 24*q* (see FIG. 31). It is required to prevent projection of the four engaging members 3 over the fork portions 111R and 111L. It is preferable that the two engaging members 3 are disposed outwards as much as possible and two other engaging members 3 are disposed in parallel with the leg portions 22*a* and 22*b*.

If the height of the engaging members 3 is added to the height of the upper surface of the support frame 11 in the case where the carrying vehicle 1 on which a heavy article has been loaded is levitated, the calculated height is larger than the height of a space formed downward of the camber members 24*p* and 24*q* of the pallet 2. Moreover, if the height of the engaging members 3 is added to the height of the upper surface of the support frame 11 in the case where the carrying vehicle 1 has been grounded on the floor surface, the calculated height is smaller than the height of the space formed downward of the camber members 24*p*, 24*q* of the pallet 2.

(v) The ON/OFF switch 144 is switched on to levitate the carrying vehicle 1. As a result, the sub-arms 231*p*, 231*q* and the camber members 24*p*, 24*q* of the pallet 2 are raised by the fork portions 111R and 111L through the engaging members 3 so that the pallet 2 is raised. The joy stick 143 is used to adjust the attitude such that the support frame 11 is made to be horizontal.

The resin sheet 5 spread on the table 43 and the floor surface of the container B may smoothen the irregularity of the floor surface. Moreover, no gap is formed between the table 43 and the container B. Therefore, compressed air discharged from the air bearings 12*a* to 12*d* efficiently levitates the carrying vehicle 1. The guides 432R and 432L (see FIGS. 22 to 24, omitted in FIG. 32) are disposed apart from each other for a distance slightly longer than the distance between the leg portions 22*a* and 22*b* of the pallet 2. Since the guides 432R, 432L have been inserted into the container B from the upper surface of the table 43, an operator is allowed to insert the pallet 2 into the container B by introducing the pallet 2 along the guide 5.

(vi) The handle portion 13 is pushed to accommodate the coil in the container (see FIG. 32).

(vii) After the carrying vehicle 1 has reached a predetermined position in the container B, the ON/OFF switch 144 is switched off to ground the carrying vehicle 1 on the surface of the earth. At this time, also the pallet 2 is grounded on the surface of the earth by means of leg portions 22*a*, 22*b*. The leg portions 22*a* and 22*b* bear the dead weight of the pallet 2 and the weight of the coil C. Therefore, a gap is formed between the upper surface of the engaging members 3 and the lower surface of the pallet 2.

Figure 33:
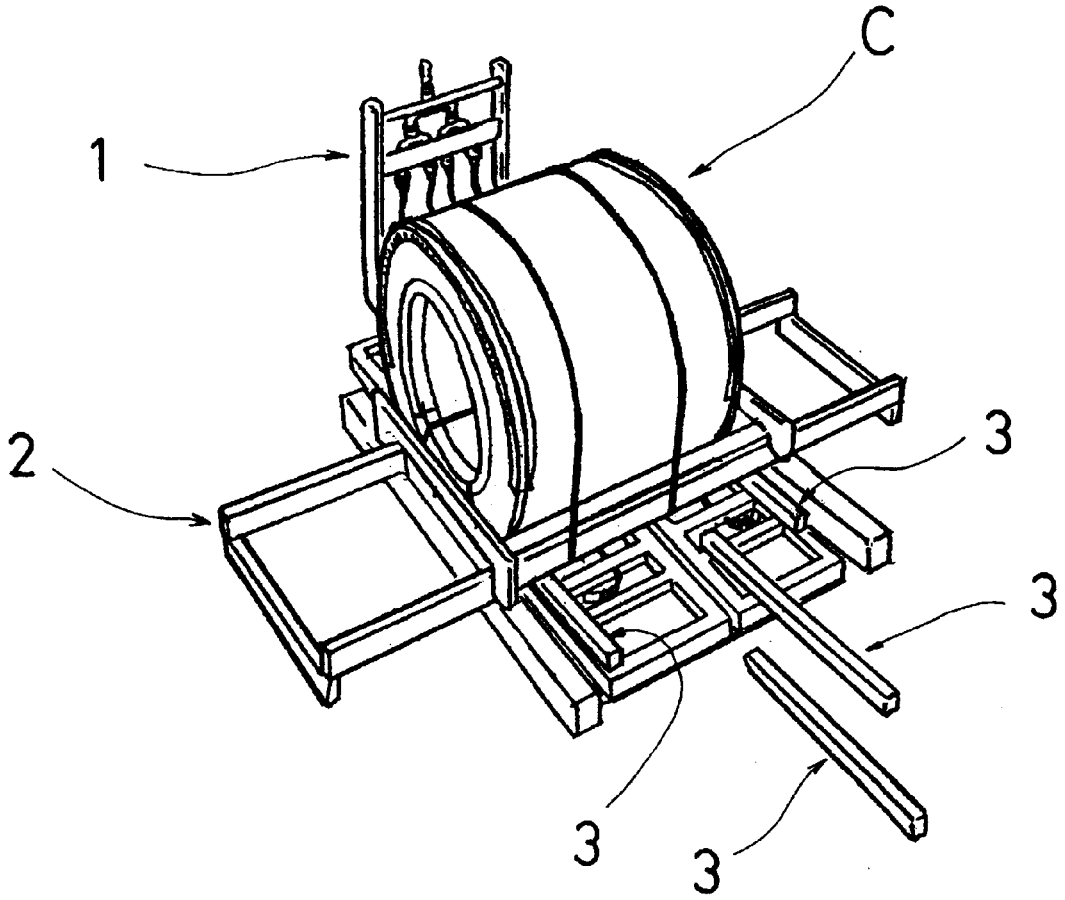
FIG. 33 is a diagram showing a state where engaging members are removed by grounding the carrying vehicle.

Then, as shown in FIG. 33, the four engaging members 3 are removed to levitate the carrying vehicle 1 again. At this time, the support frame 11 is only raised in the space downward of (between the leg portions 22*a* and 22*b*) the pallet 2. That is, the pallet 2 is not raised by the support frame 11.

(viii) The ON/OFF switch 144 is switched on to levitate the carrying vehicle 1 so as to be moved rearwards from the pallet 2, followed by returning the carrying vehicle 1 to the upper surface of the table 43 of the stage 4 for introducing/discharging a heavy article. In this state, the predetermined position of the loaded pallet 2 in the container B is maintained. Note that as shown in FIG. 32, the leg portions 22*a* and 22*b* of the pallet 2 are positioned across the resin sheet 5.

The above-mentioned operation is repeated four times so that four thin-plate coils C loaded on the pallet 2 are introduced into the container B. The distance between the sub-arms 231*p* and 231*q* of the pallet 2 is smaller than the width of the inside portion of the container B by several centimeters. The length of each of the leg portions 22*a* and 22*b* is shorter than ¼ of the depth of the inside portion of the container B. Therefore, the four pallets can be arranged as described above in a range substantially the same as the size of the floor surface of the container B. The conventional lashing operation using nails is not required to prevent a shift of the pallet.

Figure 34:
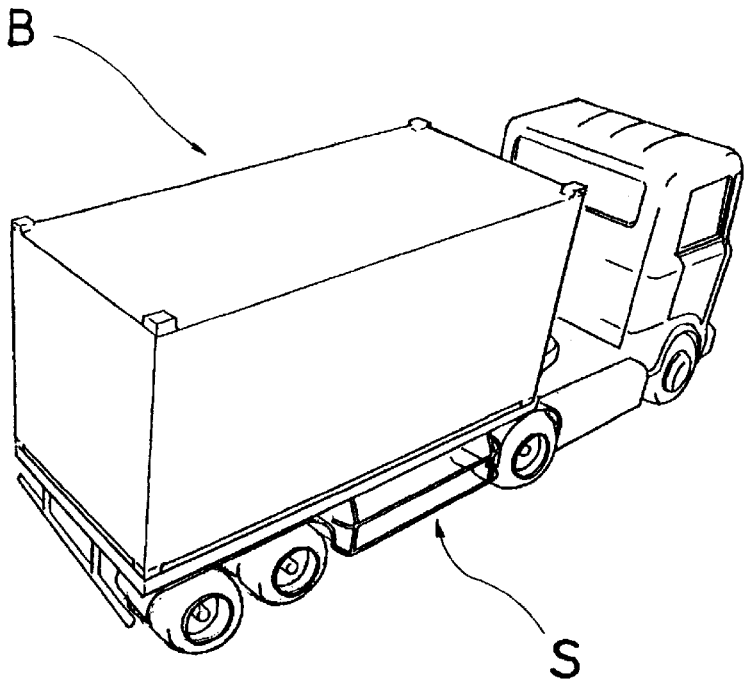
FIG. 34 is a diagram showing a state where the opening door of the container on the chassis has been closed.

Finally, the resin sheet 5 is removed from the inside portion of the container B so as to be wound up. Then, the worm jacks 424R and 424L of the support column 42 are extended such that weights of the container B and the chassis S are borne by the suspension of the chassis S. Thus, engagement of the engaging members 425, 425 is released. Then, while keeping the loaded carrying vehicle 1 on the table 43, the stage 4 for introducing/discharging a heavy article is separated from the chassis S and the container B. Then, the opening doors of the container B are closed as shown in FIG. 34.

As a result, the thin-plate coil is introduced into the dry container on the chassis.

(b) Method of Discharging Coil from Container

A method of discharging the coil from the container is carried out by performing the similar procedure for opening the opening doors of the container B, disposing the stage 4 for introducing/discharging a heavy article, suspending the container B, adjusting the table 43, and spreading the resin sheet 5 in the container B.

Initially, the ON/OFF switch 144 is switched on to levitate the carrying vehicle 1 on the table 43. Then, the joy stick 143 is used to adjust the attitude to make the support frame 11 to be horizontal.

Then, the carrying vehicle 1 is introduced into the container B on the chassis S, and then the fork portions 111R and 111L are inserted into between the leg portions 22*a* and 22*b* of the pallet 2, that is, a position downward of the sub-arms 231*p* and 231*q* and the camber members 24*p* and 24*q*. The carrying vehicle 1 is inserted until the leading ends of the fork portions 111R and 111L project over the sub-arm 231*q* which is opposite to the carrying vehicle 1.

Specifically, the carrying vehicle 1 is inserted until the sub-arm 231*p* abuts against the positioning member 15 for the carrying vehicle 1 shown in FIGS. 12 to 14. The positioning member 15 is disposed such that when the pallet 2 loaded with the thin-plate coil C is loaded on the fork portions 111R and 111L in a state where the sub-arm 231*p* abuts against the positioning member 15, the center of gravity of the pallet 2 loaded with the thin-plate coil C substantially coincides with the center of gravity of the air bearings 12*a* to 12*d*.

The ON/OFF switch 144 is switched off to ground the carrying vehicle 1 on the floor surface of the container B. Then, the four engaging members 3 are inserted between the fork portions 111R and 111L, and the sub-arms 231*p* and 231*q*, and the camber members 24*p* and 24*q* of the pallet 2 (see FIG. 31). The positions of the four engaging members 3 are as described above.

Then, the ON/OFF switch 144 is switched on to levitate the carrying vehicle 1. Thus, the fork portions 111R and 111L raise the sub-arms 231*p*, 231*q* and the camber members 24*p*, 24*q* of the pallet 2 through the engaging members 3 so that the pallet 2 is raised (see FIG. 31). Then, the joy stick 143 is used to adjust the attitude to make the support frame 11 horizontal.

Then, the handle portion 13 is pulled to recede the carrying vehicle 1 from the inside portion of the container B so that the coil C is discharged (see FIG. 32). Then, the ON/OFF switch 144 is switched off to ground the carrying vehicle 1 on the table 43. At this time, the pallet 2 is grounded likewise through the leg portions 22*a* and 22*b*.

Then, the coil C is, together with the pallet, carried to a predetermined position by a tongue or the like (see FIG. 30).

Thus, the thin-plate coil is discharged from the dry container positioned on the chassis.

(5) Effects of this Embodiment

Since the above-mentioned levitation-type heavy-article carrying vehicle is employed in this embodiment, a heavy article can be supported at four points in a stable state. When the amounts of gas discharged from the nozzles separated into four groups are controlled, angles of inclination of the two axes in the horizontal plane can effectively be controlled in a state where the support frame of the heavy-article carrying vehicle is kept levitated. Therefore, the attitude of the support frame can effectively be controlled. Since the control stick is used to control the amounts of gas discharge, the amounts of the gas charge from the nozzles can easily be controlled by changing the angles of inclination of the control stick in direction of the two axes, time required for inclining or the pressure.

Since the heavy-article introducing/discharging stage according to this embodiment incorporates the table provided with the attitude control means, the table can be kept horizontal. Therefore, even if the carrying vehicle is kept standby on the table and a heavy article is loaded, undesirable shift of the carrying vehicle owning to inclination of the table can be prevented. Since the levitation-type carrying vehicle is employed in this embodiment, resistance which is produced during movement can be reduced, allowing easy transportation of the heavy article.

The coil carrying method according to this embodiment enables the coil to be introduced into a container having a side inlet portion. Therefore, a dry container can be used to transport the coil. As a result, the close packing of each coil for the purpose of preventing a flaw that has been required for the conventional method is not longer required. Since the dry container exhibits air-tightness, close packing for preventing the rust is not required. Moreover, the coil carrying method according to this embodiment enables the heavy-article introducing/discharging keeping mounted the container on a chassis.

The carrying method according to this embodiment uses the pallet made of iron and specially configured. Therefore, lashing which has been required to secure a wooden pallet with nails in the conventional method is not required, thus saving the labor and time to the substantial degree. As the wood material contains water, there is apprehension that water discharged in the sealed dry container may rust the coil. However, the carrying method according to this embodiment using no wood material is free from the above-mentioned potential problem.

The conventional wood skid (the pallet) has to be trashed as the waste. On the contrary, the pallet according to this embodiment is made of iron, thus allowing the waste pallet to be recycled.

Since the dry container is employed, the periodical shipping can be used when marine transport is performed. Thus, frequent transportation of coils in a small quantity can be performed. Therefore, as compared with the conventional method with which coils in a large quantity are transported once by a conventional ship, intermediate stock can be reduced as well as shortening the time required to complete transportation.

As compared with the open-top containers and the flat-truck containers which allow introduction from above portion, a large quantity of cargo can be distributed by the dry container at a low cost as a preferable means for physical distribution.

Since the pallet has the holding portion which supports the side surface of the cylindrical coil-shape heavy article and which has the pair of opposite inclined surfaces, rolling of the coil-shape heavy article can be prevented. Thus, the coil-shape heavy article can be placed in a stable state. Since the side surface of the cylindrical coil-shape heavy article is supported by the opposite inclined surfaces, coil-shape heavy articles having a variety of outer diameters satisfying a predetermined range can be loaded. The opposite inclined surfaces support the side surface of the cylindrical coil-shape heavy article. Therefore even if the coil-shape heavy article is swayed to a certain degree, it is moved by gravitational force to reach around the central portion between the pair of the holding portion. The pallet for a coil-shape heavy article according to this embodiment is free from a cargo shift even if the above-mentioned securing operation is omitted. Therefore, the coil can be transported without generating the flaw. The securing members, for example, the band and the movement-inhibition member may prevent the heavy article from being separated.

Second Embodiment

A pallet, a heavy-article carrying vehicle, a heavy-article introducing/discharging stage and a carrying method using the same are as follows.

(1) Pallet

A pallet 2 for a coil-shape heavy article according to this embodiment has a structure similar to that of the pallet according to the first embodiment. The pallet of the second embodiment is different from that of the first embodiment in that the movement inhibiting member and a stack-support portion are further provided.

As shown in FIGS. 36 to 39, the pallet 2 for a coil-shape heavy article according to this embodiment incorporates the sub-arms 231*p*, 231*q* which have side-end guides 233*a*, 233*b* in place of the sub-leg members 232*a*, 232*b*, respectively.

Figure 37:
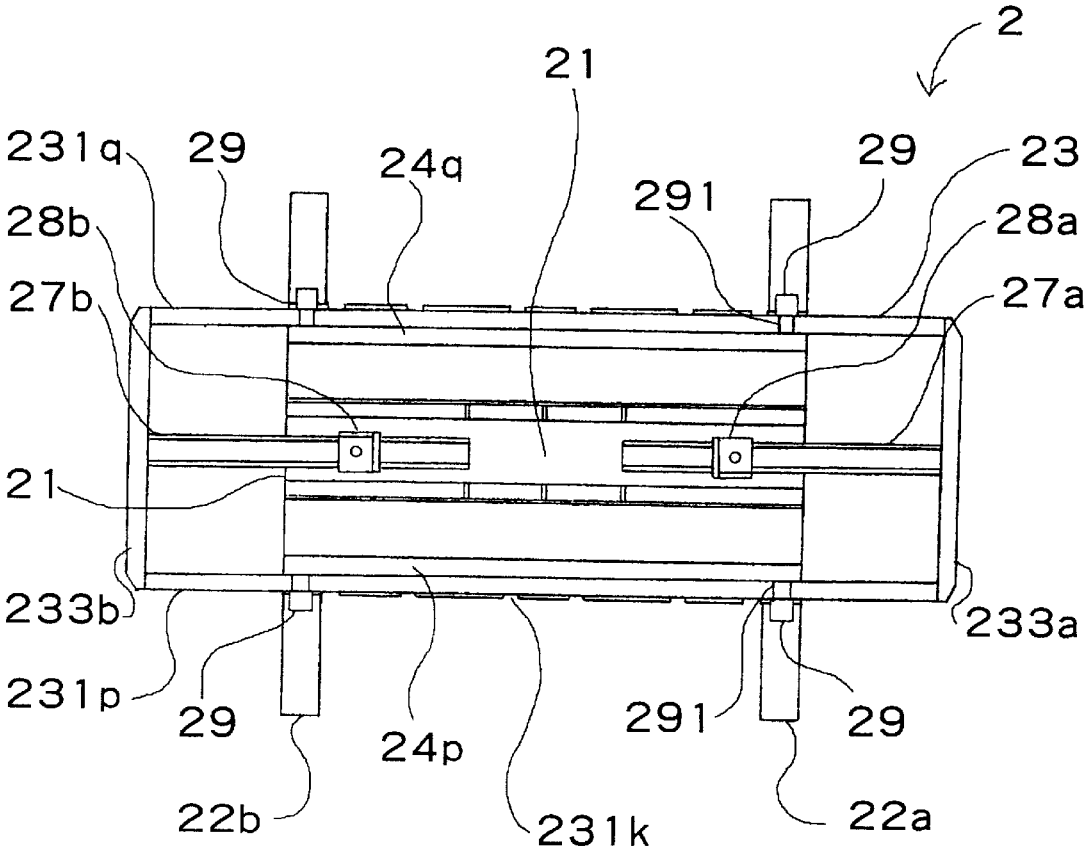
FIG. 37 is a plan view of the pallet shown in FIG. 36.
Figure 38:
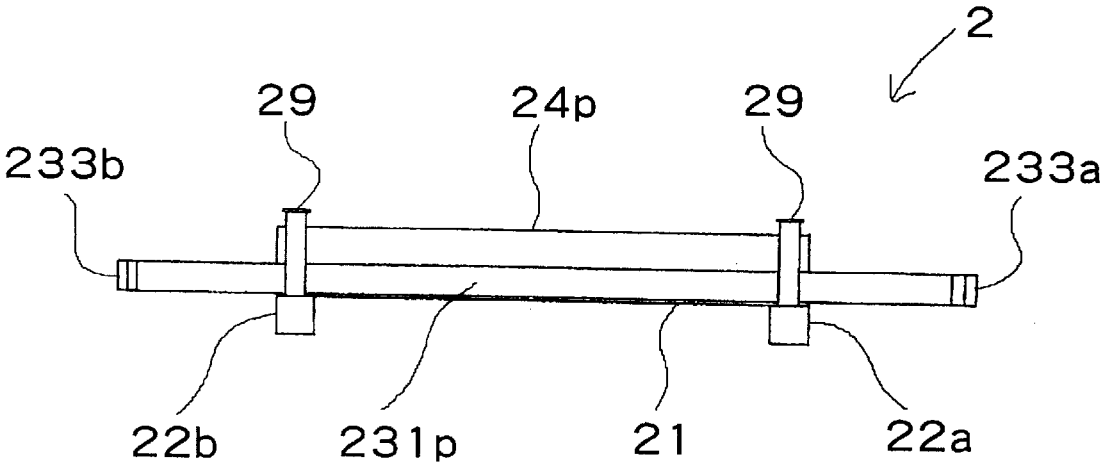
FIG. 38 is a side view of the pallet shown in FIG. 36.

As shown in FIGS. 37 and 38, the side-end guides 233*a*, 233*b* are rod members having two ends connected to the leading ends of the sub-arms 231*p*, 231*q* and longitudinally disposed. The distance between the outer surfaces of the side-end guides 233*a*, 233*b* is shorter than the width of the internal space of the container by several centimeters. Therefore, the side-end guides 233*a*, 233*b* are, similar to the sub-leg members 232*a*, 232*b*, able to prevent undesirable lateral shift of the pallet 2 for a coil-shape heavy article in the container.

Figure 36:
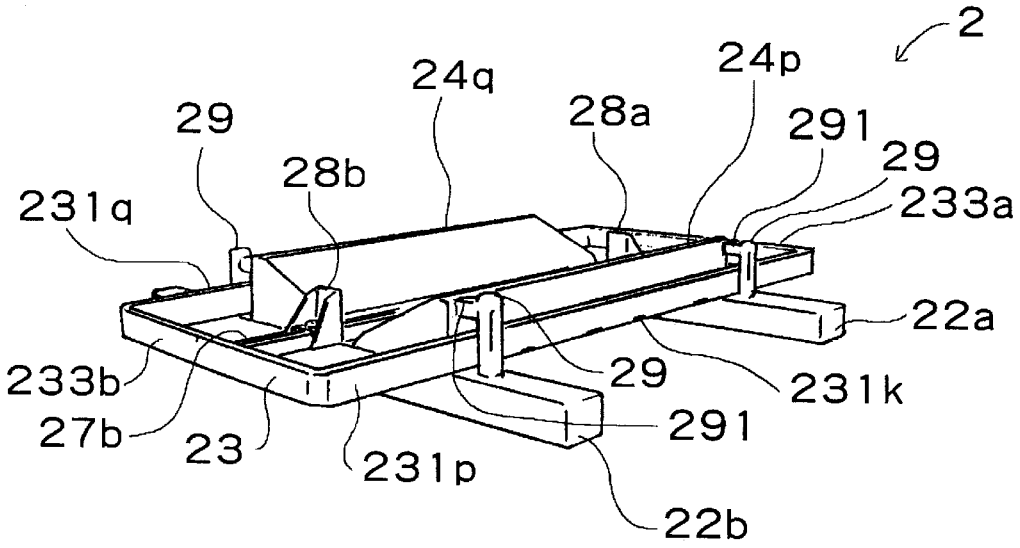
FIG. 36 is a perspective view showing another exemplary pallet in accordance with the present invention.

As shown in FIGS. 36 and 37, the outer corners in the front and rear portions of each of the side-end guides 233*a*, 233*b* are cut away so as to form tapered shapes. That is, the widths of the front and rear ends are reduced. Therefore, when the pallet 2 is introduced such that the sub-arm 231*p* is positioned forwards or the sub-arm 231*q* is positioned forwards, the pallet 2 can easily be introduced into the container without requiring a delicate position alignment.

Since the levitation-type carrying vehicle 1 is employed in this embodiment, the route can easily be modified when the leading ends of the side-end guides 233*a*, 233*b* are brought into contact with the inner wall of the container B with substantially small force. Therefore, the pallet 2 for a coil-shape heavy article can be introduced into the container without exerting damage.

A cut portion 231*k* is formed at a corner in the lower portion of the bottom plate 21. The cut portion 231*k* allows a binding band 61 to pass therethrough. The binding band 61 is not directly brought into contact with a corner of the bottom plate 21 or the like. Therefore, cutting and lateral shift hardly take place.

On the other hand, the pallet 2 for a coil-shape heavy article according to this embodiment is provided with a coil-end fixing mechanism. The coil-end fixing mechanism is composed of slide rails 27 and movement inhibiting members 28 each forming a pair provided for right and left portions. As shown in FIGS. 36, 37, 39 and 40, the pair of slide rails 27*a*, 27*b* running parallel with the camber members 24*p*, 24*q* are disposed therebetween on the bottom plate 21. The slide rails 27*a*, 27*b* extend outwards from positions at which the slide rails 27*a*, 27*b* are facing with and apart from each other at the interval of 40 cm to reach the side-end guides 233*a*, 233*b*.

The slide rails 27*a*, 27*b* are provided with movement inhibiting members 28*a*, 28*b* which are stood erect to be capable of sliding as designed. The upper ends of the movement inhibiting members 28*a*, 28*b* are not higher than the upper ends of the camber members 24*p*, 24*q*. Note that the foregoing upper ends may be stood erect or bent outwards.

The movement inhibiting members 28*a*, 28*b* incorporate bolts which penetrate therethrough to extend to the slide rails 27*a*, 27*b*. Each of the slide rails 27*a*, 27*b* accommodates a block which has a hole into which a bolt is inserted. When the bolt is turned to be joined to the block, the block is moved upwards until the block and the lower surface of the upper frame of the slide rail are brought into contact with each other. Thus, the movement inhibiting members 28*a*, 28*b* can be secured to the slide rails 27*a*, 27*b*.

The pallet 2 for a coil-shape heavy article according to this embodiment incorporates the movement inhibiting members 28*a*, 28*b*. Therefore, when the coil is placed such that the side surface of the cylindrical coil is in contact with the inclined surfaces of the camber members 24*p*, 24*q*, the end surface of the coil can be held between the movement inhibiting members 28*a* and 28*b* for securing the coil.

The movement inhibiting members 28*a*, 28*b* are slidably joined to the slide rails 27*a*, 27*b* so as to be bolted to predetermined positions with. Therefore, coils having various widths can be secured. The slide rails extend from the position at which the slide rails are held between the holding portions to the range exceeding the ends of the holding portions. Therefore, a coil-shape heavy article having a width wider than that of the holding portion can be secured by holding the end surface.

Moreover, the pallet 2 for a coil-shape heavy article according to this embodiment incorporates stack-support portions 29 formed on the leg portions 22*a*, 22*b* at positions interposing the sub-arms 231*p*, 231*q* as shown in FIGS. 36 to 40.

Four stack-support portions 29, each of which is a column member, are formed on the leg portions 22*a*, 22*b* at positions interposing the sub-arms 231*p*, 231*q*. The lower surfaces of the stack-support portions 29 which have penetrated the leg portions 22*a*, 22*b* and formed into recessed shapes substantially coincide with the bottom surfaces (the lower surfaces) of the leg portions 22*a*, 22*b*. On the other hand, the upper portions are connected to the longitudinal end surfaces of the camber members 24*p*, 24*q*. Moreover, the lower ends of the stack-support portions 29 are the position substantially coinciding with the lower surfaces of the leg portions 22*a*, 22*b*. The upper ends are higher than the upper ends of the camber members 24*p*, 24*q* by several centimeters. Each of the upper surfaces is formed into a projecting spherical surface while each of the lower surfaces is formed into a recessed spherical surface.

The pallets 2 for coil-shape heavy articles according to this embodiment can be stacked by the stack-support portions 29. That is, when the lower ends of the stack-support portions 29 of a next pallet 2 for a coil-shape heavy article are placed on the upper ends of the four stack-support portions 29 of the pallet 2 for a coil-shape heavy article placed on the floor surface. Therefore, after the heavy article has been transported, a plurality of empty pallets can be stacked and returned compactly.

The pair of the holding portions for supporting the side surface of the cylindrical coil-shape heavy article are disposed opposite to each other, thus preventing the coil-shape heavy article from rolling. Therefore, the coil-shape heavy article can be placed in a stable state. The side surface of the cylindrical coil-shape heavy article is supported by the opposite inclined surfaces. Therefore even if the coil-shape heavy article is swayed to a certain degree, it is moved by gravitational force to reach around the central portion between the pair of the holding portion. Even if the operation for securing the coil is omitted, the pallet for a coil-shape heavy article according to this embodiment is able to prevent a cargo shift. Therefore, transportation can be performed without generating the flaw.

Figure 51:
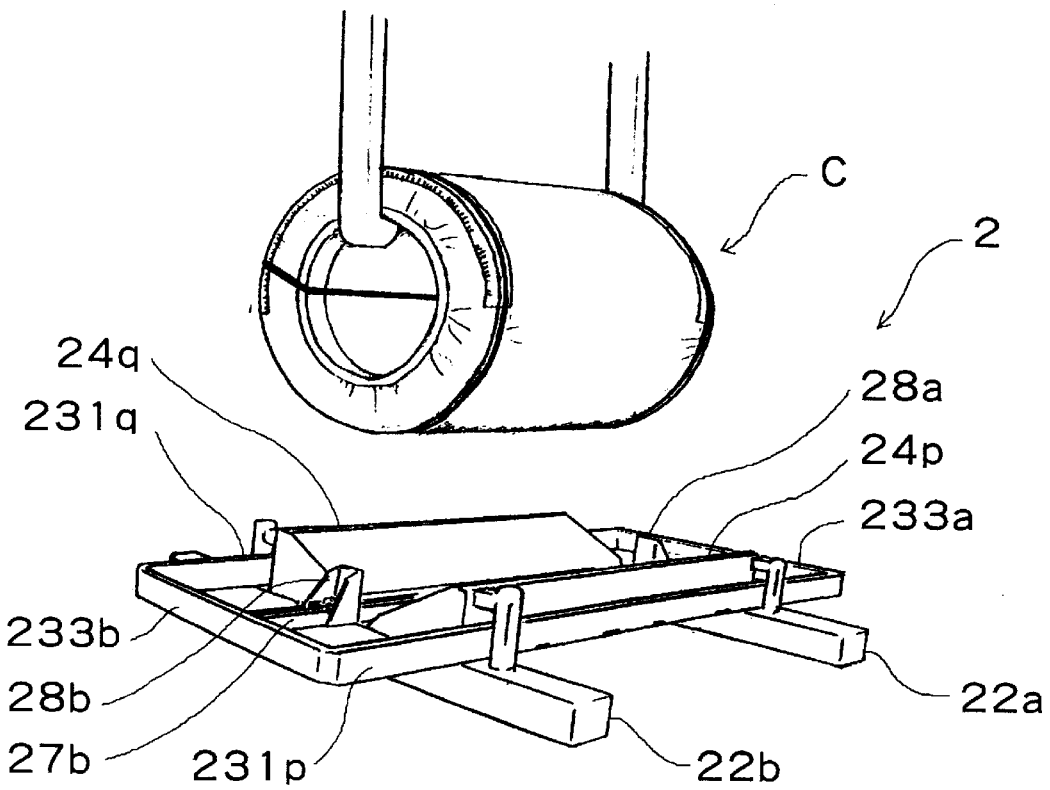
FIG. 51 is a diagram showing a process for suspending a coil by a tongue to place the coil on a pallet.
Figure 52:
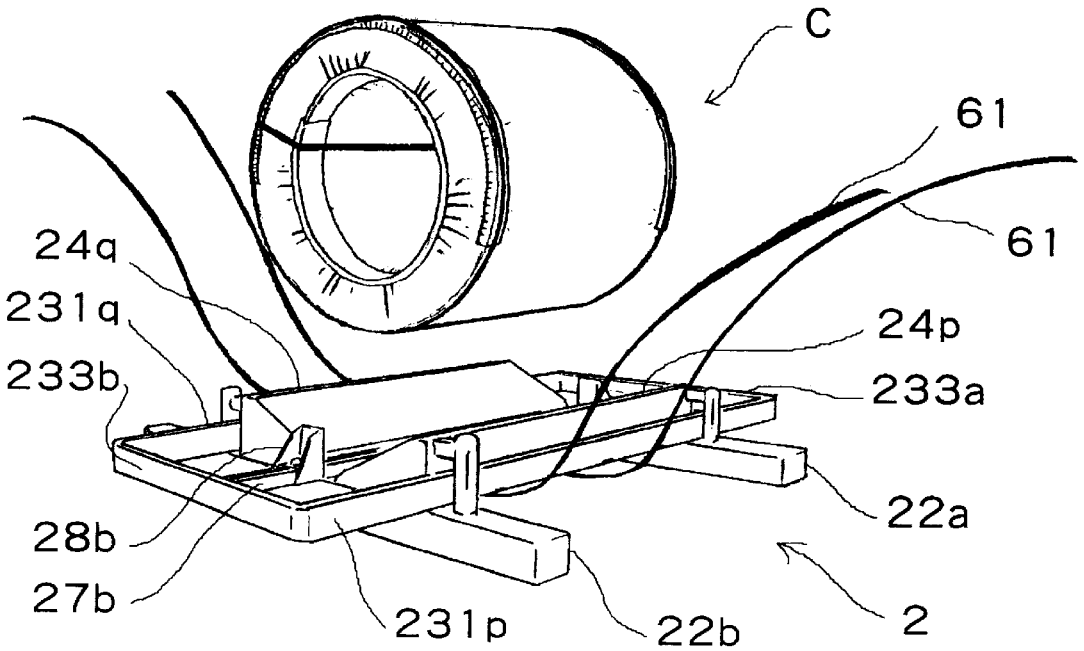
FIG. 52 is a diagram showing a state where the coil is being placed and banded on the pallet.
Figure 53:
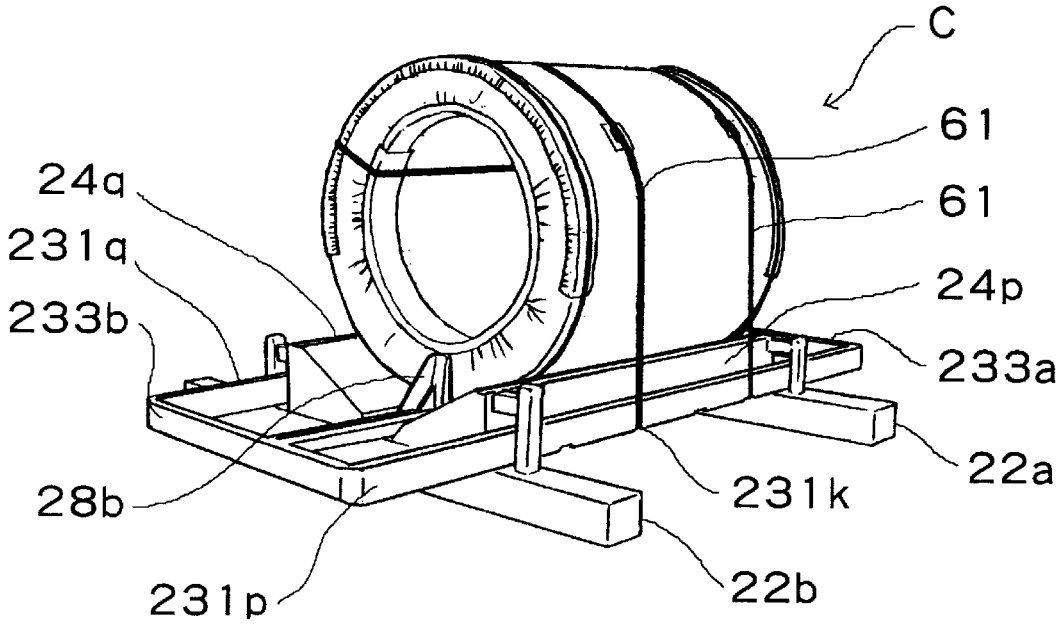
FIG. 53 is a diagram showing a state where the coil has been placed and banded on the pallet.

(2) Method of Securing Coil-Shape Heavy Article to Pallet for Coil-Shape Heavy Article When a coil is secured to the pallet 2 for a coil-shape heavy article according to this embodiment, a packed coil C is initially placed on the inclined surfaces of the camber members 24*p*, 24*q* as shown in FIG. 51. Then as shown in FIGS. 52 and 53, the binding band 61 is used to bind the coil C and the pallet 2 for a coil-shape heavy article together in a direction perpendicular to the axis of the coil. At this time, the binding band 61 is routed to pass through the cut portion 231*k* at the corner of the lower surface of the bottom plate 21.

Then, the movement inhibiting members 28*a*, 28*b* are moved on the slide rails 27*a*, 27*b* so as to be positioned to interpose the two ends surfaces of the coil C as shown in FIG. 53. Then, bolts are used to secure the coil C in the position.

Figure 54:
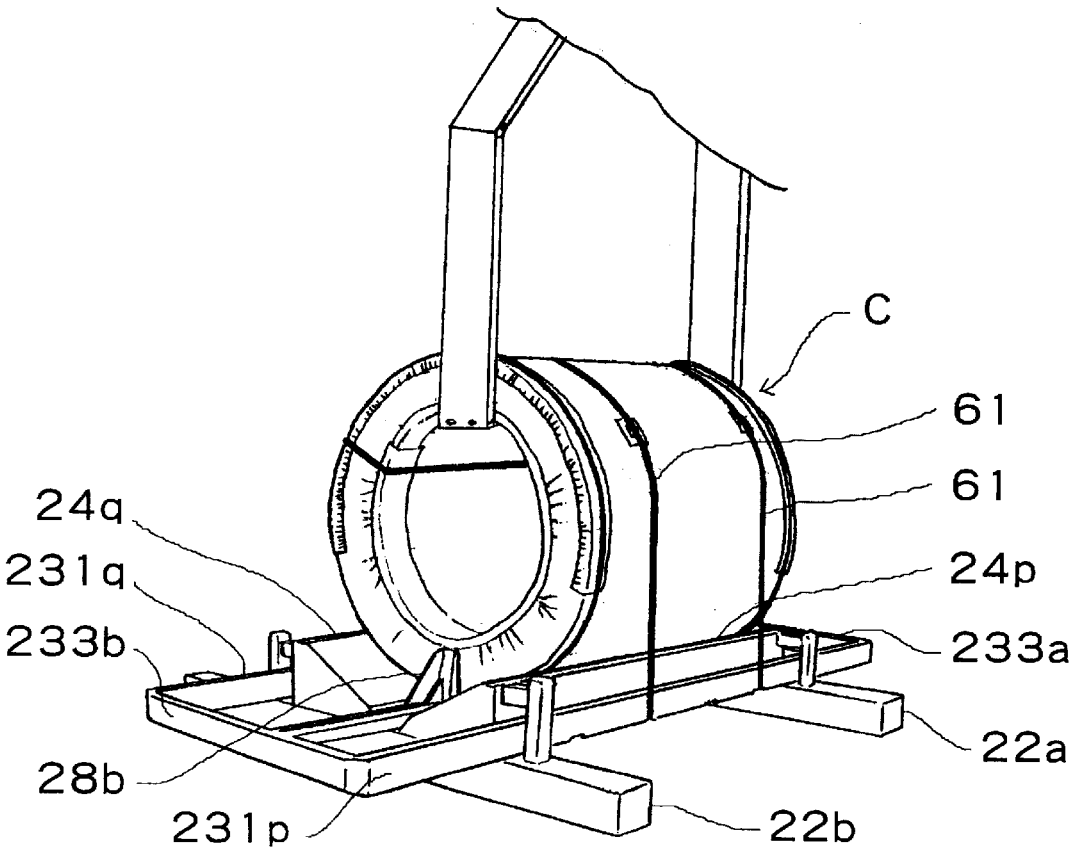
FIG. 54 is a diagram showing a state where the coil is being conveyed by the tongue.

Thus, the lateral shift of the coil C placed and secured to the upper surface of the pallet 2 for a coil-shape heavy article as shown in FIG. 53 with respect to the pallet 2 for a coil-shape heavy article is inhibited by the movement inhibiting members 28*a*, 28*b*. Moreover, the camber members 24*p*, 24*q* for holding the curved surface of the coil C from front and rear positions and the binding band 61 prevent longitudinal shift of the coil C with respect to the pallet 2 for a coil-shape heavy article. Therefore, the coil C can be suspended by a tongue or the like so that the coil C and the pallet 2 for a coil-shape heavy article are collectively moved as shown in FIG. 54.

(3) Heavy-Article Carrying Vehicle

Figure 44:
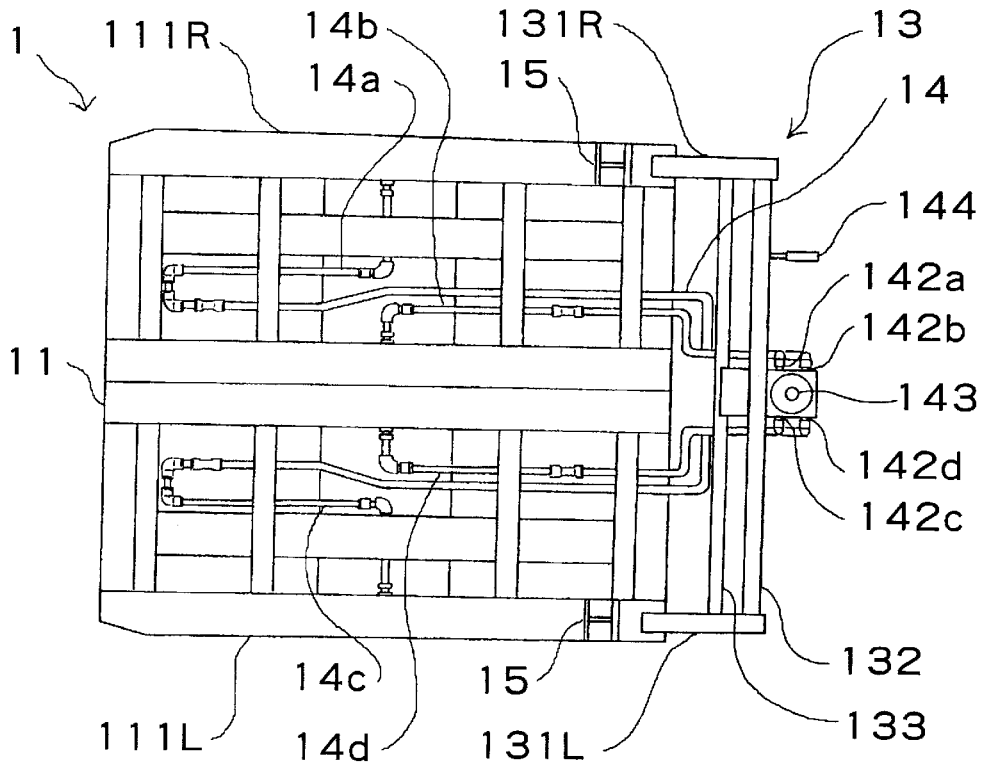
FIG. 44 is a plan view showing another exemplary embodiment of a carrying vehicle in accordance with the present invention.
Figure 45:
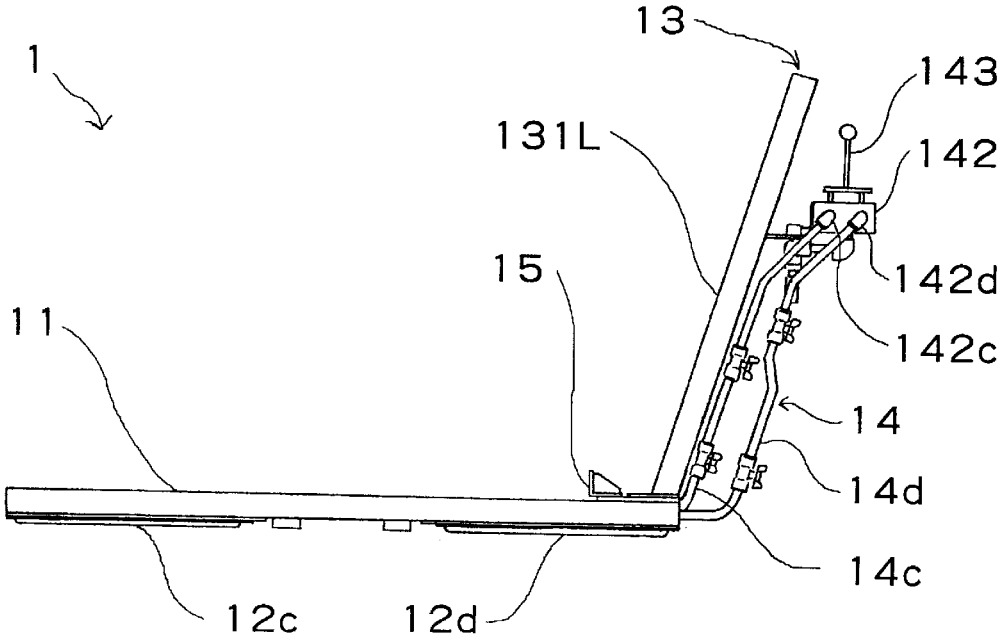
FIG. 45 is a side view of the carrying vehicle shown in FIG. 44.
Figure 46:
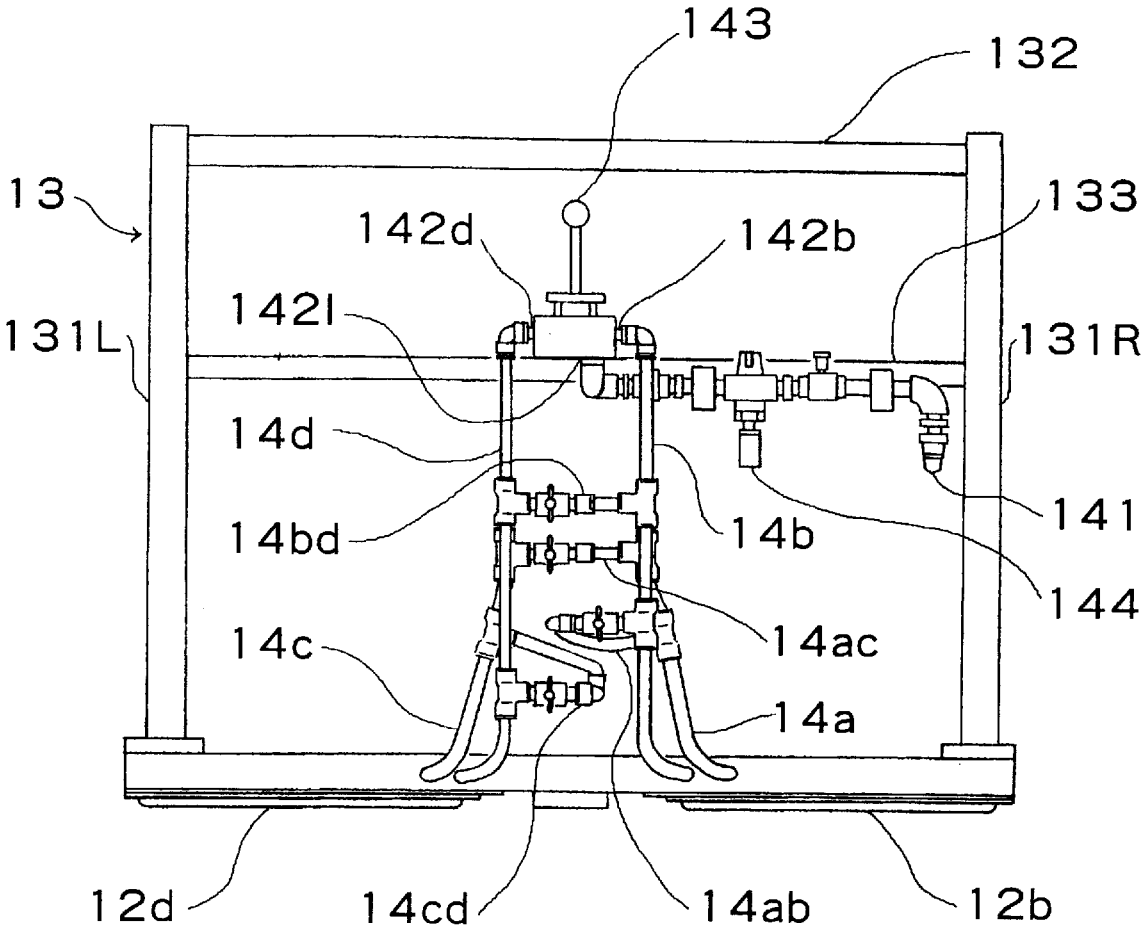
FIG. 46 is a rear view of the carrying vehicle shown in FIG. 44.

A carrying vehicle 1 according to this embodiment shown in FIGS. 44 to 46 is a carrying vehicle for carrying a thin-plate coil C by loading the thin-plate coil C on the pallet. The carrying vehicle 1 according to this embodiment is structured similar to the carrying vehicle according to the first embodiment. Note that the structure of the pipe portion 14 and the like are different from those of the carrying vehicle according to the first embodiment.

That is, the carrying vehicle 1 according to this embodiment incorporates the regulator 142 exposed to the outside and connected to the second beam member 133. Each outlet portion of the regulator 142 is connected to the air bearing.

That is, as shown in FIG. 44, a right front outlet portion of the regulator 142 connected to the right front air bearing 12*a* is called as an outlet portion 142*a*. A right rear outlet portion connected to the right rear air bearing 12*b* is called as an outlet portion 142*b*. A left front outlet portion connected to the left front air bearing 12*c* is called as an outlet portion 142*c*, while a left rear outlet portion connected to the left rear air bearing 12*d* is called as an outlet portion 142*d*.

As shown in FIGS. 44 to 46, a pipe for connecting the right front air bearing 12*a* and the outlet portion 142*a* of the regulator 142 to each other is called as a pipe 14*a*. A pipe for connecting the right rear air bearing 12*b* and the outlet portion 142*b* is called as a pipe 14*b*. Pipes 14*c* and 14*d* are likewise defined.

Figure 41:
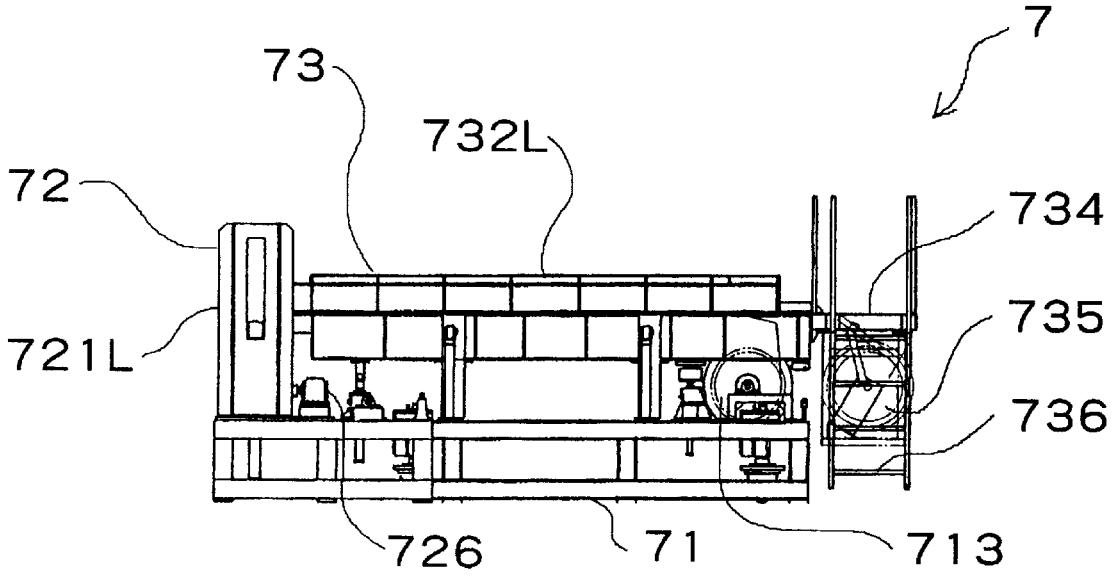
FIG. 41 is a side view showing a stage for introducing/discharging a heavy article in accordance with the present invention.

In the first embodiment, the above-mentioned pipes 14*a*, 14*b*, 14*c* and 14*d* are individual pipes. In the carrying vehicle 1 according to this embodiment, the connections are established between the pipes 14*d* and 14*b*, between the pipes 14*c* and 14*a*, between the pipes 14*c* and 14*d* and between the pipes 14*a* and 14*b* as shown in FIG. 41. Moreover, each of pipes 14*bd*, 14*cd*, 14*cd* and 14*ab* has a valve which is capable of adjusting the flow rate.

Similar to the carrying vehicle 1 according to the first embodiment, the carrying vehicle 1 according to this embodiment incorporates a joy stick 143 with which the attitude of the carrying vehicle 1 can be adjusted.

If the distance of the air bearings provided for the carrying vehicle 1 is shorter than the height of the loaded heavy article, rolling and pitching may occur because balance cannot easily be kept when air has been supplied to levitate the carrying vehicle 1. The above-mentioned problem becomes critical when the attitude control is performed automatically. There is apprehension that "oscillation" occurs in controlling the attitude. The foregoing problem is caused by excessive sensitiveness to the response of the control system.

The pipes 14*ac* and 14*bd* are able to overcome the above-mentioned problem by establishing the connections between the pipes 14*a* and 14*c*, between the pipes 14*b* and 14*d* for the right and left air bearings, between the pipes 14*c* and 14*d*, between pipes 14*a* and 14*b* for the front and rear air bearings, respectively. Thus, air flows among the above-mentioned pipes are permitted to moderate the change in the flow rate. As a result, the response of the control system of the carrying vehicle 1 can be moderated. Accordingly the attitude control can be stabilized, allowing the operator to easily operate the carrying vehicle 1.

By adjusting the valves provided for the pipes 14*ac*, 14*bd*, 14*cd* and 14*ab*, the responsiveness of the attitude control can be controlled.

Figure 47:
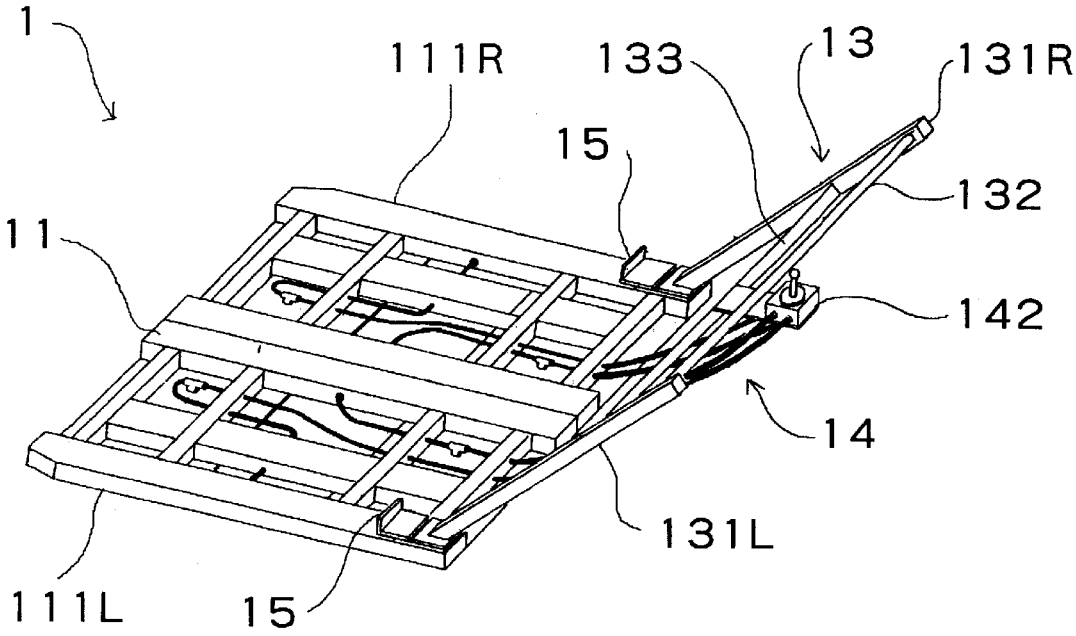
FIG. 47 is a perspective view showing yet another exemplary carrying vehicle in accordance with the present invention.

When the pipes 14*a*, 14*b*, 14*c* and 14*d* are not connected to one another, the flexible hoses may be employed as the pipes as shown in FIG. 47. In case of the foregoing structure, the carrying vehicle 1 can easily be manufactured, and replacement and cleaning of the pipes can easily be performed.

As shown in FIG. 44, the carrying vehicle 1 according to this embodiment is provided with the pair of positioning members 15. Therefore, the pallet 2 can reliably be loaded on a predetermined position on the support frame 11.

In the carrying vehicle 1 according to this embodiment, pipes extend from the inlet portion 142I of the regulator 142 to the right. The manifold 141 is disposed adjacent to the right end of the handle portion 13. Therefore, even if a hose for supplying compressed air to the manifold is connected, the operation cannot be interrupted by the hose.

Moreover, the lever-shape ON/OFF switch 144 is disposed at an intermediate position of the pipe extending to the right from the regulator 142. That is, the ON/OFF switch 144 is disposed at a position apart from the joy stick 143 for controlling the attitude. Therefore, there is no apprehension that the operator unintentionally touches the ON/OFF switch 144 during the operation of the joy stick 143 for controlling the attitude.

(4) Heavy-Article Introducing/Discharging Stage

Figure 42:
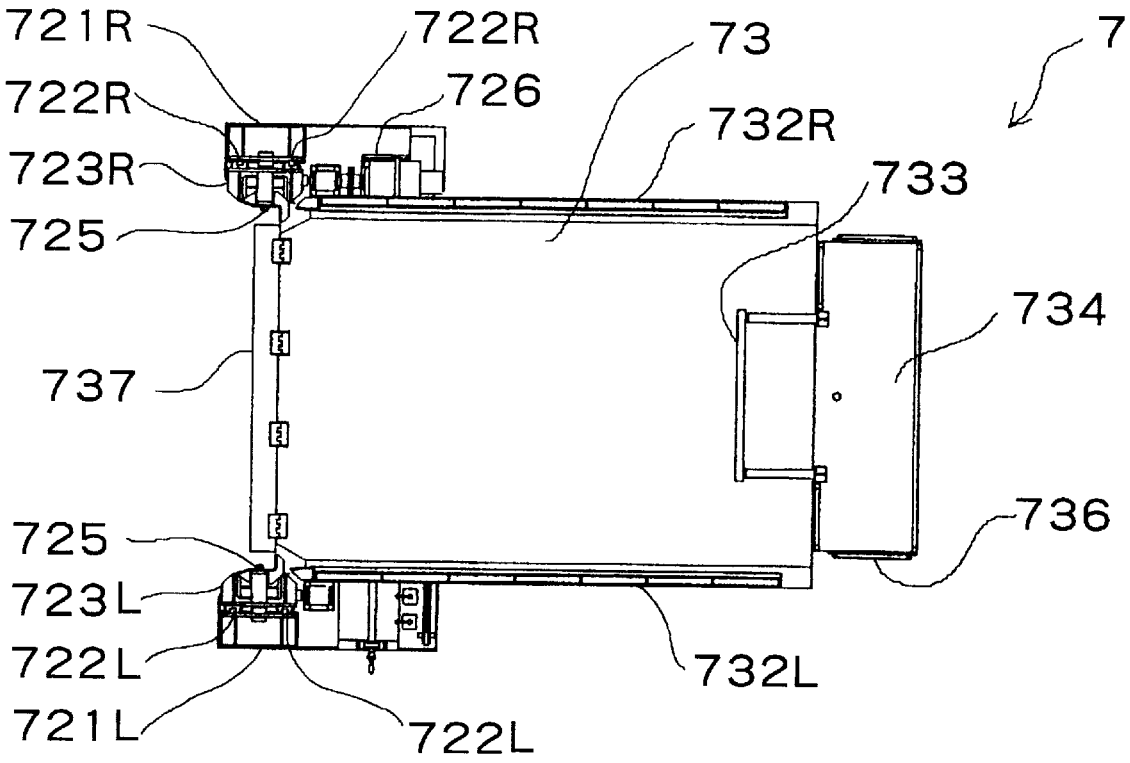
FIG. 42 is a plan view of the stage for introducing/discharging a heavy article shown in FIG. 41.
Figure 43:
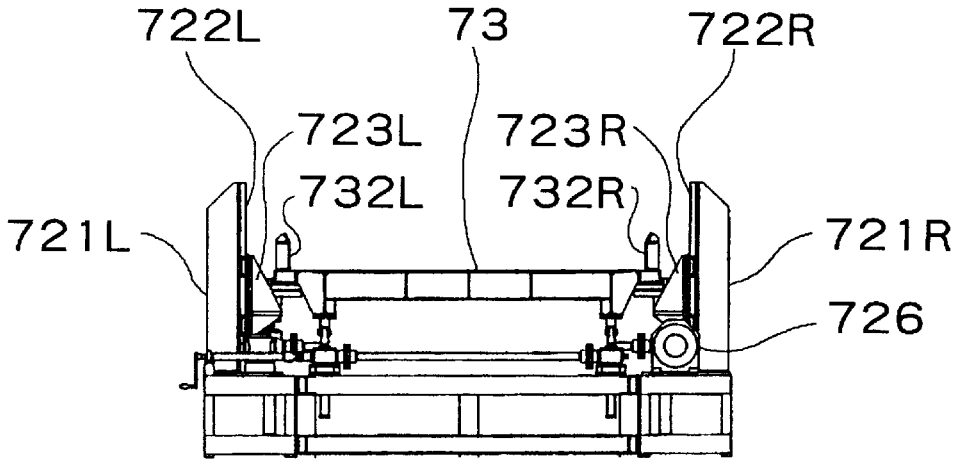
FIG. 43 is a rear view of the stage for introducing/discharging a heavy article shown in FIG. 42 in a state where a deck has been removed.

A heavy-article introducing/discharging stage 7 according to this embodiment and shown in FIGS. 41 to 43 has a similar structure to that of the stage 4 for introducing/discharging a heavy article according to the first embodiment. The difference lies in the structure for supporting the container.

The heavy-article introducing/discharging stage 7 incorporates a stage body 71, support columns 72 provided for the stage body 71 and a table 73. The stage body 71 has a similar structure to that of the stage body 41 of the stage 4 for introducing/discharging a heavy article according to the first embodiment. As shown in FIG. 41, the stage body 71 is provided with a sheet winding reel 713.

The sheet-winding reel 713 is disposed at a relatively rear portion of the upper surface of the stage body 41 such that the lateral direction serves as the axis. The resin sheet 5 is wound around the sheet-winding reel 713. The resin sheet 5 has similar width and length as those of the above-mentioned resin sheet. In a state where the resin sheet 5 has been wound around the sheet-winding reel 713, the sheet-winding reel 713 is unwound upwards to pass through a slit 733 of the table 73 to be described later so as to be discharged to the upper surface of the table 73.

The support column 72 incorporates right and left columns 721R and 721L suspended from the right and left corners of the front portion of the stage body 71. The height of the right and left columns 721R and 721L is 1295 mm which is not higher than the columns according to the first embodiment which is higher than the container placed on the chassis. The right and left columns 721R and 721L are disposed apart from each other for a distance with which the container B loaded on the chassis S can be interposed from right and left portions.

Figure 48:
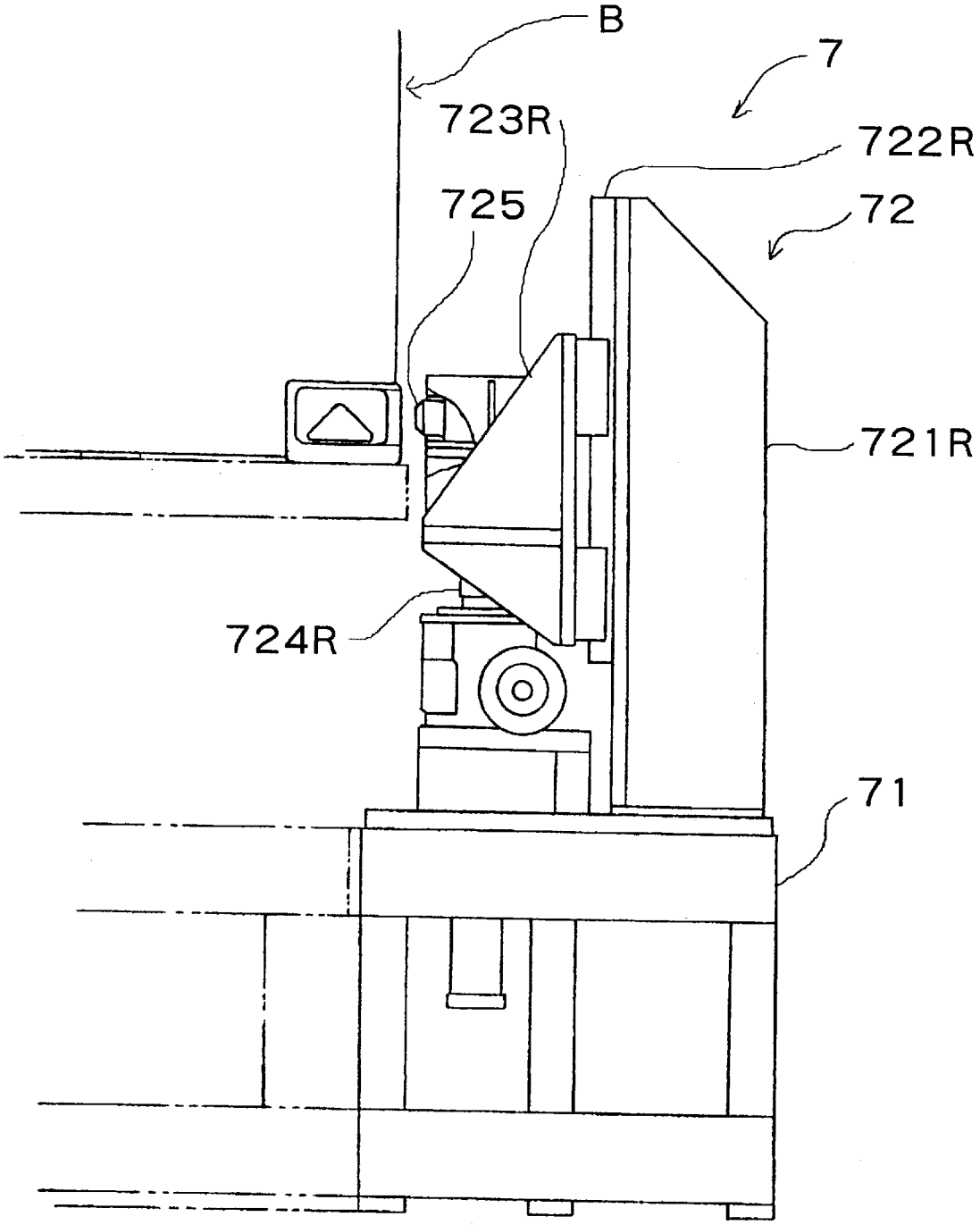
FIG. 48 is a diagram showing a procedure for supporting the container and the chassis by engaging members.
Figure 49:
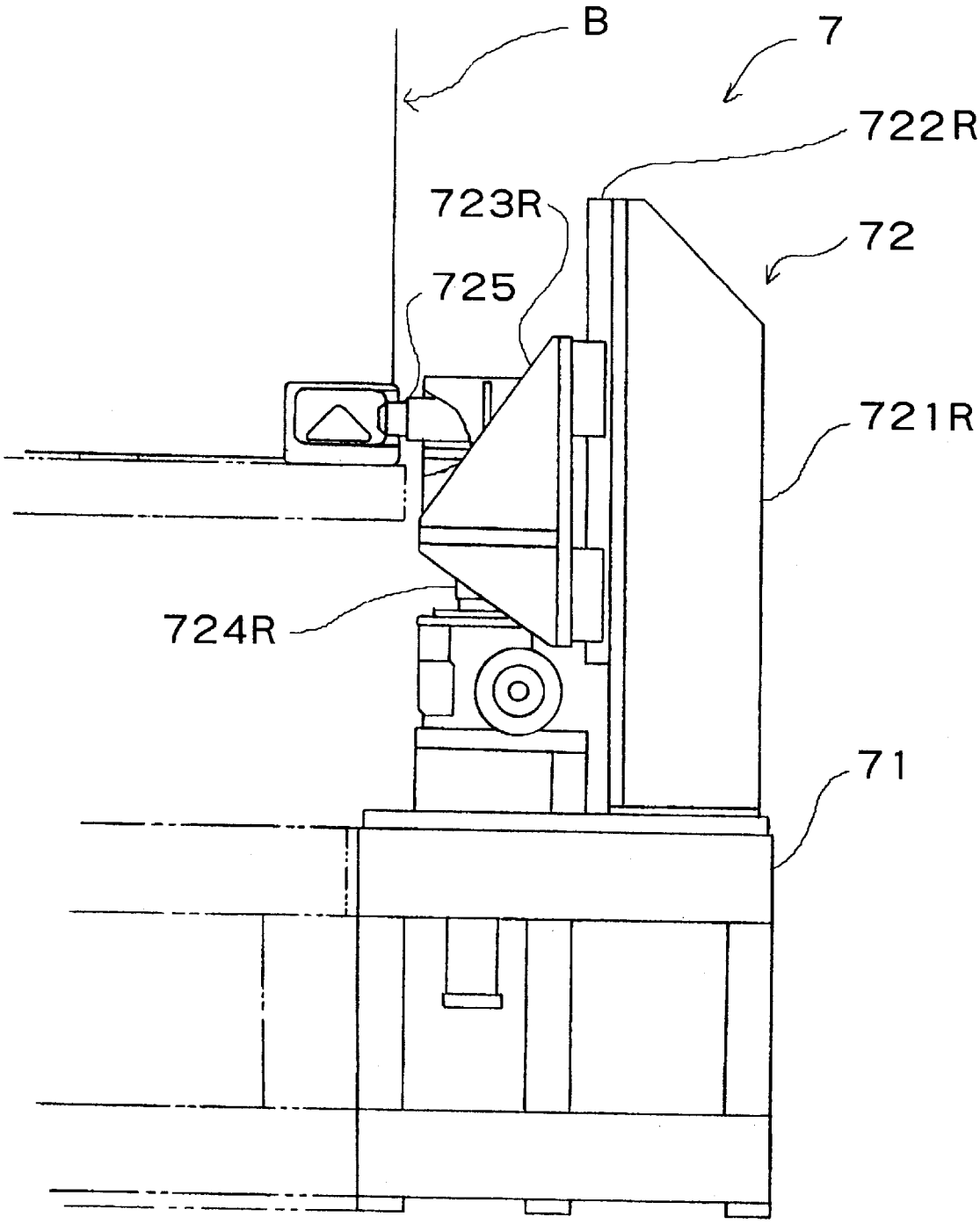
FIG. 49 is a diagram showing a procedure for supporting the container and the chassis by the engaging members.
Figure 50:
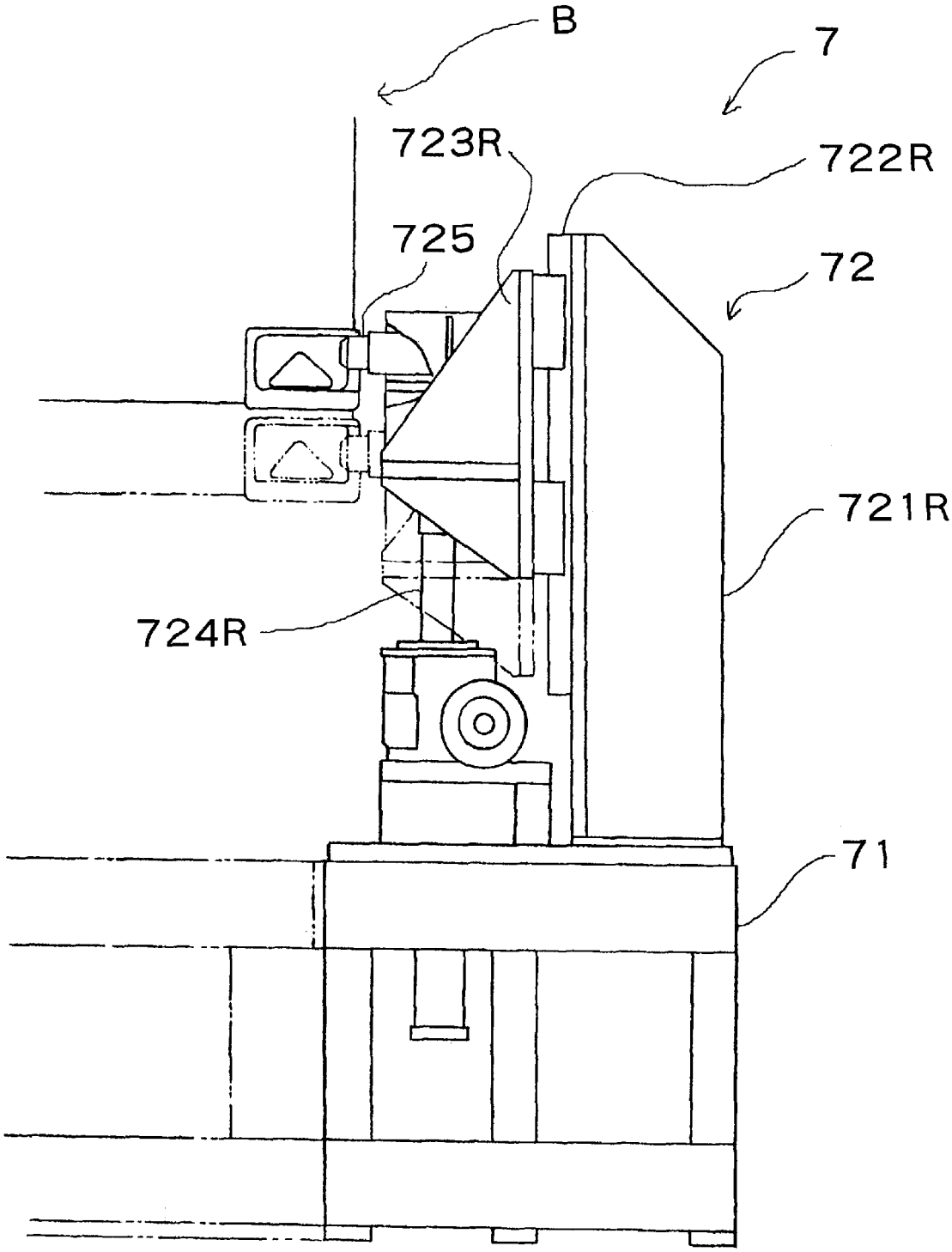
FIG. 50 is a diagram showing a procedure for supporting the container and the chassis by the engaging members.

The right column 721R is provided with a pair of longitudinal guide rails 722R:, 722R. As shown in FIGS. 48 to 50, a slide portion 723R is provided for the upper surfaces of the guide rails 722R to be slidable along the guide rails 722R such that the slide portion 723R is positioned across the guide rails 722R. The slide portion 723R is supported by the screw jack 724R from a lower portion with rollers.

The slide portion 723R is provided with engaging members 725 connected to a cylinder to be introduced/discharged inwards, that is, in a direction toward the opposite left column 721L. The engaging members 725 is formed into a substantially cylindrical shape having a leading end portion, from which corners have been cut away so as to be tapered.

On the other hand, the screw jack 724R for supporting the slide portion 723R from a lower portion with rollers is connected to an air motor 726 disposed to the rear of the screw jack 724R. Thus, the screw jack 724R is operated by the air motor 726. The slide portion 723R is vertically moved along the guide rails 722R, 722R by the screw jack 724R.

The screw jack 724L adjacent to the left column 721L is, through a rod arranged in the lateral direction, also connected to the air motor 726 disposed to the rear of the screw jack 724R. Thus, the screw jack 724L is operated by the air motor 726.

On the other hand, the table 73 disposed on the upper surface of the stage body 71 has a structure similar to that of the table 43 of the stage 4 for introducing/discharging a heavy article according to the first embodiment. However, the table 73 incorporates a slit 733 in the rear portion thereof and a deck 734 to the rear of the slit 733. A flap 737 is formed in the front portion.

Guides 732R, 732L of the table 73 are different from those of the stage 4 for introducing/discharging a heavy article according to the first embodiment. As shown in FIGS. 41 to 43, they do not project forwards over the table 73.

The slit 733 is formed as an elongated rectangular hole which permits penetration of the resin sheet 5 and which has a width of several centimeters. The slit 733 is formed at a position slightly forward of the upper portion of the sheet-winding reel 713. The resin sheet 5 pulled out from the sheet-winding reel 713 is allowed to pass through the slit 733 so as to be pulled out forwards to be spread on the upper surface of the table 73 and the floor surface of the container B.

The deck 734 has an upper surface which is flush with the upper surface of the table 73. The deck 734 is provided with the hose-winding reel 735 in the lower portion thereof and ladders 736 on the left and right surfaces thereof. The deck 734 provides a space where the operator is standby. The operator uses the ladders 736 on the right and left surfaces to go up and down the deck 734.

A hose for supply compressed air to the carrying vehicle 1 is wound around the hose-winding reel 735. An end of the hose is connected to the hose-winding reel 735. The hose-winding reel 735 has an air-hose connector provided individually. Another air hose connected to a source for supplying compressed air is connected to the air-hose connector. The hose wound around the hose-winding reel 735 is pulled out from an upper portion so as to be connected to the heavy-article carrying vehicle 1 for supplying the compressed air is supplied (see FIG. 41).

As shown in FIG. 42, a flap 737 which is allowed to rotate about the front side of the table 73 is provided for the front portion of the table 73. The flap 737 has a width substantially the same as that of the table 73. When the heavy-article introducing/discharging stage 7 has been connected to the container, the flap 737 is disposed from the table 73 to the floor surface at the inlet portion of the container.

The foregoing flap 737 covers the gap between the front end of the table 73 and the container. Thus, the resin sheet 5 is, from a lower position, supported from the table 73 to the floor surface of the container without any gap. As a result, the resin sheet 5 is not required to bear the weight of the heavy article carrying vehicle 1.

(5) Method of Carrying Coil and Method of Introducing/Discharging Coil to and from Container A method of carrying a coil according to this embodiment is substantially the same as that of the method of carrying a coil according to the first embodiment. As shown in FIGS. 51 to 53, the coil C is previously loaded on the pallet 2 by the tongue or the like, followed by fixing the coil C with the band. Then, the carrying vehicle 1 and the heavy-article introducing/discharging stage 7 are used to collectively introduce the coil C and the pallet 2.

(a) Method of Introducing Coil into Container

Initially, the opening doors of the dry container B loaded on the chassis S are opened.

Then, the engaging members 725, 725 are used to engage the corner metal members on the side surfaces of the lower portion adjacent to the opening of the dry container B. That is, as shown in FIG. 48, the slide portions 723R, 723L are vertically moved along the guide rails 722R, 722L by the screw jacks 724R, 724L, respectively. Thus, the vertical and longitudinal positions of the corner metal members in the lower portions adjacent to the opening of the dry container B and the engaging members 725 are made coincident with each other.

Then, the heavy-article introducing/discharging stage 7 is moved so as to interpose the end portions of the opening of the dry container B between the right and left columns 721R and 721L of the support column 72, as shown in FIGS. 57 and 48 to 50. Then, the hydraulic cylinders 711 for wheels are contracted so that the stage body 71 is placed.

At this time, the stage body 71 is placed such that the longitudinal positions of the corner metal members in the lower portion of the opening of the dry container B and the engaging members 725 of the right and left columns 721R and 721L coincide with each other.

The support jacks 731*a* to 731*d* for supporting the table 73 have been extended to maximum. Thus, the table 73 has been positioned upward of the height of the floor surface of the container B by approximately several centimeters. Therefore, when the end portions of the opening portion of the container B are interposed between the right and left columns 721R and 721L, the flap 737 is inserted into the opening of the container B at a height apart from the floor surface of the container B by approximately tens of centimeters.

As shown in FIG. 49, the engaging members 725 are pushed forwards to the corner metal members of the container B so as to be inserted into the holes of the corner metal members.

Then as shown in FIG. 50, the screw jacks 724R and 724L are operated to push the slide portions 723R and 723L upwards along the guide rails 722R, 722L until the springs of the suspension of the chassis S are extended to maximum. Thus, the container B and the chassis S are suspended.

Then, the support jacks 731*a* to 731*d* of the table 73 are contracted to coincide the height of the table 73 with the that of the floor surface of the container B. Since the flap 737 has been inserted into the opening of the container B at the foregoing moment of time, the support jacks 731*a* to 731*d* are contracted to ground the flap 737. Thus, the height of the upper surface of the table 73 can easily be adjusted. Then, the support jacks 731*a* to 731*d* are adjusted to make the upper surface of the table 73 horizontal.

Since the flap 737 is rotatively disposed at the front end of the table 73, the apparatus cannot be broken even if the table 73 is unintentionally lowered downward of the floor surface of the container B.

Then, the resin sheet (note that the leading end of the sheet is allowed to pass through the slit and discharged to the upper surface of the stage) 5 wound around the sheet-winding reel 713 is allowed to pass through the slit 733 to be extended along the container B. Thus, the resin sheet 5 is spread (omitted in FIG. 57) on the floor in the container B. The leading end of the resin sheet 5 reaches the deepest position in the container B.

On the other hand, the carrying vehicle 1 has been placed on the table 73. The hose has been connected to the manifold 141 of the carrying vehicle 1 so that compressed air is supplied to the carrying vehicle 1. At this time, the carrying vehicle 1 has not been levitated.

As shown in FIGS. 54 to 57, the thin-plate coil C secured to the upper surface of the pallet 2 is, together with the pallet 2 and by the tongue or the like, placed on the support frame 11 of the carrying vehicle 1 placed on the table 73. The pallet 2 loaded with the thin-plate coil C is placed such that the leg portions 22*a*, 22*b* are positioned across the support frame 11 in order to cause the support frame 11 of the carrying vehicle 1 to be positioned in the space downward of the camber members 24*p*, 24*q* of the pallet 2.

Figure 55:
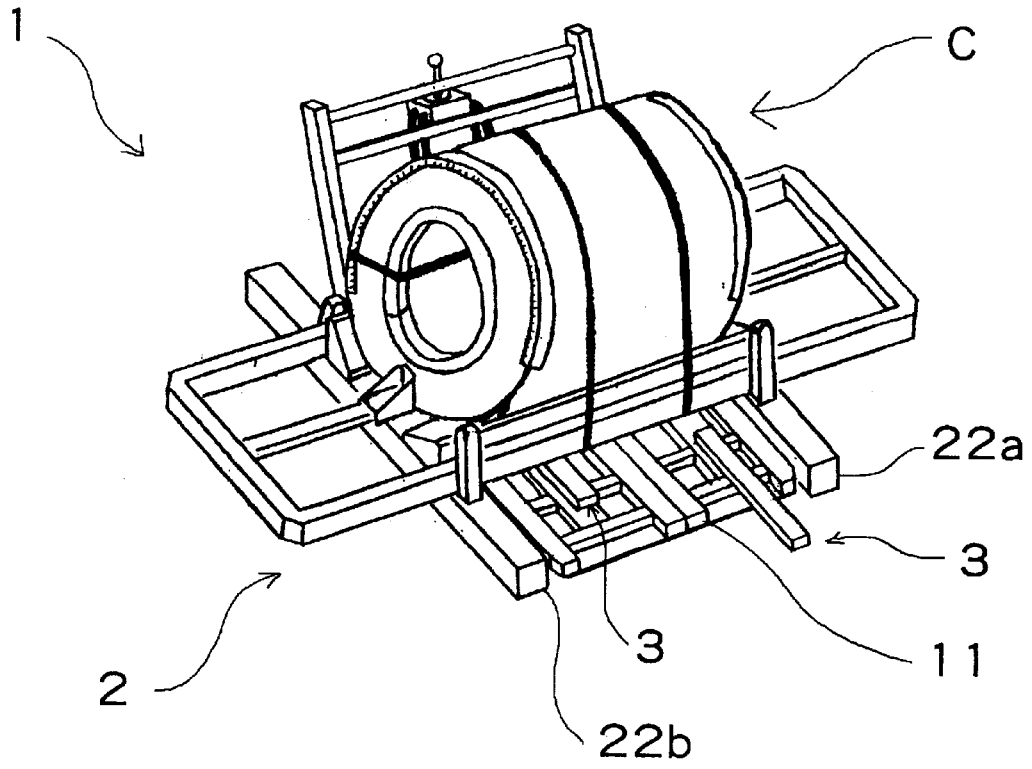
FIG. 55 is a diagram showing a process for loading the pallet on the carrying vehicle and the engaging members are inserted.
Figure 56:
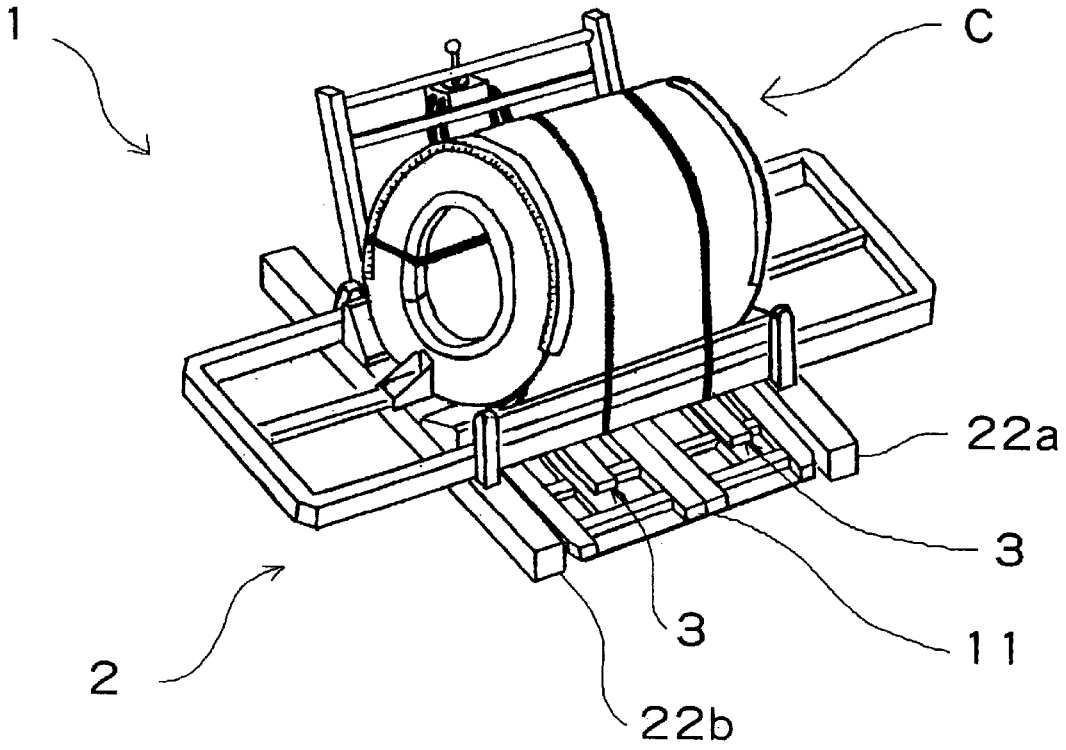
FIG. 56 is a diagram showing a state where the pallet has been loaded on the carrying vehicle.

As shown in FIGS. 55 and 56, four engaging members 3 as rod members are disposed longitudinally at positions between the pallet 2 and the upper surface of the support frame 11. Similar to the first embodiment, a gap is formed between the upper surfaces of the engaging members 3 and the lower surface of the pallet 2. Therefore, the weights of the pallet 2 and the coil C are not exerted to the support frame 11. The foregoing weights are borne by the leg portions 22*a* and 22*b*.

Then as shown in FIG. 57 likewise the first embodiment, the coil C is introduced into the container B by the carrying vehicle 1.

Figure 39:
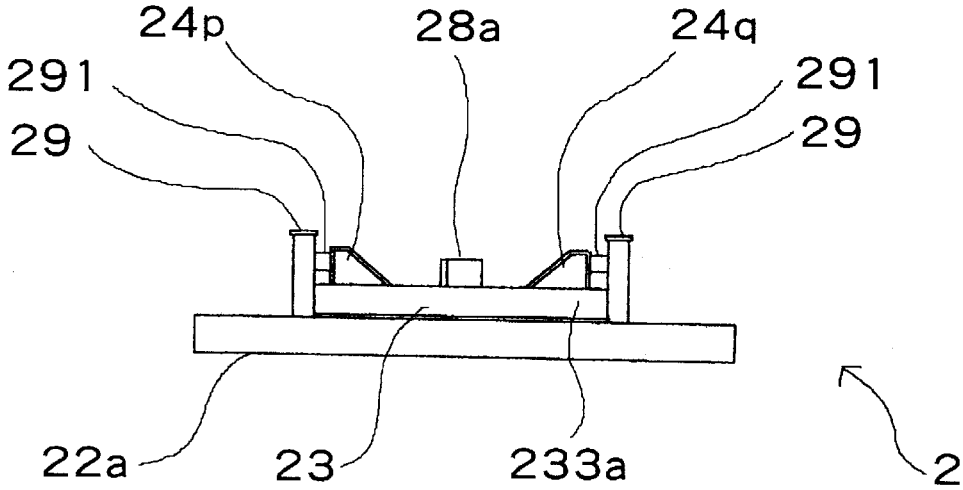
FIG. 39 is a front view of the pallet shown in FIG. 36.
Figure 40:
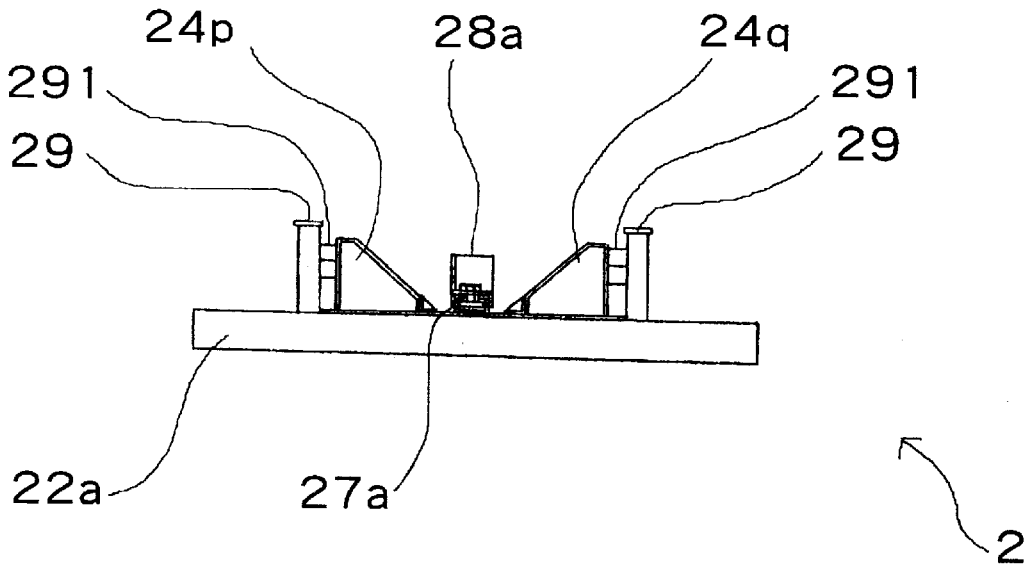
FIG. 40 is a side view showing the pallet shown in FIG. 39 in a state where side end guides have been removed.

The carrying vehicle shown in FIG. 42 is employed in the case shown in FIGS. 55 to 57. When the carrying vehicle shown in FIGS. 39 to 41 is employed, the valves provided for the pipes 14*ac*, 14*bd*, 14*cd* and 14*ad* are operated to adjust the responsiveness of the attitude control of the carrying vehicle. Thus, the thin-plate coil C can be introduced into the container B.

Finally, the resin sheet 5 is removed from the inside portion of the container B, followed by winding the resin sheet 5 around the sheet-winding reel 713. Then, the screw jacks 724R, 724L of the support column 72 are contracted to cause the suspension of the chassis S to bear the weights of the container B and the chassis S. Thus, the engaging members 725, 725 are introduced so that the engagement of the engaging members 725 is released. Then, the heavy-article introducing/discharging stage 7 is separated from the chassis S and the container B such that the carrying vehicle 1 loaded on the table 73 is maintained. Then, the opening doors of the container B are closed.

As described above, the thin-plate coil C is introduced into the dry container on the chassis.

(b) Method of Discharging Coil from Container

The method of discharging the coil from the container is substantially the same as that according to the first embodiment.

(6) Effect of this Embodiment

The method of carrying a coil according to this embodiment enables similar effects to those derived from the first embodiment to be obtained. Moreover, the following effects can be obtained.

That is, the corner metal members disposed at the two corners in the lower portion of the opening of the container are used to position the chassis and the container. Therefore, the elements, such as the screw jacks 724R, 724L and the engaging members 725, can be disposed downward of the apparatus. As a result, the overall size of the apparatus can be reduced. Therefore when the container is used to transport the apparatus, the apparatus can easily be accommodated in the container.

The heavy-article introducing/discharging stage 7 according to this embodiment is provided with the flap 737. Therefore, even if a stepped portion is formed between the table 73 and the floor surface of the container B, the gap can moderately be covered. Since the resin sheet 5 is spread on the foregoing elements, undesirable contact of the bottom surface of the carrying vehicle with the table 73 and the floor surface of the container B or disorder of the attitude can be prevented when using the carrying vehicle which is levitated by discharged gas.

The levitation-type carrying vehicle for use in this embodiment has the right, left, front and rear exhaust nozzles connected to one another. Therefore, the rightward, leftward, forward and rearward attitude control of the loaded heavy article can be performed in a reliable and stable state.

It is understood that the present disclosure of the preferred form can be changed in the details of construction and in the combination and arrangement of parts without departing from the spirit and the scope of the invention.

(1) Pallet

The pallet for a coil-shape heavy article is not limited to the shapes described in the embodiments. A variety of arbitrary shapes and sizes may be employed. That is, the coil support portion of the holding portion is not limited to the inclined surface. The coil support portion may be provided with curved surfaces running parallel to the curved surface of a coil to be loaded. The pallet body is not limited to the shape of parallel crosses. For example, a flat shape or a box shape may be employed.

Also the lower opening space is not limited to the structure having two opened side portions. It may have only one open side portion. When the fixing band is employed in the foregoing case, a groove or a hole is formed in the side surface which serves as the wall surface to allow the band to pass through for securing the coil.

Also the size of the pallet is not limited to the shape according to the foregoing embodiments and obtained by quadrisecting the depth of the container. For example, the size may be any one of sizes obtained by dividing the depth by two, three or five evenly. When pallets having different sizes are employed, a great number of coils having small widths can be loaded into the container. When coils having large widths are loaded, the coils can be loaded such that extension over the pallet is prevented. Therefore, an adequate pallet may be employed to be adaptable to the size of the coil. As a result, the coils can be loaded in the container without waste.

Moreover, pallets having different sizes may be combined so as to be accommodated in the container. For example, pallets having sizes of 1/6, 2/6 (1/3), and 3/6 (1/2) of the depth of the container may be combined such that the pallets loaded with the coils can be accommodated without forming an unnecessary gap in the container. In addition, pallets having 1/5, 2/5, may be combined with each other.

The pallet according to the embodiments is not limited to the 20-feet dry container. The application is permitted to 40-feet dry container or the like which has the different size. Also application to an open-top container is permitted.

The weight of the coil to be loaded on the pallet according to this embodiment may be, for example, 100 kg or greater. The weight may be in the range from 100 kg to 100 metric tons. It is preferable that the weight is in the range from about 100 kg to about 50 metric tons. In general, the weight is in the range from about 1 ton to about 20 metric tons.

The length of the coil to be loaded on the pallet according to the embodiments may be longer than the length of the coil support portion. That is, extension of one or two lateral ends of the coil over the coil support portion is permitted. This is because the pallet achieves the object as far as the coil is secured by the portions of the coil support portion. The diameter and weight of the coil may arbitrarily be changed so long as securing can satisfactorily be performed.

Figure 11:
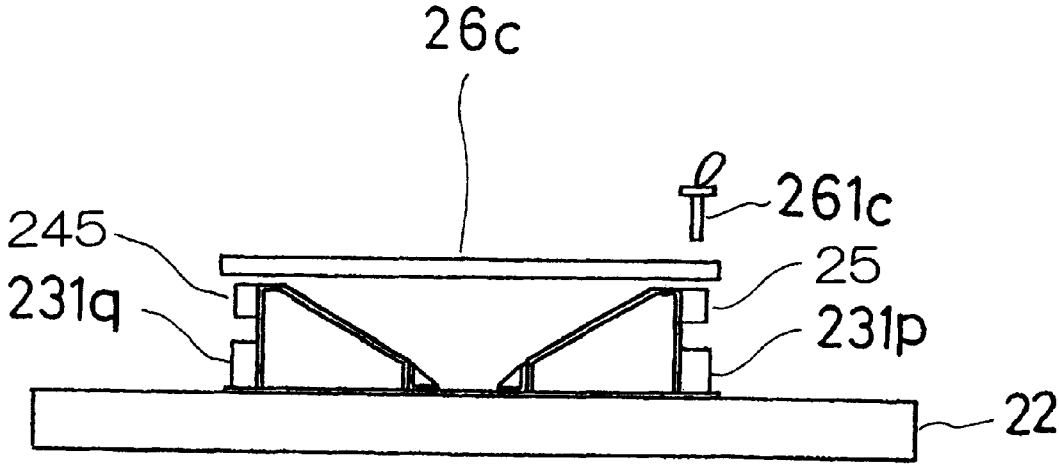
FIG. 11 is a front view of an exemplary pallet of the present invention including a movement-inhibiting member.

Also, the shape of the movement-inhibiting member according to the first embodiment may be formed arbitrarily except U-like shape. Moreover, an arbitrary structure may be employed. For example, as shown in FIG. 11, a movement-inhibiting member may be formed by securing the angular rod 26*c* to a movement-inhibiting-member guide 25 with a pin 261*c*. Another structure using bolts to secure the movement-inhibiting member may be employed. Also the movement-inhibiting member according to the second embodiment may have various shapes, sizes and heights.

When the securing band in the insertion hole, a band extracting tool 244 structured as shown in FIGS. 6 and 7 may be employed to easily extract the securing band. The band extracting tool 244 has a flat shape so as to be inserted and secured to the securing hole 243 formed in the band insertion hole 241. Thus, the end portion of the band insertion passage can be formed into the inclined shape. Therefore, insertion of the securing band 62 into an unnecessary portion in the band insertion hole can be prevented.

The shape of the band insertion hole may arbitrarily be selected to be adaptable to the employed band. The shape of the opening is exemplified by a rectangular shape, a square shape, a circular shape and an elliptical shape. The band insertion hole may be provided with the band extracting tool arranged to easily extract the band from the band insertion hole and disposed in the band insertion hole or the band insertion passage. If the band extracting tool has the inclined shape to easily extract the band, the shape and size are not limited. For example, the region from the bottom surface of the insertion passage to the end of the insertion hole may be connected to each other with a rod member or a plate member to form a guide.

Either of the band insertion holes may be a hole elongated in the lateral direction of the pallet. The foregoing band insertion hole may be formed to facilitate extraction of the band. If the band is caught by a peripheral portion of the band insertion hole because of inconsistency of the distance between the right and left band insertion hole and the axial length of the coil, the load added to the foregoing peripheral portion may cause deformation. When the above-mentioned band insertion hole as the elongated hole is employed, the above-mentioned deformation can be prevented.

If the movement-inhibiting member is able to satisfactorily prevent a shift of the coil, the pallet according to the present invention is not required to secure the coil with the securing band. At this time, as shown in FIG. 9, the band insertion passage and the band insertion hole can be omitted from the pallet.

Figure 9:
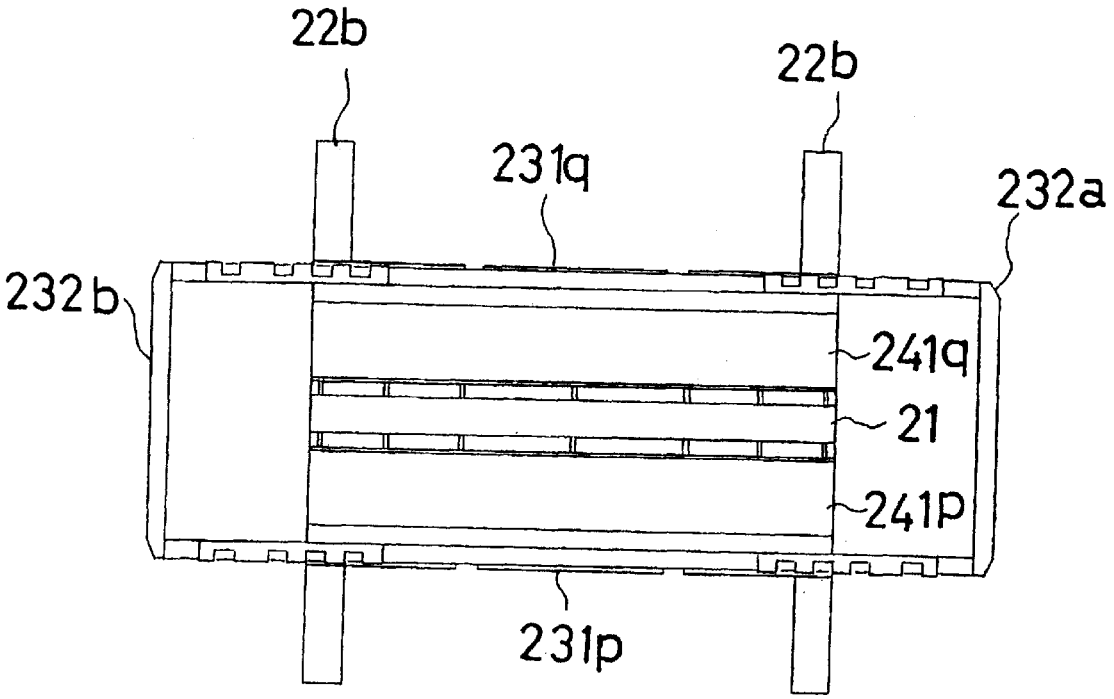
FIG. 9 is a schematic view showing another pallet for a coil-shape heavy article in accordance with the present invention.
Figure 10:
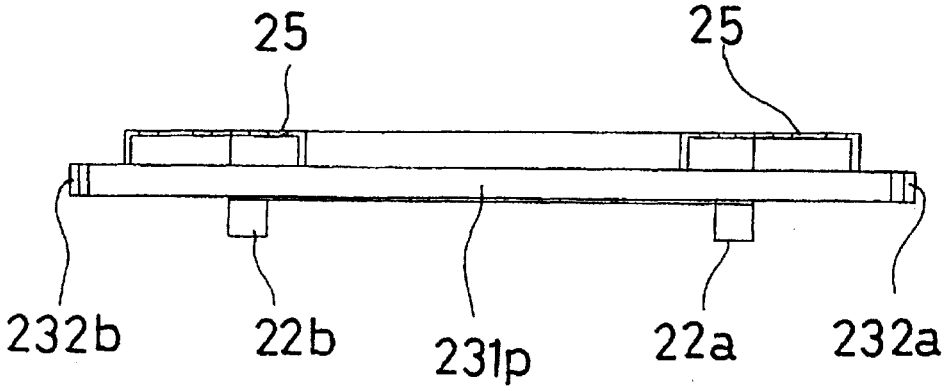
FIG. 10 is a side view of the pallet for a coil-shape heavy article shown in FIG. 9.

If the sub-leg portions 232*a*, 232*b* according to the first embodiment are able to satisfactorily bear the overall weight, they may be omitted as shown in FIGS. 9 and 10. When the corners of the arm portions are tapered as shown in FIG. 9, undesirable catch by the wall surface of the container that occurs when performing introduction/discharge to and from the container can be prevented.

The stack-support portion according to the second embodiment may be applied to the pallet according to the first embodiment. The cut portion 231*k* provided for the bottom plate 21 may be provided for the bottom plate according to the first embodiment. The sub-arms 231*p*, 231*q* according to the first embodiment may be tapered to prevent damage of the facilities similar to the pallet according to the second embodiment.

Figure 8:
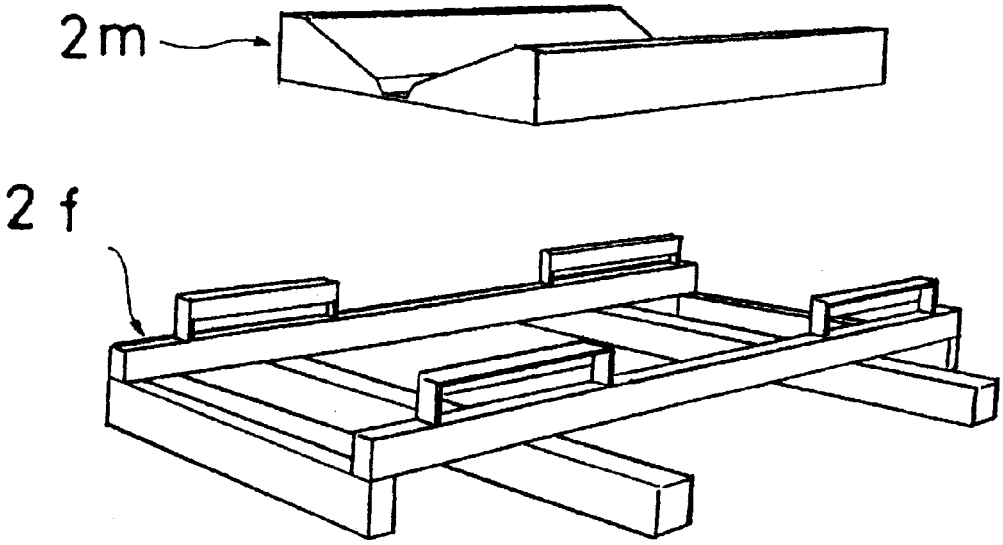
FIG. 8 is a schematic view showing another pallet for a coil-shape heavy article having a holding portion and leg portions that are separable.

As shown in FIG. 8, the pallet for a coil-shape heavy article according to the present invention can be sectioned into a holding portion 2*m* and a leg portion 2*f*. The foregoing separable pallet enables the leg portion to be omitted when a holding portion incorporating an adequate coil support portion adaptable to the size of the container S is provided, the holding portion having a common shape and a common size may be employed. The separable holding portion and the leg portion may be secured by an arbitrary method, for example, screw fixing.

The pallet according to the present invention may be carried by a usual carrying apparatus, such as a crane or a large forklift as well as the carrying apparatus. When the foregoing usual carrying apparatus is employed, support of the pallet according to the present invention by inserting a claw or the like into the lower opened space enables safe transportation to be performed with no contact with the coil on the pallet.

The leading end of the leg portion may be provided with a movement inhibition plate having a width larger than the width of the leg portion to reliably support an adjacent article to prevent a shift of the pallet. When the movement inhibition plate having a large width is provided for the leg portion, a shift of the pallet can be prevented in the range of the gap for transportation such that the leg portions of the pallet according to the present invention are in a staggered configuration by means of each movement inhibition member provided for each leg portion.

The cut portion 231*k* provided for each of the bottom plate 21 and according to the second embodiment may be provided for the bottom plate according to the first embodiment. The corner portions of the sub-arms 231*p*, 231*q* according to the first embodiment may be tapered to prevent damage of the facilities similar to the pallet according to the second embodiment.

For example, a non-coil-shape heavy article, that is, a cylindrical heavy article or a tubular heavy article made of a single material, one rod-shape heavy article or an aggregate heavy article obtained by binding rod members may be handled. The shape of the holding portion of the pallet to carry the above-mentioned heavy article is not limited particularly as far as the heavy article to be employed can be loaded.

(2) Structure for Joining Pallet

A structure for joining the pallet for a coil-shape heavy article according to the first or second aspect may be employed.

Figure 35:
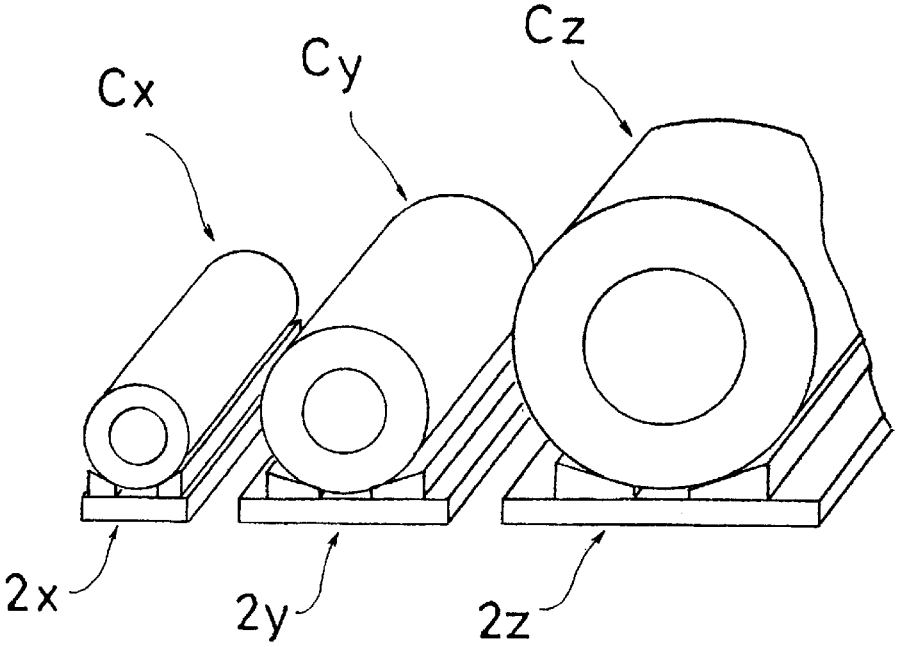
FIG. 35 is a schematic view showing pallets for coil-shape heavy articles having different sizes.

There is provided a structure for joining a pallet for a coil-shape heavy article to a transporting receptacle incorporating a pallet for a coil-shape heavy article according to the first or second pallet for a coil-shape heavy article, a transporting receptacle for accommodating the pallet for a coil-shape heavy article and a coil-shape heavy article to be loaded on the pallet for a coil-shape heavy article, in which one or more pallet for a coil-shape heavy article among the pallet for a coil-shape heavy articles has the coil-shape heavy article loaded thereon, and the pallet for a coil-shape heavy article is disposed in the transporting receptacle such that coincidence with the planar size of the inside portion of the transporting receptacle is established (see FIGS. 25, 32 and 35).

(3) Structure of Pallet in Container

A variety of structures of the pallet introduced into the container by the employed carrying vehicle on the stage according to the present invention to fix the position of the heavy article in the container to be transported will now be described.

A plurality of the following various pallets can be combined with one another so as to be closely placed on the floor surface of the container. Therefore, when heavy articles are transported using the foregoing pallets, the positions of the pallets are fixed in the container. Therefore, tight lashing is not required in the container.

Each of the following pallets has a space opened with respect to the floor surface. Therefore, when the levitation-type carrying vehicle is inserted into the space and the height of levitation of the inserted carrying vehicle from the floor surface is changed, the operations for loading the pallet on the carrying vehicle, carrying the pallet by the carrying vehicle and unloading the pallet can efficiently be performed. Therefore, when the following pallets, the above-mentioned levitation-type carrying vehicle and the stage according to the present invention are combined with each other, heavy articles can efficiently be introduced into the container on the chassis. Moreover, the heavy articles can efficiently be discharged from the inside portion of the container.

(i) First Aspect

A pallet for a coil-shape heavy article according to a first aspect is arranged to be accommodated in a transporting receptacle in a state where a coil-shape heavy article has been placed on the pallet, the pallet for a coil-shape heavy article is characterized by a pallet body, a holding portion disposed on the pallet body and structured to be in contact with side surfaces of the cylindrical coil-shape heavy article to support the coil-shape heavy article, and a lower opening formed below the pallet body and opened in at least a lower portion thereof or one of side portions thereof, in which a coil securing member for securing the coil-shape heavy article to the pallet body is disposed on the pallet for the coil-shape heavy article, and when the number of the pallet for the coil-shape heavy article is one, the size of the one pallet for the coil-shape heavy article is substantially the same as the planar size of the transporting receptacle and when the number of the pallet for the coil-shape heavy article is two or more, the size of the combined pallets for the coil-shape heavy article is substantially the same as the planar size of the transporting receptacle (see FIGS. 1 to 11).

(ii) Second Aspect

A pallet for a coil-shape heavy article according to a second aspect has a structure of the pallet for a coil-shape heavy article according to the first aspect, in which the holding portion is detachable from the body of the pallet for a coil-shape heavy article (see FIG. 8).

(iii) Third Aspect

A pallet for a coil-shape heavy article according to a third aspect has a structure of the pallet for a coil-shape heavy article according to the first aspect, in which the coil securing member is a binding and securing band or movement-inhibiting members disposed on both ends of the coil.

For example, the movement-inhibiting members may be elongated members (the members 26*a*, 26*b* shown in FIG. 1 each having U-shape facing side or rod members) detachably joined to a movement-inhibiting-member guide. As shown in FIGS. 36 and 37, the movement-inhibiting members may be erect members 28*a* and 28*b* slidably joined to the slide rails. In the slidable movement-inhibiting members, slide rails are disposed between a pair of holding portions in a direction substantially perpendicular to the direction in which the pair of the holding portions are opposite to each other and at a position lower than the lower ends of the inclined surface. The slide rails extend from a position at which the slide rails are interposed between the holding portions to reach a position over the end of the pair of the holding portions. A pair of the movement inhibiting members is slidably stood erect, the movement inhibiting members each having a height higher than the lower end of the inclined surface.

(iv) Fourth Aspect

A pallet for a coil-shape heavy article according to a fourth aspect has a structure that the pallet body is provided with at least four column stack-support portions formed into a quadrangle configuration, and when the coil-shape heavy article is not held (not loaded), stacking of other pallets for the coil-shape heavy article above and below the pallet body is permitted (see FIGS. 36 to 38). The number of the stack-support portions is usually four. The number may be increased. Although the configuration of the four stack-support portions is usually a rectangle or a square, the configuration is not limited to the foregoing configurations. To vertically stack the pallets, all of the pallets have the stack-support portions formed at the corresponding positions. The upper and lower surfaces of the stack-support portions are required to be formed such that slippage can be prevented. For example, the surfaces may be any one of the following structures: (1) both of the surfaces are formed into planar shapes; (2) one of the surfaces has a projecting shape (a convex shape) while another surface has a recessed shape (a concave shape)(see FIG. 36); or (3) the upper surface has engaging projections, while the lower surface has corresponding engaging recesses. The stack-support portion may be applied to the pallet according to the first embodiment.

(v) Fifth Aspect

A pallet for a coil-shape heavy article according to a fifth aspect has a structure that the holding portion has inclined surfaces and a pair of the inclined surfaces are formed opposite to each other. Slide rails are disposed between a pair of holding portions in a direction in which the pair of the holding portions are opposite to each other and at a position lower than the lower ends of the inclined surface. The slide rails extend from a position at which the slide rails are interposed between the holding portions to reach a position over the end of the pair of the holding portions. A pair of the movement inhibiting members is slidably stood erect, the movement inhibiting members each having a height higher than the lower end of the inclined surface.

(4) Carrying Vehicle

A variety of structures of the carrying vehicle for use on the stage according to the present invention will now be described.

Since each of the following various heavy-article carrying vehicles use gas discharge to raise a heavy article, the weight of the heavy article can be borne by a wide floor area. Therefore, concentration of loads to a point of contact between each wheel and the floor when using wheels can be prevented. As a result, the possibility of breakage of the floor by the weight can be lowered.

The heavy-article carrying vehicle uses discharge of gas to levitate the support frame to exert the force immediately below the center of gravity so as to raise the heavy article. Therefore, the position of the center of gravity is not considerably shifted between an unloaded state and a state where a heavy article has been placed. Therefore, excellent stability can be realized.

If the heavy article is raised at a position deviated from the center of gravity as is performed by the conventional carrying vehicle, the deadweight must be increased in order to keep a balance to raise a heavy article. Moreover, a counter balance has to be provided for a portion opposite to the cargo when employing a forklift. The heavy-article carrying vehicle according to the present invention does not require the additional weights. Therefore, the possibility of damaging the floor for bearing the weight can be lowered. Moreover, the size of the apparatus can be reduced and a heavy article can easily be carried into a small space.

Since gas is used to levitate and bear the weight, no friction resistance is produced when the horizontal movement is performed. Therefore, the heavy article can easily be moved. Even if a heavy article weighing about 10 metric tons is placed, the heavy article can be conveyed by man power.

Since gas is used to levitate the cargo to bear the weight of the cargo, the cargo can be conveyed in a stable state by adjusting the flow rate and direction of the gas in spite of variation in the positions of the center of gravity of the held heavy articles.

In general, it is difficult for the levitation-type carrying vehicle to climb over a stepped portion of the floor surface. However, the stage according to the present invention does not form a stepped portion between the upper surface of the stage and the floor surface of the container even if a heavy article is loaded on the container. Therefore, when the following levitation-type carrying vehicle is placed on the stage according to the present invention such that a heavy article is loaded on the stage and the carrying vehicle is used to introduce the heavy article into the container, the heavy article can efficiently be introduced. Also discharge of the heavy article from the container can similarly efficiently be performed.

(i) First Aspect

A heavy-article carrying vehicle according to a first aspect incorporates a support frame for lifting a pallet, and exhaust nozzles provided for the lower surface of the support frame to discharge gas flows to the floor surface at a predetermined pressure so as to be capable of levitating the support frame in a state where the pallet loaded with a heavy article has been placed on the support frame (see FIGS. 12 to 16).

(ii) Second Aspect

A heavy-article carrying vehicle according to a second aspect is a heavy-article carrying vehicle according to the first aspect, incorporating a plurality of exhaust nozzles, valves provided for the plural exhaust nozzles to adjust an amount of gas flow rate from each exhaust nozzle and a control stick which is capable of simultaneously controlling degrees of opening of the plural valves, in which operation of the control stick enables the attitude control of the support frame to be performed (see FIGS. 12 to 16 and 19 to 21).

(iii) Third Aspect

A heavy-article carrying vehicle according to a third aspect is a heavy-article carrying vehicle according to the first or second heavy-article carrying vehicle, wherein the plural exhaust nozzles are grouped into four, and the four groups are disposed in a quadrangle configuration (see FIGS. 12 to 16).

In the third aspect, the number of the exhaust nozzles is four or more, or each exhaust nozzle may be provided for each group so that the number becomes four.

When the nozzles divided into four groups are disposed at the right, left, front and rear positions of the support frame, control of amounts of gas discharge from the right and left nozzle group enables the roll angle (the lateral angle with respect to a longitudinal axis) of the support frame to be controlled. When amounts of gas discharge from the front and rear nozzles are adjusted, the pitch angle (an angle of longitudinal inclination with respect to the lateral axis) of the support frame can be controlled. If the nozzles are not positioned at the right, left, front and rear positions of the support frame, control of the amounts of gas discharge from the nozzles performed synchronously enables the attitude to be controlled.

The control unit for controlling the gas discharge may be a track ball or the like in place of the control stick.

(5) Stage for Introducing/Discharging Heavy article to and from Container and Method of Introducing/Discharging Heavy Article to and from Container The support column of the stage according to this aspect is not limited to the gate shape. For example, two columns may be employed from which the corner metal members at the two corners of the upper surface of the container are suspended. The support jacks for supporting the table may be allowed to extend/contract independently. Thus, the roll angle and pitch angle of the table can arbitrarily be adjusted.

The height of the table 43 with respect to the container may be adjusted by using the leading end of the table 43 in place of the guides 432R and 432L. In this case, the leading end of the table 43 and the container are brought into contact with each other. Therefore, the table 43 and the container can be connected to each other without forming gap between the body of the table 43 and the floor surface of the container.

To introduce a heavy article into the container placed on the chassis, the rear portion (adjacent to the opening) of the container may be set to be higher than that of the front portion (inner portion as compared with the opening door) of the container to incline the floor surface of the container. In the foregoing case, when a heavy article is introduced into the inside portion by the levitation-type heavy-article carrying vehicle, only small force can be used to start moving the heavy-article carrying vehicle into the inside portion because of the inclination. Therefore, the heavy article can easily be introduced. It is preferable that the upper surface of the stage is inclined in the same manner as above.

It is preferable that the angle of inclination is 0.2° or less (including 0, which can be applied to the following case). If the angle is larger than 0.2°, the acceleration of the heavy-article carrying vehicle is increased excessively to easily stop the heavy-article carrying vehicle manually. Although the amount of gas discharge of the heavy-article carrying vehicle may be reduced from a position further forward of the predetermined stop position in the container so as to stop the heavy-article carrying vehicle, the heavy-article carrying vehicle cannot easily be stopped at an accurate position. Although the leg portions of the pallet are brought into contact with each other to stop the heavy-article carrying vehicle, there is apprehension that the pallet is broken.

Note that the angle of inclination may be increased in accordance with the heavy article and the carrying vehicle as far as safety can be secured. The angle may be, for example, 1° or less, preferably 0.4° or less.

To discharge a heavy article from the container placed on the chassis, the rear portion (adjacent to the opening) of the container may be set to be lower than the front portion (inner portion as compared with the opening door) of the container to incline the floor surface of the container. In the foregoing case, when a heavy article is discharged by the levitation-type heavy-article carrying vehicle, only small force is required to start moving the heavy-article carrying vehicle toward the opening of the container because of the inclination. Therefore, the heavy article can easily be discharged.

The carrying vehicle may be structured as shown in FIG. 8. The control unit for controlling gas discharge may be a track ball or the like in place of the control stick. The heavy-article introducing method according to the present invention may employ a carrying vehicle provided with wheels.

The resin sheet may be provided for each container. In the foregoing case, the resin sheet does not have to be discharged from the position downward of the pallet after introducing the pallet. Therefore, the width of the resin sheet can be corresponded to the full width in the container. Therefore, compressed air of the carrying vehicle can be received further effectively.

The heavy article to be loaded on the pallet is not limited to the thin-plate coil. A variety of heavy-articles may be loaded. For example, thick-plate coils, sheets and shape steel may be loaded. The heavy article may weigh, for example, 100 kg or greater. The weight may be in the range from about 100 kg to about 100 metric tons. It is preferable that the weight is in the range from about 100 kg to about 50 metric tons. In general, the weight is in the range from about 1 ton to about 20 metric tons.

In the first and the second embodiments, the method of introducing/discharging a predetermined heavy article into a container uses the predetermined heavy-article carrying vehicle and the predetermined heavy-article introducing/discharging stage. The carrying method according to the present invention is not limited to the foregoing arrangement. That is, the foregoing carrying vehicle may be employed to carry (move) the heavy article to a predetermined position without the heavy-article introducing/discharging stage. Another heavy-article introducing/discharging stage except for that according to the embodiments and/or pallets may be employed to move or carry the heavy article.

What is claimed is:

1. A method of introducing a heavy article using a stage for introducing a heavy article to and from a transporting receptacle to introduce a coil-shape heavy article into a transporting receptacle placed on a chassis, said method comprising:

conveying, by a heavy-article carrying vehicle, a pallet incorporating a holding frame on which the coil-shape heavy article is held and leg portions for supporting the holding frame at a predetermined height and forming a space between said holding frame and a surface of a floor to introduce the coil-shape heavy article placed on said pallet and secured to said pallet into said transporting receptacle;

said stage for introducing a heavy-article comprising:

a support column disposed adjacent to an opening door of said transporting receptacle placed on said chassis and secured to said chassis and structured to fix the height of said chassis and the height of said transporting receptacle by fixing the positions of corner metal members adjacent to the opening door of said transporting receptacle; and a table disposed to be adjacent to the opening of said transporting receptacle when said support column has been disposed adjacent to the opening door of said transporting receptacle so as to introduce said heavy-article carrying vehicle for introducing said heavy article into said transporting receptacle in a standby condition, wherein said table has a support portion for individually bearing the weight of said pallet on which a coil-shape heavy article has been placed, and said support portion is able to coincide the height of the upper surface of said table with the height of the floor surface of said transporting receptacle;

said pallet comprising:

a pallet body, and a lower opening formed downward of said pallet body and opened in at least a lower portion thereof or one of side portions thereof, wherein a coil securing member for securing the coil-shape heavy article to said pallet body is disposed on said pallet for the coil-shape heavy article, and said holding frame being disposed on said pallet body and structured to be in contact with side surfaces of the coil-shape heavy article to support the coil-shape heavy article;

said heavy-article carrying vehicle comprising:

a support frame for lifting a pallet; and a plurality of exhaust nozzles provided for the lower surface of said support frame to discharge gas flows to the floor surface at a predetermined pressure so as to be capable of levitating said support frame in a state where the pallet loaded with a heavy article has been placed on said support frame, wherein said plural exhaust nozzles, valves for the exhaust nozzles for adjusting amounts of exhaust gas from said exhaust nozzles and a control stick which is capable of simultaneously controlling degrees of opening of the plural valves are provided so that control of the attitude of said support frame is permitted when said control stick is operated; and said conveying to introduce the coil-shape heavy article into said transporting receptacle including the following sequentially performed steps:

(1) said heavy-article carrying vehicle is placed on said table, after an engaging member has been placed on said support frame of said heavy-article carrying vehicle, said pallet on which the heavy article is held and secured is placed on said heavy-article carrying vehicle such that said support frame of said heavy-article carrying vehicle is positioned in a space downward of said holding frame of said pallet and said leg portions of said pallet are positioned across said support frame of said heavy-article carrying vehicle, and then said heavy-article carrying vehicle is levitated so as to raise the heavy article through said engaging member and said pallet;

(2) the heavy article is introduced into said transporting receptacle by said heavy-article carrying vehicle;

(3) initially, amounts of gas discharge from said exhaust nozzles of said heavy-article carrying vehicle are reduced or set to be zero to temporarily lower said support frame to bring said leg portions of said pallet into contact with the ground to enlarge the gap between the lower surface of said holding frame of said pallet and the upper surface of said support frame of said heavy-article carrying vehicle so as to unload the heavy article from said heavy-article carrying vehicle, and then said engaging member disposed between said support frame of said heavy-article carrying vehicle and the lower surface of said holding frame is removed, followed by moving said heavy-article carrying vehicle rearwardly so as to discharge said support frame from the space below said holding frame of said pallet; and (4) said heavy-article carrying vehicle is returned to the upper surface of said table.

2. A method of introducing a heavy article using a stage for introducing a heavy article to and from a transporting receptacle to introduce a coil-shape heavy article into a transporting receptacle placed on a chassis, said method comprising:

conveying, by a heavy-article carrying vehicle, a pallet incorporating a holding frame on which the coil-shape heavy article is held and leg portions for supporting the holding frame at a predetermined height and forming a space between said holding frame and a surface of a floor to introduce the coil-shape heavy article placed on said pallet and secured to said pallet into said transporting receptacle;

said stage for introducing a heavy-article comprising:

a support column disposed adjacent to an opening door of said transporting receptacle placed on said chassis and secured to said chassis and structured to fix the height of said chassis and the height of said transporting receptacle by fixing the positions of corner metal members adjacent to the opening door of said transporting receptacle; and a table disposed to be adjacent to the opening of said transporting receptacle when said support column has been disposed adjacent to the opening door of said transporting receptacle so as to introduce said heavy-article carrying vehicle for introducing said heavy article into said transporting receptacle in a standby condition, wherein said table has a support portion for individually bearing the weight of said pallet on which a coil-shape heavy article has been placed, and said support portion is able to coincide the height of the upper surface of said table with the height of the floor surface of said transporting receptacle;

said pallet comprising:

a pallet body, and a lower opening formed downward of said pallet body and opened in at least a lower portion thereof or one of side portions thereof, wherein a coil securing member for securing the coil-shape heavy article to said pallet body is disposed on said pallet for the coil-shape heavy article, and said holding frame being disposed on said pallet body and structured to be in contact with side surfaces of the coil-shape heavy article to support the coil-shape heavy article;

said heavy-article carrying vehicle comprising:

a support frame for lifting a pallet; and a plurality of exhaust nozzles provided for the lower surface of said support frame to discharge gas flows to the floor surface at a predetermined pressure so as to be capable of levitating said support frame in a state where the pallet loaded with a heavy article has been placed on said support frame, wherein said plural exhaust nozzles, valves for the exhaust nozzles for adjusting amounts of exhaust gas from said exhaust nozzles and a control stick which is capable of simultaneously controlling degrees of opening of the plural valves are provided so that control of the attitude of said support frame is permitted when said control stick is operated; and said conveying to introduce the coil-shape heavy article into said transporting receptacle including the following sequentially performed steps:

(1) said heavy-article carrying vehicle is placed on said table of said stage, said pallet on which the heavy article is placed and secured is positioned on said heavy-article carrying vehicle such that said support frame of said heavy-article carrying vehicle is positioned in a space downward of said holding frame of said pallet and said leg portions of said pallet are positioned across said support frame of said heavy-article carrying vehicle, then an engaging member is placed on said support frame of said heavy-article carrying vehicle, and then said heavy-article carrying vehicle is levitated so as to raise the heavy article through said pallet;

(2) the heavy article is introduced into said transporting receptacle by said heavy-article carrying vehicle;

(3) initially, amounts of gas discharge from said exhaust nozzles of said heavy-article carrying vehicle are reduced or made to be zero to temporarily lower said support frame to bring said leg portions of said pallet into contact with the ground to enlarge the gap between the lower surface of said holding frame of said pallet and the upper surface of said support frame of said heavy-article carrying vehicle so as to unload the heavy article from said heavy-article carrying vehicle, and then said engaging member disposed between said support frame of said heavy-article carrying vehicle and the lower surface of said holding frame is removed, followed by rearwardly moving said heavy-article carrying vehicle so as to discharge said support frame from the space below said holding frame of said pallet; and (4) said heavy-article carrying vehicle is returned to the upper surface of said table.

3. A method of introducing a heavy article using a stage for introducing a heavy article to and from a transporting receptacle to introduce a coil-shape heavy article into a transporting receptacle placed on a chassis, said method comprising:

conveying, by a heavy-article carrying vehicle, a pallet incorporating a holding frame on which the coil-shape heavy article is held and leg portions for supporting the holding frame at a predetermined height and forming a space between said holding frame and a surface of a floor to introduce the coil-shape heavy article placed on said pallet and secured to said pallet into said transporting receptacle;

said stage for introducing a heavy-article comprising:

a support column disposed adjacent to an opening door of said transporting receptacle placed on said chassis and secured to said chassis and structured to fix the height of said chassis and the height of said transporting receptacle by fixing the positions of corner metal members adjacent to the opening door of said transporting receptacle; and a table disposed to be adjacent to the opening of said transporting receptacle when said support column has been disposed adjacent to the opening door of said transporting receptacle so as to introduce said heavy-article carrying vehicle for introducing said heavy article into said transporting receptacle in a standby condition, wherein said table has a support portion for individually bearing the weight of said pallet on which a coil-shape heavy article has been placed, and said support portion is able to coincide the height of the upper surface of said table with the height of the floor surface of said transporting receptacle;

said pallet comprising:

a pallet body, and a lower opening formed downward of said pallet body and opened in at least a lower portion thereof or one of side portions thereof, wherein a coil securing member for securing the coil-shape heavy article to said pallet body is disposed on said pallet for the coil-shape heavy article, and said holding frame being disposed on said pallet body and structured to be in contact with side surfaces of the coil-shape heavy article to support the coil-shape heavy article;

said heavy-article carrying vehicle comprising:

a support frame for lifting a pallet; and a plurality of exhaust nozzles provided for the lower surface of said support frame to discharge gas flows to the floor surface at a predetermined pressure so as to be capable of levitating said support frame in a state where the pallet loaded with a heavy article has been placed on said support frame, wherein said plural exhaust nozzles, valves for the exhaust nozzles for adjusting amounts of exhaust gas from said exhaust nozzles and a control stick which is capable of simultaneously controlling degrees of opening of the plural valves are provided so that control of the attitude of said support frame is permitted when said control stick is operated; and said conveying to introduce the coil-shape heavy article into said transporting receptacle including the following sequentially performed steps:

(1) said heavy-article carrying vehicle is placed on said table, said pallet on which the heavy article is placed and secured is positioned on said heavy-article carrying vehicle such that said support frame of said heavy-article carrying vehicle is positioned in a space downward of said holding frame of said pallet and said leg portions of said pallet are positioned across said support frame of said heavy-article carrying vehicle, and then said heavy-article carrying vehicle is levitated so as to raise the heavy article through said pallet;

(2) the heavy article is introduced into said transporting receptacle by said heavy-article carrying vehicle;

(3) initially, amounts of gas discharge from said exhaust nozzles of said heavy-article carrying vehicle are reduced or made to be zero to temporarily lower said support frame to bring said leg portions of said pallet into contact with the ground to enlarge the gap between the lower surface of said holding frame of said pallet and the upper surface of said support frame of said heavy-article carrying vehicle so as to unload the heavy article from said heavy-article carrying vehicle, followed by rearwardly moving said heavy-article carrying vehicle so as to discharge said support frame from the space downward of said holding frame of said pallet; and (4) said heavy-article carrying vehicle is returned to the upper surface of said table.

4. The method of introducing a heavy article according to any one of claims 1 to 3, wherein said holding portion includes inclined surfaces, a pair of said inclined surfaces are formed opposite to each other, and said coil securing member is a band for binding and securing the coil.

5. The method of introducing a heavy article according to any one of claims 1 to 3, wherein said pallet body is provided with at least four column stack-support portions formed into a quadrangle configuration, and when said coil-shape heavy article is not held, stacking of other pallets for the coil-shape heavy article above and below said pallet body is permitted.

6. The method of introducing a heavy article according to any one of claims 1 to 3, wherein the number of said exhaust nozzles is four, said four exhaust nozzles are disposed in a quadrangle configuration, and wherein the nozzle disposed at the right front in a direction of transportation is a right-front nozzle, the nozzle disposed at the right rear is a right-rear nozzle, the nozzle disposed at the left front is a left-front nozzle and the nozzle disposed left rear is a left-rear nozzle, said nozzles forming each of four pairs composed of a pair formed by said right-front nozzle and said right-rear nozzle, a pair formed by said left-front nozzle and said left-rear nozzle, a pair formed by said right-front nozzle and said left-front nozzle and a pair formed by said right-rear nozzle and said left-rear nozzle are connected to each other through a connecting pipe.

7. The method of introducing a heavy article according to any one of claims 1 to 3, wherein said transporting receptacle is a container.

8. The method of introducing a heavy article according to claim 1, wherein when the number of said pallet for the coil-shape heavy article for transporting in said transporting receptacle is one, the size of the one pallet for the coil-shape heavy article is substantially the same as the planar size of said transporting receptacle and when the number of said pallet for the coil-shape heavy article is two or more, the size of the combined pallets for the coil-shape heavy article is substantially the same as the planar size of said transporting receptacle.

9. The method of introducing a heavy article according to claim 1, wherein said holding portion includes inclined surfaces, a pair of said inclined surfaces are formed opposite to each other, and said coil securing member includes movement inhibiting members disposed on the two sides of the coil.

10. The method of introducing a heavy article according to claim 2, wherein when the number of said pallet for the coil-shape heavy article for transporting in said transporting receptacle is one, the size of the one pallet for the coil-shape heavy article is substantially the same as the planar size of said transporting receptacle and when the number of said pallet for the coil-shape heavy article is two or more, the size of the combined pallets for the coil-shape heavy article is substantially the same as the planar size of said transporting receptacle.

11. The method of introducing a heavy article according to claim 2, wherein said holding portion includes inclined surfaces, a pair of said inclined surfaces are formed opposite to each other, and said coil securing member includes movement inhibiting members disposed on the two sides of the coil.

12. The method of introducing a heavy article according to claim 3, wherein when the number of said pallet for the coil-shape heavy article for transporting in said transporting receptacle is one, the size of the one pallet for the coil-shape heavy article is substantially the same as the planar size of said transporting receptacle and when the number of said pallet for the coil-shape heavy article is two or more, the size of the combined pallets for the coil-shape heavy article is substantially the same as the planar size of said transporting receptacle.

13. The method of introducing a heavy article according to claim 3, wherein said holding portion includes inclined surfaces, a pair of said inclined surfaces are formed opposite to each other, and said coil securing member includes movement inhibiting members disposed on the two sides of the coil.

14. A method of discharging a heavy article using a stage for introducing/discharging a heavy article to and from a transporting to discharge a coil-shape heavy article from a transporting receptacle placed on a chassis, said method comprising:

carrying, by a heavy-article carrying vehicle, a pallet incorporating a holding frame on which the coil-shape heavy article is held and leg portions for supporting the holding frame at a predetermined height and forming a space between said holding frame and a surface of a floor to discharge the heavy article placed on said pallet and secured to said pallet from said transporting receptacle;

said stage for introducing/discharging a heavy-article comprising:

a support column disposed adjacent to an opening door of said transporting receptacle placed on said chassis and secured to said chassis and structured to fix the height of said chassis and the height of said transporting receptacle by fixing the positions of corner metal members adjacent to the opening door of said transporting receptacle; and a table disposed to be adjacent to the opening of said transporting receptacle when said support column has been disposed adjacent to the opening door of said transporting receptacle so as to introduce said heavy-article carrying vehicle for introducing said heavy article into said transporting receptacle in a standby condition, wherein said table has a support portion for individually bearing the weight of said pallet on which a coil-shape heavy article has been placed, and said support portion is able to coincide the height of the upper surface of said table with the height of the floor surface of said transporting receptacle;

said pallet comprising:

a pallet body, and a lower opening formed downward of said pallet body and opened in at least a lower portion thereof or one of side portions thereof, wherein a coil securing member for securing the coil-shape heavy article to said pallet body is disposed on said pallet for the coil-shape heavy article, and said holding frame being disposed on said pallet body and structured to be in contact with side surfaces of the coil-shape heavy article to support the coil-shape heavy article;

said heavy-article carrying vehicle comprising:

a support frame for lifting a pallet; and a plurality of exhaust nozzles provided for the lower surface of said support frame to discharge gas flows to the floor surface at a predetermined pressure so as to be capable of levitating said support frame in a state where the pallet loaded with a heavy article has been placed on said support frame, wherein said plural exhaust nozzles, valves for the exhaust nozzles for adjusting amounts of exhaust gas from said exhaust nozzles and a control stick which is capable of simultaneously controlling degrees of opening of the plural valves are provided so that control of the attitude of said support frame is permitted when said control stick is operated; and said carrying to discharge the heavy-article from the transporting receptacle comprising the following sequentially performed steps:

(1) said heavy-article carrying vehicle in said standby condition on said table is introduced into said transporting receptacle;

(2) said support frame of said heavy-article carrying vehicle is inserted into a space downward of said holding frame of said pallet, and then amounts of gas discharge from said exhaust nozzles of said heavy-article carrying vehicle are reduced or made to be zero to temporarily lower said support frame to enlarge the gap between the lower surface of said holding frame and the upper surface of said support frame, then an engaging member is disposed between the lower surface of said holding frame of said pallet and the upper surface of said support frame, and then the amount of gas discharge from the exhaust nozzles of said heavy-article carrying vehicle is enlarged to raise said support frame so as to raise the heavy article through said engaging member and said pallet;

(3) said heavy-article carrying vehicle is returned onto said table so as to discharge the heavy article from the inside portion of said transporting receptacle; and (4) the heavy article is unloaded from said heavy-article carrying vehicle.

15. A method of discharging a heavy article using a stage for introducing/discharging a heavy article to and from a transporting receptacle to discharge a coil-shape heavy article from a transporting receptacle placed on a chassis, said method comprising:

carrying, by a heavy-article carrying vehicle, a pallet incorporating a holding frame on which the coil-shape heavy article is held and leg portions for supporting the holding frame at a predetermined height and forming a space between said holding frame and a surface of a floor to discharge the heavy article placed on said pallet and secured to said pallet from said transporting receptacle;

said stage for introducing/discharging a heavy-article comprising:

a support column disposed adjacent to an opening door of said transporting receptacle placed on said chassis and secured to said chassis and structured to fix the height of said chassis and the height of said transporting receptacle by fixing the positions of corner metal members adjacent to the opening door of said transporting receptacle; and a table disposed to be adjacent to the opening of said transporting receptacle when said support column has been disposed adjacent to the opening door of said transporting receptacle so as to introduce said heavy-article carrying vehicle for introducing said heavy article into said transporting receptacle in a standby condition, wherein said table has a support portion for individually bearing the weight of said pallet on which a coil-shape heavy article has been placed, and said support portion is able to coincide the height of the upper surface of said table with the height of the floor surface of said transporting receptacle;

said pallet comprising:

a pallet body, and a lower opening formed downward of said pallet body and opened in at least a lower portion thereof or one of side portions thereof, wherein a coil securing member for securing the coil-shape heavy article to said pallet body is disposed on said pallet for the coil-shape heavy article, and said holding frame being disposed on said pallet body and structured to be in contact with side surfaces of the coil-shape heavy article to support the coil-shape heavy article;

said heavy-article carrying vehicle comprising:

a support frame for lifting a pallet; and a plurality of exhaust nozzles provided for the lower surface of said support frame to discharge gas flows to the floor surface at a predetermined pressure so as to be capable of levitating said support frame in a state where the pallet loaded with a heavy article has been placed on said support frame, wherein said plural exhaust nozzles, valves for the exhaust nozzles for adjusting amounts of exhaust gas from said exhaust nozzles and a control stick which is capable of simultaneously controlling degrees of opening of the plural valves are provided so that control of the attitude of said support frame is permitted when said control stick is operated; and said carrying to discharge the heavy-article from the transporting receptacle comprising the following sequentially performed steps:

(1) said heavy-article carrying vehicle in said standby condition on said table is introduced into said transporting receptacle;

(2) said support frame of said heavy-article carrying vehicle is inserted into a space downward of said holding frame of said pallet, and then amounts of gas discharge from said exhaust nozzles of said heavy-article carrying vehicle are reduced or made to be zero to temporarily lower said support-frame to enlarge the gap between the lower surface of said holding frame and the upper surface of said support frame, and then the amount of gas discharge from the exhaust nozzles of said heavy-article carrying vehicle is enlarged to raise said support frame so as to raise the heavy article through said pallet;

(3) said heavy-article carrying vehicle is returned onto said table so as to discharge the heavy article from the inside portion of said transporting receptacle; and (4) the heavy article is unloaded from said heavy-article carrying vehicle.

16. The method of discharging a heavy article according to claim 14 or 15, wherein said holding portion includes inclined surfaces, a pair of said inclined surfaces are formed opposite to each other, and said coil securing member is a band for binding and securing the coil.

17. The method of discharging a heavy article according to claim 14 or 15, wherein said pallet body is provided with at least four column stack-support portions formed into a quadrangle configuration, and when said coil-shape heavy article is not held, stacking of other pallets for the coil-shape heavy article above and below said pallet body is permitted.

18. The method of discharging a heavy article according to claims 14 or 15, wherein the number of said exhaust nozzles is four, said four exhaust nozzles are disposed in a quadrangle configuration, and wherein the nozzle disposed at the right front in a direction of transportation is a right-front nozzle, the nozzle disposed at the right rear is a right-rear nozzle, the nozzle disposed at the left front is a left-front nozzle and the nozzle disposed left rear is a left-rear nozzle, said nozzles forming each of four pairs composed of a pair formed by said right-front nozzle and said right-rear nozzle, a pair formed by said left-front nozzle and said left-rear nozzle, a pair formed by said right-front nozzle and said left-front nozzle and a pair formed by said right-rear nozzle and said left-rear nozzle are connected to each other through a connecting pipe.

19. The method of discharging a heavy article according to claims 14 or 15, wherein said transporting receptacle is a container.

20. The method of discharging a heavy article according to claim 14, wherein when the number of said pallet for the coil-shape heavy article for transporting in said transporting receptacle is one, the size of the one pallet for the coil-shape heavy article is substantially the same as the planar size of said transporting receptacle and when the number of said pallet for the coil-shape heavy article is two or more, the size of the combined pallets for the coil-shape heavy article is substantially the same as the planar size of said transporting receptacle.

21. The method of discharging a heavy article according to claim 14, wherein said holding portion includes inclined surfaces, a pair of said inclined surfaces are formed opposite to each other, and said coil securing member includes movement inhibiting members disposed on the two sides of the coil.

22. The method of discharging a heavy article according to claim 15, wherein when the number of said pallet for the coil-shape heavy article for transporting in said transporting receptacle is one, the size of the one pallet for the coil-shape heavy article is substantially the same as the planar size of said transporting receptacle and when the number of said pallet for the coil-shape heavy article is two or more, the size of the combined pallets for the coil-shape heavy article is substantially the same as the planar size of said transporting receptacle.

23. The method of discharging a heavy article according to claim 15, wherein said holding portion includes inclined surfaces, a pair of said inclined surfaces are formed opposite to each other, and said coil securing member includes movement inhibiting members disposed on the two sides of the coil.

* * * * *